US009100734B2

(12) United States Patent
Visser

(10) Patent No.: US 9,100,734 B2
(45) Date of Patent: Aug. 4, 2015

(54) SYSTEMS, METHODS, APPARATUS, AND COMPUTER-READABLE MEDIA FOR FAR-FIELD MULTI-SOURCE TRACKING AND SEPARATION

(75) Inventor: Erik Visser, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 586 days.

(21) Appl. No.: 13/243,492

(22) Filed: Sep. 23, 2011

(65) Prior Publication Data

US 2012/0099732 A1 Apr. 26, 2012

Related U.S. Application Data

(60) Provisional application No. 61/405,922, filed on Oct. 22, 2010.

(51) Int. Cl.

| | |
|---|---|
| ***H04R 5/00*** | (2006.01) |
| ***H04R 3/00*** | (2006.01) |
| ***G10L 21/0272*** | (2013.01) |
| *G10L 21/0216* | (2013.01) |

(52) U.S. Cl.

CPC ..... *H04R 3/005* (2013.01); *G10L 21/0272* (2013.01); *G10L 2021/02166* (2013.01); *H04R 2430/23* (2013.01)

(58) Field of Classification Search

CPC ..... G10L 21/0208; G10L 21/0232; G10L 21/0264; G10L 21/0272; G10L 21/028; G10L 21/038; G10L 25/18; G10L 25/81; G10L 25/84; G10L 25/87; G10L 25/51; G10L 2021/02087; H04R 2227/009; H04R 2225/43

USPC ..... 381/26, 56, 317, 320, 71.11, 71.12, 91, 381/92, 94.2, 94.3, 122; 704/226, 200.1, 704/205; 700/94

See application file for complete search history.

(56) References Cited

U.S. PATENT DOCUMENTS

| | | | | |
|---|---|---|---|---|
| 5,943,367 | A * | 8/1999 | Theunis | 375/285 |
| 6,339,758 | B1 | 1/2002 | Kanazawa et al. | |
| 7,174,022 | B1 | 2/2007 | Zhang et al. | |
| 2005/0047611 | A1 | 3/2005 | Mao | |

(Continued)

FOREIGN PATENT DOCUMENTS

| | | | |
|---|---|---|---|
| CN | 101800919 | A | 8/2010 |
| EP | 1081985 | A2 | 3/2001 |

(Continued)

OTHER PUBLICATIONS

Charoensak, "System-Level Design of Low-Cost FPGA Hardware for Real-Time ICA-Based Blind Source Separation", IEEE International SOC Conference Proceedings, 2004, p. 139-140.*

(Continued)

*Primary Examiner* — Leshui Zhang

(74) *Attorney, Agent, or Firm* — Austin Rapp & Hardman

(57) ABSTRACT

An apparatus for multichannel signal processing separates signal components from different acoustic sources by initializing a separation filter bank with beams in the estimated source directions, adapting the separation filter bank under specified constraints, and normalizing an adapted solution based on a maximum response with respect to direction. Such an apparatus may be used to separate signal components from sources that are close to one another in the far field of the microphone array.

40 Claims, 33 Drawing Sheets

(56) References Cited

U.S. PATENT DOCUMENTS

| | | | | |
|---|---|---|---|---|
| 2008/0181430 | A1 | 7/2008 | Zhang et al. | |
| 2008/0306739 | A1 | 12/2008 | Nakajima et al. | |
| 2009/0012779 | A1* | 1/2009 | Ikeda et al. | 704/205 |
| 2009/0164212 | A1 | 6/2009 | Chan et al. | |
| 2010/0046770 | A1 | 2/2010 | Chan et al. | |
| 2010/0183178 | A1 | 7/2010 | Kellermann et al. | |
| 2010/0185308 | A1 | 7/2010 | Yoshida et al. | |
| 2011/0307251 | A1* | 12/2011 | Tashev et al. | 704/231 |

FOREIGN PATENT DOCUMENTS

| | | | |
|---|---|---|---|
| EP | 1400814 | A2 | 3/2004 |
| JP | 2000047699 | A | 2/2000 |
| JP | 2004258422 | A | 9/2004 |
| JP | 2007513530 | A | 5/2007 |
| JP | 2008145610 | A | 6/2008 |
| JP | 2008219458 | A | 9/2008 |
| JP | 2009533912 | A | 9/2009 |
| WO | WO-2005022951 | A2 | 3/2005 |
| WO | WO-2007118583 | A1 | 10/2007 |
| WO | WO-2009086017 | | 7/2009 |
| WO | WO-2010005050 | A1 | 1/2010 |
| WO | WO2010048620 | A1 | 4/2010 |

OTHER PUBLICATIONS

International Search Report and Written Opinion—PCT/US2011/055441—ISA/EPO—Apr. 3, 2012.

Bourgeois, et al., "Time-Domain Beamforming and Blind Source Separation: Speech Input in the Car Environment," Section 9, Springer, 2009, (ISBN 978-0-387-68835-0, e-ISBN 978-0-387-68836-7).

Ikram, M.Z. et al., "A beamforming approach to permutation alignment for multichannel frequency-domain blind speech separation," Proc. IEEE International Conference on Acoustics, Speech, and Signal Processing, 2002 (ICASSP '02), May 13-17, 2002, Orlando, FL, vol. 1, pp. I-881-I-884, 2002.

Lombard, A. et al., "Multidimensional localization of multiple sound sources using averaged directivity patterns of Blind Source Separation systems," ICASSP 2009—2009 IEEE International Conference on Acoustics, Speech and Signal Processing, Apr. 19-24, 2009, Taipei, TW, pp. 233-236, 2009.

Parra, L. et al., "An Adaptive Beamforming Perspective on Convolutive Blind Source Separation," Available online Sep. 22, 2011 at bme.ccny.cuny.edu/faculty/lparra/publish/bsschapter.pdf, 18 pp.

Parra, L.C. et al., "Geometric Source Separation: Merging Convolutive Source Separation With Geometric Beamforming," IEEE Transactions on Speech and Audio Processing, vol. 10, No. 6, Sep. 2002, pp. 352-362.

Smaragdis, P. "Blind Separation of Convolved Mixtures in the Frequency Domain," 1998. Available online Sep. 22, 2011 at www.cs.illinois.edu/~paris/pubs/smaragdis-neurocomp.pdf, 8 pp.

Wang, L. et al., "Combining Superdirective Beamforming and Frequency-Domain Blind Source Separation for Highly Reverberant Signals," EURASIP Journal on Audio, Speech, and Music Processing, vol. 2010, Article ID 797962, 13 pp.

Wu, W.-C. et al., "Multiple-sound-source localization scheme based on feedback-architecture source separation," 52nd IEEE International Midwest Symposium on Circuits and Systems, 2009. MWSCAS '09, Aug. 2-5, 2009, pp. 669-672.

Zhang, C. et al., "Maximum Likelihood Sound Source Localization and Beamforming for Directional Microphone Arrays in Distributed Meetings," available online Sep. 22, 2011 at http://research.microsoft.com/~zhang/Papers/ML-SSL-IEEE-TMM.pdf, 11 pp.

Zhang, C. et al., "Maximum likelihood sound source localization for multiple directional microphones," available online Sep. 22, 2011 at research.microsoft.com/pubs/146851/SSL_ICASSP2007.pdf, 4 pp.

* cited by examiner

8cm mic spacing

4cm mic spacing

SYSTEMS, METHODS, APPARATUS, AND COMPUTER-READABLE MEDIA FOR FAR-FIELD MULTI-SOURCE TRACKING AND SEPARATION

CLAIM OF PRIORITY UNDER 35 U.S.C. §119

The present application for patent claims priority to Provisional Application No. 61/405,922, entitled "SYSTEMS, METHODS, APPARATUS, AND COMPUTER-READABLE MEDIA FOR FAR-FIELD MULTI-SOURCE TRACKING AND SEPARATION," filed Oct. 22, 2010, and assigned to the assignee hereof.

BACKGROUND

Field

This disclosure relates to audio signal processing.

SUMMARY

An apparatus for processing a multichannel signal according to a general configuration includes a filter bank having (A) a first filter configured to apply a plurality of first coefficients to a first signal that is based on the multichannel signal to produce a first output signal and (B) a second filter configured to apply a plurality of second coefficients to a second signal that is based on the multichannel signal to produce a second output signal. This apparatus also includes a filter orientation module configured to produce an initial set of values for the plurality of first coefficients, based on a first source direction, and to produce an initial set of values for the plurality of second coefficients, based on a second source direction that is different than the first source direction. This apparatus also includes a filter updating module configured to determine, based on a plurality of responses, a response that has a specified property, and to update the initial set of values for the plurality of first coefficients, based on said response that has the specified property. In this apparatus, each response of said plurality of responses is a response at a corresponding one of a plurality of directions.

Figure 26A:
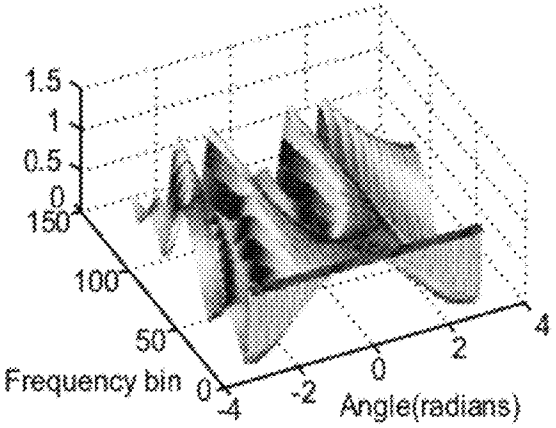
FIGS. 26A-26C show examples of microphone spacings and beam patterns from the resulting arrays.
Figure 26B:
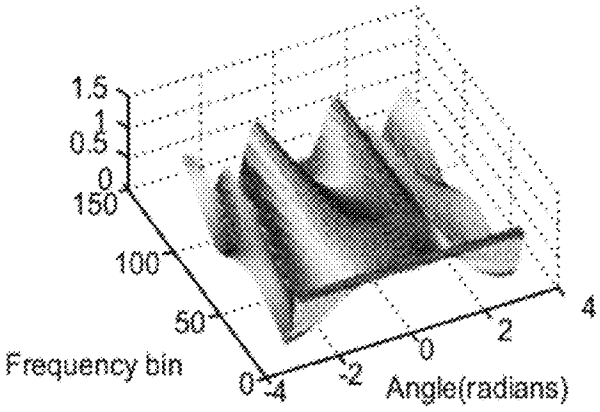
Figure 26C:
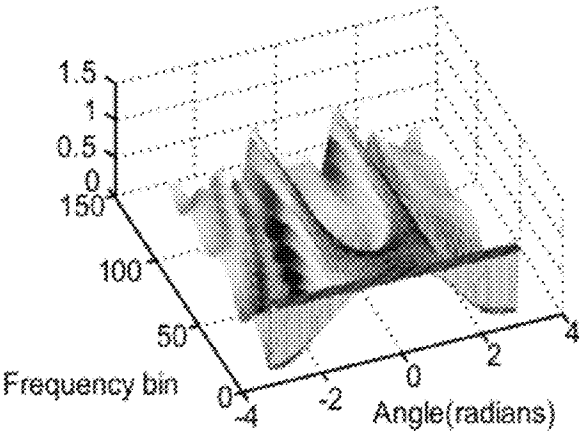

It is noted that FIGS. 3A-3C, 4, 5, 8-10, and 21 and the plots in FIGS. 26A-26C are grayscale mappings of pseudocolor figures that present only part of the information displayed in the original figures. In these figures, the original midscale value is mapped to white, and the original minimum and maximum values are both mapped to black.

DETAILED DESCRIPTION

Data-independent methods for beamforming are generally useful in multichannel signal processing to separate sound components arriving from different sources (e.g., from a desired source and from an interfering source), based on estimates of the directions of the respective sources. Existing methods of source direction estimation and beamforming are typically inadequate for reliable separation of sound components arriving from distant sources, however, especially for a case in which the desired and interfering signals arrive from similar directions. It may be desirable to use an adaptive solution that is based on information from the actual separated outputs of the spatial filtering operation, rather than only an open-loop beamforming solution. Unfortunately, an adaptive solution that provides a sufficient level of discrimination may have a long convergence period. A solution having a long convergence period may be impractical for a real-time application that involves distant sound sources which may be in motion and/or in close proximity to one another.

Signals from distant sources are also more likely to suffer from reverberation, and an adaptive algorithm may introduce additional reverberation into the separated signals. Existing speech de-reverberation methods include inverse filtering, which attempts to invert the room impulse response without whitening the spectrum of the source signals (e.g., speech). However, the room transfer function is highly dependent on source location. Consequently, such methods typically require blind inversion of the room impulse transfer function, which may lead to substantial speech distortion.

It may be desirable to provide a system for dereverberation and/or interference cancellation that may be used, for example, to improve speech quality for devices used within rooms and/or in the presence of interfering sources. Examples of applications for such a system include a set-top box or other device that is configured to support a voice communications application such as telephony. A performance advantage of a solution as described herein over competing solutions may be expected to increase as the difference between directions of the desired and interfering sources becomes smaller.

Unless expressly limited by its context, the term "signal" is used herein to indicate any of its ordinary meanings, including a state of a memory location (or set of memory locations) as expressed on a wire, bus, or other transmission medium. Unless expressly limited by its context, the term "generating" is used herein to indicate any of its ordinary meanings, such as computing or otherwise producing. Unless expressly limited by its context, the term "calculating" is used herein to indicate any of its ordinary meanings, such as computing, evaluating, smoothing, and/or selecting from a plurality of values. Unless expressly limited by its context, the term "obtaining" is used to indicate any of its ordinary meanings, such as calculating, deriving, receiving (e.g., from an external device), and/or retrieving (e.g., from an array of storage elements). Unless expressly limited by its context, the term "selecting" is used to indicate any of its ordinary meanings, such as identifying, indicating, applying, and/or using at least one, and fewer than all, of a set of two or more. Where the term "comprising" is used in the present description and claims, it does not exclude other elements or operations. The term "based on" (as in "A is based on B") is used to indicate any of its ordinary meanings, including the cases (i) "derived from" (e.g., "B is a precursor of A"), (ii) "based on at least" (e.g., "A is based on at least B") and, if appropriate in the particular context, (iii) "equal to" (e.g., "A is equal to B"). Similarly, the term "in response to" is used to indicate any of its ordinary meanings, including "in response to at least."

References to a "location" of a microphone of a multi-microphone audio sensing device indicate the location of the center of an acoustically sensitive face of the microphone, unless otherwise indicated by the context. The term "channel" is used at times to indicate a signal path and at other times to indicate a signal carried by such a path, according to the particular context. Unless otherwise indicated, the term "series" is used to indicate a sequence of two or more items. The term "logarithm" is used to indicate the base-ten logarithm, although extensions of such an operation to other bases are within the scope of this disclosure. The term "frequency component" is used to indicate one among a set of frequencies or frequency bands of a signal, such as a sample of a frequency domain representation of the signal (e.g., as produced by a fast Fourier transform) or a subband of the signal (e.g., a Bark scale or mel scale subband).

Unless indicated otherwise, any disclosure of an operation of an apparatus having a particular feature is also expressly intended to disclose a method having an analogous feature (and vice versa), and any disclosure of an operation of an apparatus according to a particular configuration is also expressly intended to disclose a method according to an analogous configuration (and vice versa). The term "configuration" may be used in reference to a method, apparatus, and/or system as indicated by its particular context. The terms "method," "process," "procedure," and "technique" are used generically and interchangeably unless otherwise indicated by the particular context. The terms "apparatus" and "device" are also used generically and interchangeably unless otherwise indicated by the particular context. The terms "element" and "module" are typically used to indicate a portion of a greater configuration. Unless expressly limited by its context, the term "system" is used herein to indicate any of its ordinary meanings, including "a group of elements that interact to serve a common purpose." Any incorporation by reference of a portion of a document shall also be understood to incorporate definitions of terms or variables that are referenced within the portion, where such definitions appear elsewhere in the document, as well as any figures referenced in the incorporated portion. Unless initially introduced by a definite article, an ordinal term (e.g., "first," "second," "third," etc.) used to modify a claim element does not by itself indicate any priority or order of the claim element with respect to another, but rather merely distinguishes the claim element from another claim element having a same name (but for use of the ordinal term). Unless expressly limited by its context, the term "plurality" is used herein to indicate an integer quantity that is greater than one.

Applications for far-field audio processing (e.g., speech enhancement) may arise when the sound source or sources are located at a large distance from the sound recording device (e.g., a distance of two meters or more). In many applications involving a television display, for example, human speakers sitting on a couch and performing activities such as watching television, playing a video game, interacting with a music video game, etc. are typically located at least two meters away from the display.

In a first example of a far-field use case, a recording of an acoustic scene that includes several different sound sources is decomposed to obtain respective sound components from one or more of the individual sources. For example, it may be desirable to record a live musical performance such that sounds from different sources (e.g., different voices and/or instruments) are separated. In another such example, it may be desirable to distinguish between voice inputs (e.g., commands and/or singing) from two or more different players of a videogame, such as a "rock band" type of videogame.

In a second example of a far-field use case, a multi-microphone device is used to perform far-field speech enhancement by narrowing the acoustic field of view (also called "zoom-in microphone"). A user watching a scene through a camera may use the camera's lens zoom function to selectively zoom the visual field of view to an individual speaker or other sound source, for example. It may be desirable to implement the camera such that the acoustic region being recorded is also narrowed to the selected source, in synchronism with the visual zoom operation, to create a complementary acoustic "zoom-in" effect.

Figure 32B:
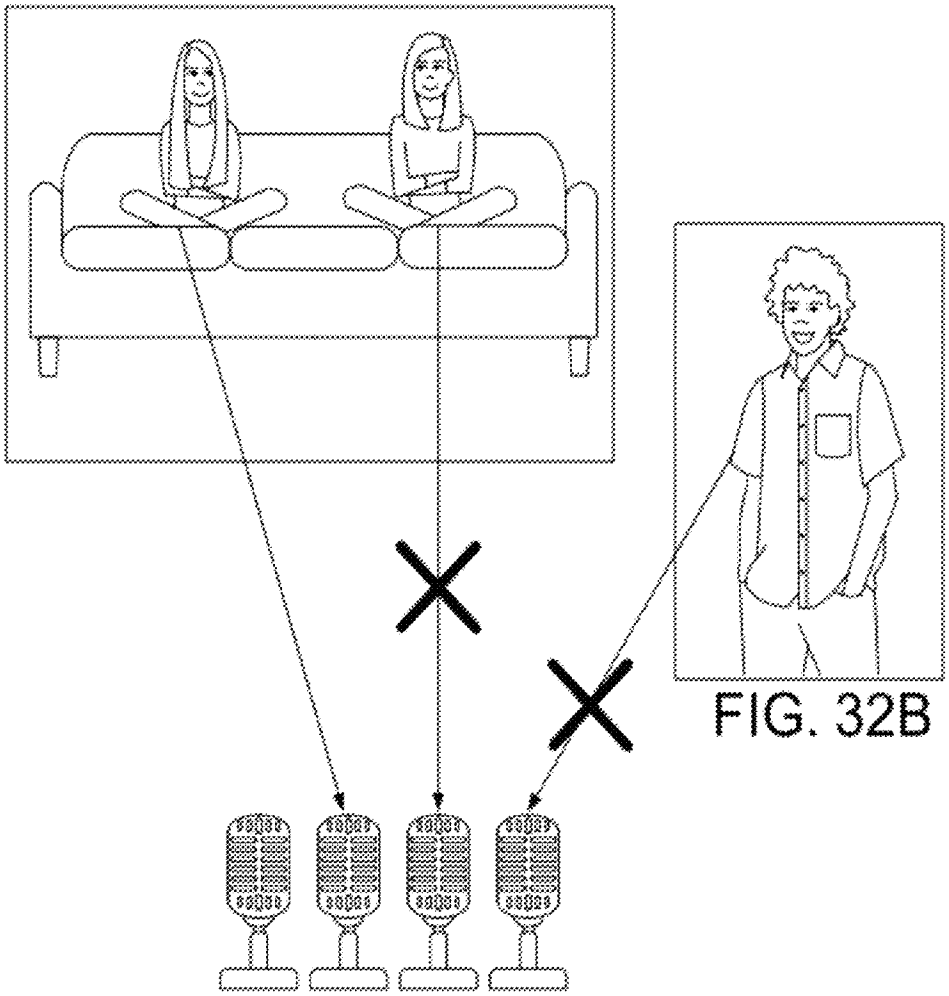
FIGS. 32A and 32B show examples of far-field use cases for an implementation of audio sensing device D10.
Figure 32A:
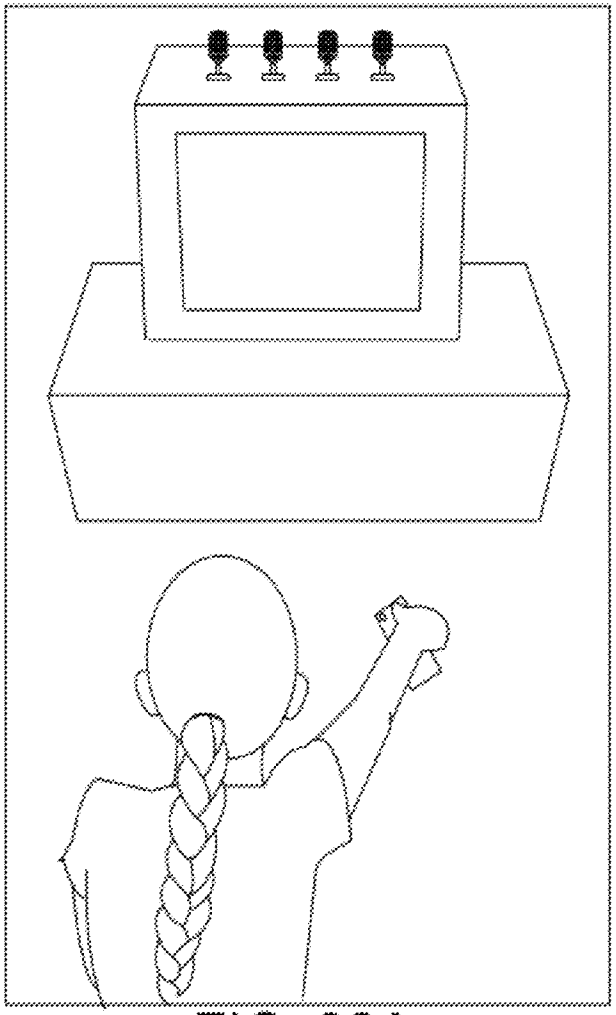

In a third example of a far-field use case, a sound recording system having a microphone array mounted on or in a television set (e.g., along a top margin of the screen) or set-top box is configured to differentiate between users sitting next to each other on a couch about two or three meters away (e.g., as shown in FIGS. 32A and 32B). It may be desirable, for example, to separate the voices of speakers who are sitting shoulder-to-shoulder. Such an operation may be designed to create the audible impression that the speaker is standing in front of the listener (as opposed to a sound that is scattered in the room). Applications for such a use case include telephony and voice-activated remote control (e.g., for voice-controlled selection among television channels, video sources, and/or volume control settings).

Far-field speech enhancement applications present unique challenges. In these far-field use cases, the increased distance between the sources and transducers tends to result in strong reverberation in the recorded signal, especially in an office, a home or vehicle interior, or another enclosed space. Source location uncertainty also contributes to a need for specific robust solutions for far-field applications. Since the distance between the desired speaker and the microphones is large, the direct-path-to-reverberation ratio is small and the source location is difficult to determine. It may also be desirable in a far-field use case to perform additional speech spectrum shaping, such as low-frequency formant synthesis and/or high-frequency boost, to counteract effects such as room low-pass filtering effect and high reverberation power in low frequencies.

Discriminating a sound component arriving from a particular distant source is not simply a matter of narrowing a beam pattern to a particular direction. While the spatial width of a beam pattern may be narrowed by increasing the size of the filter (e.g., by using a longer set of initial coefficient values to define the beam pattern), relying only on a single direction of arrival for a source may actually cause the filter to miss most of the source energy. Due to effects such as reverberation, for example, the source signal typically arrives from somewhat different directions at different frequencies, such that the direction of arrival for a distant source is typically not well-defined. Consequently, the energy of the signal may be spread out over a range of angles rather than concentrated in a particular direction, and it may be more useful to characterize the angle of arrival for a particular source as a center of gravity over a range of frequencies rather than as a peak at a single direction.

It may be desirable for the filter's beam pattern to cover the width of a concentration of directions at different frequencies rather than just a single direction (e.g., the direction indicated by the maximum energy at any one frequency). For example, it may be desirable to allow the beam to point in slightly different directions, within the width of such a concentration, at different corresponding frequencies.

An adaptive beamforming algorithm may be used to obtain a filter that has a maximum response in a particular direction at one frequency and a maximum response in a different direction at another frequency. Adaptive beamformers typically depend on accurate voice activity detection, however, which is difficult to achieve for a far-field speaker. Such an algorithm may also perform poorly when the signals from the desired source and the interfering source have similar spectra (e.g., when both of the two sources are people speaking). As an alternative to an adaptive beamformer, a blind source separation (BSS) solution may also be used to obtain a filter that has a maximum response in a particular direction at one frequency and a maximum response in a different direction at another frequency. However, such an algorithm may exhibit slow convergence, convergence to local minima, and/or a scaling ambiguity.

It may be desirable to combine a data-independent, open-loop approach that provides good initial conditions (e.g., an MVDR beamformer) with a closed-loop method that minimizes correlation between outputs without the use of a voice activity detector (e.g., BSS), thus providing a refined and robust separation solution. Because a BSS method performs an adaptation over time, it may be expected to produce a robust solution even in a reverberant environment.

In contrast to existing BSS initialization approaches, which use null beams to initialize the filters, a solution as described herein uses source beams to initialize the filters to focus in specified source directions. Without such initialization, it may not be practical to expect a BSS method to adapt to a useful solution in real time.

Figure 1A:
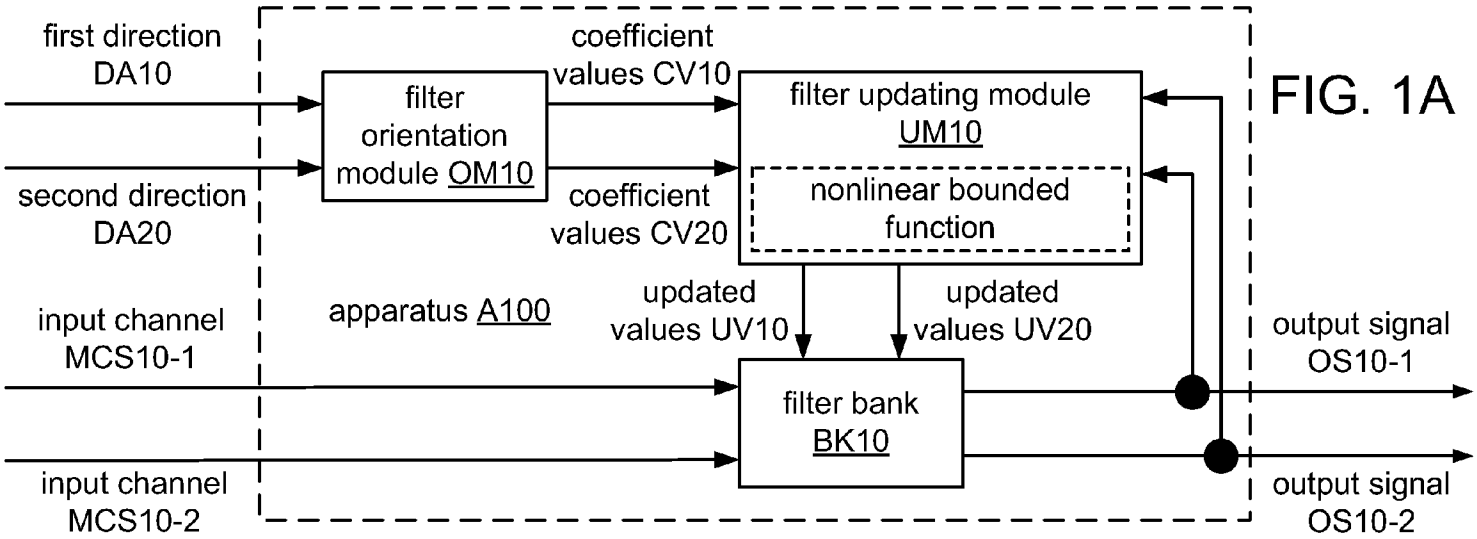
FIG. 1A shows a block diagram of an apparatus A100 according to a general configuration.

FIG. 1A shows a block diagram of an apparatus A100 according to a general configuration that includes a filter bank BK10, a filter orientation module OM10, and a filter updating module UM10 and is arranged to receive a multichannel signal (in this example, input channels MCS10-1 and MCS10-2). Filter bank BK10 is configured to apply a plurality of first coefficients to a first signal that is based on the multichannel signal to produce a first output signal O510-1. Filter bank BK10 is also configured to apply a plurality of second coefficients to a second signal that is based on the multichannel signal to produce a second output signal O510-2. Filter orientation module OM10 is configured to produce an initial set of values CV10 for the plurality of first coefficients that is based on a first source direction DA10, and to produce an initial set of values CV20 for the plurality of second coefficients that is based on a second source direction DA20 that is different than the first source direction DA10. Filter updating module UM10 is configured to update the initial sets of values for the pluralities of first and second coefficients to produce corresponding updated sets of values UV10 and UV20, based on information from the first and second output signals.

Figure 1C:
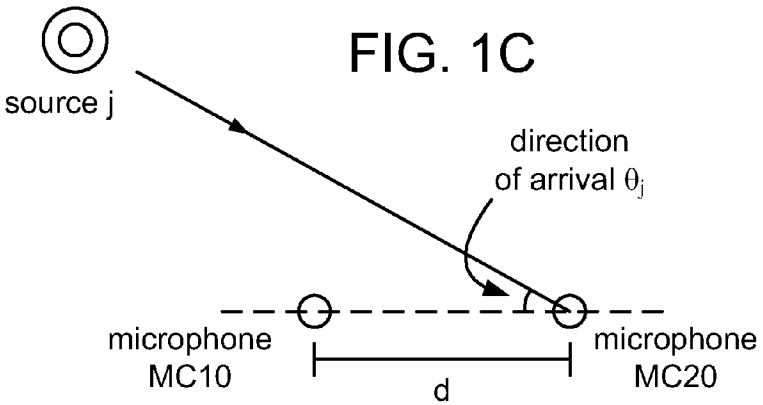
FIG. 1C illustrates a direction of arrival $\theta_j$, relative to an axis of microphones MC10 and MC20 of array R100, of a signal component received from a point source j.
Figure 1B:
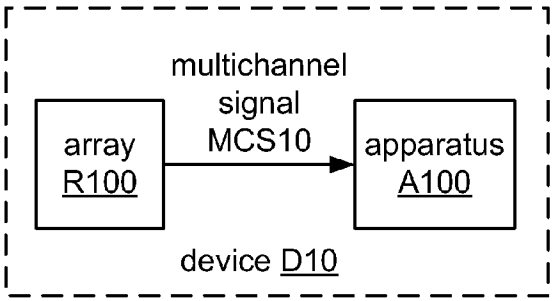
FIG. 1B shows a block diagram of a device D10 that includes a microphone array R100 and an instance of apparatus A100.

It may be desirable for each of source directions DA10 and DA20 to indicate an estimated direction of a corresponding sound source relative to a microphone array that produces input channels MCS10-1 and MCS10-2 (e.g., relative to an axis of the microphones of the array). FIG. 1B shows a block diagram of a device D10 that includes a microphone array R100 and an instance of apparatus A100 that is arranged to receive a multichannel signal MCS10 (e.g., including input channels MCS10-1 and MCS10-2) from the array. FIG. 1C illustrates a direction of arrival $\theta_j$, relative to an axis of microphones MC10 and MC20 of array R100, of a signal component received from a point source j. The axis of the array is defined as a line that passes through the centers of the acoustically sensitive faces of the microphones. In this example, the label d denotes the distance between microphones MC10 and MC20.

Filter orientation module OM10 may be implemented to execute a beamforming algorithm to generate initial sets of coefficient values CV10, CV20 that describe beams in the respective source directions DA10, DA20. Examples of beamforming algorithms include DSB (delay-and-sum beamformer), LCMV (linear constraint minimum variance), and MVDR (minimum variance distortionless response). In one example, filter orientation module OM10 is implemented to calculate the N×M coefficient matrix W of a beamformer such that each filter has zero response (or null beams) in the other source directions, according to a data-independent expression such as $$W(\omega)=D^H(\omega,\theta)[D(\omega,\theta)D^H(\omega,\theta)+r(\omega)\times I]^{-1},$$

where r(ω) is a regularization term to compensate for noninvertibility. In another example, filter orientation module OM10 is implemented to calculate the N×M coefficient matrix W of an MVDR beamformer according to an expression such as $$W=\frac{\Phi^{-1}D(\omega)}{D^H(\omega)\Phi^{-1}D(\omega)}. \quad (1)$$

In these examples, N denotes the number of output channels, M denotes the number of input channels (e.g., the number of microphones), Φ denotes the normalized cross-power spectral density matrix of the noise, D(ω) denotes the M×N array manifold matrix (also called the directivity matrix), and the superscript H denotes the conjugate transpose function. It is typical for M to be greater than or equal to N.

Each row of coefficient matrix W defines initial values for coefficients of a corresponding filter of filter bank BK10. In one example, the first row of coefficient matrix W defines the initial values CV10, and the second row of coefficient matrix W defines the initial values CV20. In another example, the first row of coefficient matrix W defines the initial values CV20, and the second row of coefficient matrix W defines the initial values CV10.

Each column j of matrix D is a directivity vector (or "steering vector") for far-field source j over frequency w that may be expressed as $$D_{mj}(\omega)=\exp(-i\times\cos(\theta_j)\times\mathrm{pos}(m)\times\omega/c).$$

In this expression, i denotes the imaginary number, c denotes the propagation velocity of sound in the medium (e.g., 340 m/s in air), $\theta_j$ denotes the direction of source j with respect to the axis of the microphone array (e.g., direction DA10 for j=1 and direction DA20 for j=2) as an incident angle of arrival as shown in FIG. 1C, and pos(m) denotes the spatial coordinates of the m-th microphone in an array of M microphones. For a linear array of microphones with uniform inter-microphone spacing d, the factor pos(m) may be expressed as (m−1)d.

For a diffuse noise field, the matrix Φ may be replaced using a coherence function Γ such as $$\Gamma_{ij}=\begin{cases}\mathrm{sinc}\left(\frac{\omega d_{ij}}{c}\right), & i\neq j\\ 1, & i=j\end{cases},$$

where $d_{ij}$ denotes the distance between microphones i and j. In a further example, the matrix Φ is replaced by (Γ+λ(ω)I), where λ(ω) is a diagonal loading factor (e.g., for stability).

Typically the number of output channels N of filter bank BK10 is less than or equal to the number of input channels M. Although FIG. 1A shows an implementation of apparatus A100 in which the value of N is two (i.e., with two output channels OS10-1 and OS10-2), it is understood that N and M may have values greater than two (e.g., three, four, or more). In such a general case, filter bank BK10 is implemented to include N filters, and filter orientation module OM10 is implemented to produce N corresponding sets of initial coefficient values for these filters, and such extension of these principles is expressly contemplated and hereby disclosed.

Figure 2:
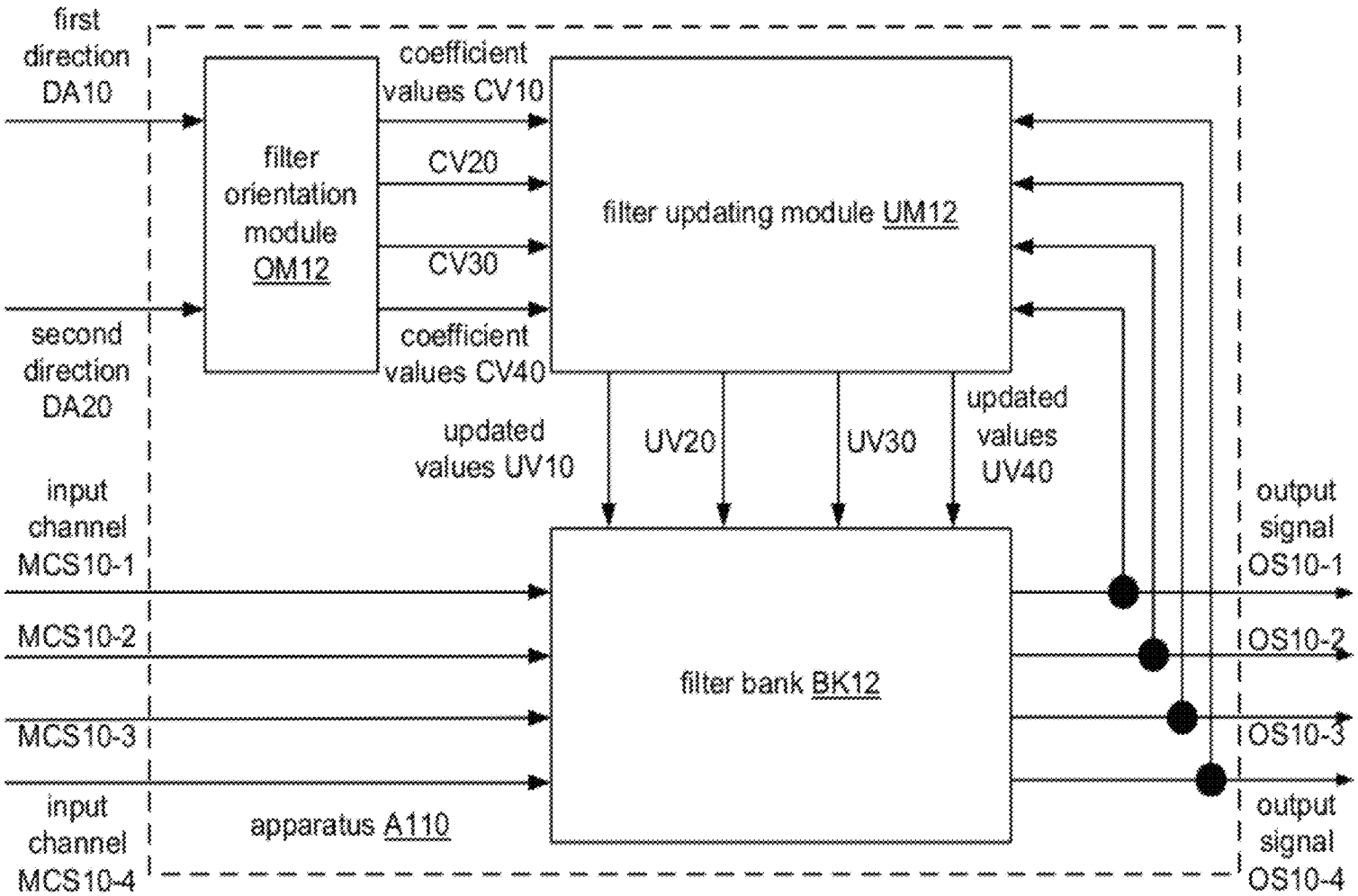
FIG. 2 shows a block diagram of an implementation A110 of apparatus A100.

For example, FIG. 2 shows a block diagram of an implementation A110 of apparatus A100 in which the values of both of N and M are four. Apparatus A110 includes an implementation BK12 of filter bank BK10 that includes four filters, each arranged to filter a respective one of input channels MCS10-1, MCS10-2, MCS10-3, and MCS10-4 to produce a corresponding one of output signals (or channels) OS10-1, OS10-2, OS10-3, and OS10-4. Apparatus A100 also includes an implementation OM12 of filter orientation module OM10 that is configured to produce initial sets of coefficient values CV10, CV20, CV30, and CV40 for the filters of filter bank BK12, and an implementation AM12 of filter adaptation module AM10 that is configured to adapt the initial sets of coefficient values to produce corresponding updated sets of values UV10, UV20, UV30, and UV40.

Figure 3A:
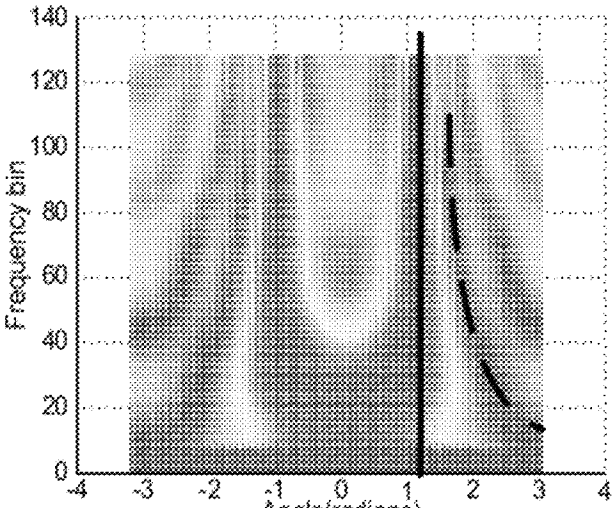
FIG. 3A shows an example of an MVDR beam pattern.
Figure 3C:
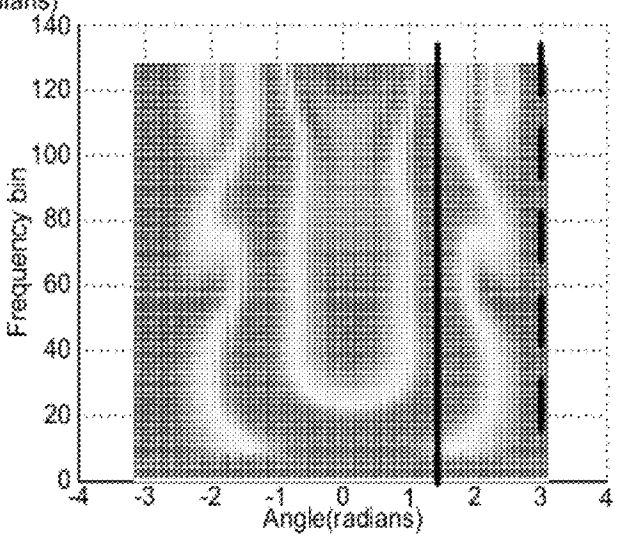
FIGS. 3B and 3C show variations of the beam pattern of FIG. 3A under two different sets of initial conditions.
Figure 3B:
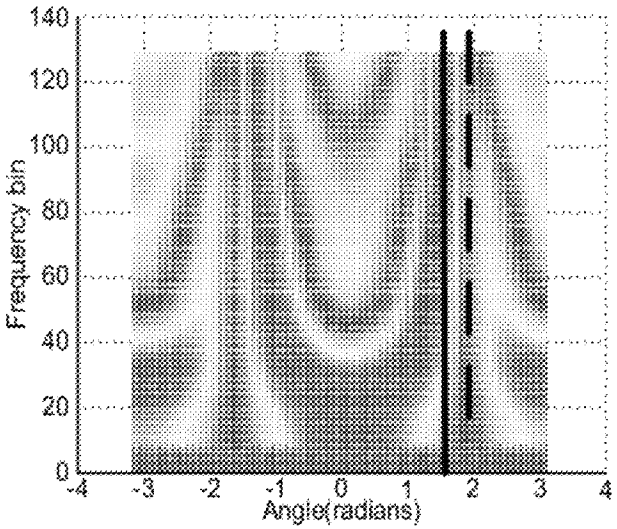

FIG. 3A shows a plot of an initial response of a filter of filter bank BK10 in terms of frequency bin vs. incident angle (also called a "beam pattern") for a case in which the coefficient values of the filter are generated by filter orientation module OM10 according to an MVDR beamforming algorithm (e.g., expression (1) above). It may be seen that this response is symmetrical about the incident angle zero (e.g., the direction of the axis of the microphone array). FIGS. 3B and 3C show variations of this beam pattern under two different sets of initial conditions (e.g., different sets of estimated directions of arrival of sound from a desired source and sound from an interfering source). In these figures, high and low gain response amplitudes (e.g., the beams and null beams) are indicated in black, mid-range gain response amplitudes are indicated in white, and the approximate directions of the beams and null beams are indicated by the bold solid and dashed lines, respectively.

It may be desirable to implement filter orientation module OM10 to produce coefficient values CV10 and CV20 according to a beamformer design that is selected according to a compromise between directivity and sidelobe generation which is deemed appropriate for the particular application. Although the examples above describe frequency-domain beamformer designs, alternative implementations of filter orientation module OM10 that are configured to produce sets of coefficient values according to time-domain beamformer designs are also expressly contemplated and hereby disclosed.

Filter orientation module OM10 may be implemented to generate coefficient values CV10 and CV20 (e.g., by executing a beamforming algorithm as described above) or to retrieve coefficient values CV10 and CV20 from storage. For example, filter orientation module OM10 may be implemented to produce initial sets of coefficient values by selecting from among pre-calculated sets of values (e.g., beams) according to the source directions (e.g., DA10 and DA20). Such pre-calculated sets of coefficient values may be calculated off-line to cover a desired range of directions and/or frequencies at a corresponding desired resolution (e.g., a different set of coefficient values for each interval of five, ten, or twenty degrees in a range of from zero, twenty, or thirty degrees to 150, 160, or 180 degrees).

The initial coefficient values as produced by filter orientation module OM10 (e.g., CV10 and CV20) may not be sufficient to configure filter bank BK10 to provide a desired level of separation between the source signals. Even if the estimated source directions upon which these initial values are based (e.g., directions DA10 and DA20) are perfectly accurate, simply steering a filter to a certain direction may not provide the best separation between sources that are far away from the array, or the best focus on a particular distant source.

Filter updating module UM10 is configured to update the initial values for the first and second coefficients CV10 and CV20, based on information from the first and second output signals OS10-1 and OS10-2, to produce corresponding updated sets of values UV10 and UV20. For example, filter updating module UM10 may be implemented to perform an adaptive BSS algorithm to adapt the beam patterns described by these initial coefficient values.

A BSS method separates statistically independent signal components from different sources according to an expression such as $Y_j(\omega,l)=W(\omega)X_j(\omega,l)$, where $X_j$ denotes the j-th channel of the input (mixed) signal in the frequency domain, $Y_j$ denotes the j-th channel of the output (separated) signal in the frequency domain, ω denotes a frequency-bin index, l denotes a time-frame index, and W denotes the filter coefficient matrix. In general, a BSS method may be described as an adaptation over time of an unmixing matrix W according to an expression such as $$W_{l+r}(\omega)=W_l(\omega)+\mu[I-\langle\Phi(Y(\omega,l))Y(\omega,l)^H\rangle]E_l(\omega), \quad (2)$$

where r denotes an adaptation interval (or update rate) parameter, μ denotes an adaptation speed (or learning rate) factor, I denotes the identity matrix, the superscript H denotes the conjugate transpose function, Φ denotes an activation function, and the brackets ⟨•⟩ denote a time-averaging operation (e.g., over frames l to l+L−1, where L is typically less than or equal to r). In one example, the value of μ is 0.1. Expression (2) is also called a BSS learning rule or BSS adaptation rule. The activation function Φ is typically a nonlinear bounded function that may be selected to approximate the cumulative density function of the desired signal. Examples of the activation function Φ that may be used in such a method include the hyperbolic tangent function, the sigmoid function, and the sign function.

Filter updating module UM10 may be implemented to adapt the coefficient values produced by filter orientation module OM10 (e.g., CV10 and CV20) according to a BSS method as described herein. In such case, output signals OS10-1 and OS10-2 are channels of the frequency-domain signal Y (e.g., the first and second channels, respectively); the coefficient values CV10 and CV20 are the initial values of corresponding rows of unmixing matrix W (e.g., the first and second rows, respectively); and the adapted values are defined by the corresponding rows of unmixing matrix W (e.g., the first and second rows, respectively) after adaptation.

In a typical implementation of filter updating module UM10 for adaptation in a frequency domain, unmixing matrix W is a finite-impulse-response (FIR) polynomial matrix. Such a matrix has frequency transforms (e.g., discrete Fourier transforms) of FIR filters as elements. In a typical implementation of filter updating module UM10 for adaptation in the time domain, unmixing matrix W is an FIR matrix. Such a matrix has FIR filters as elements. It will be understood that in such cases, each initial set of coefficient values (e.g., CV10 and CV20) will typically describe multiple filters. For example, each initial set of coefficient values may describe a filter for each element of the corresponding row of unmixing matrix W. For a frequency-domain implementation, each initial set of coefficient values may describe, for each frequency bin of the multichannel signal, a transform of a filter for each element of the corresponding row of unmixing matrix W.

A BSS learning rule is typically designed to reduce a correlation between the output signals. For example, the BSS learning rule may be selected to minimize mutual information between the output signals, to increase statistical independence of the output signals, or to maximize the entropy of the output signals. In one example, filter updating module UM10 is implemented to perform a BSS method known as independent component analysis (ICA). In such case, filter updating module UM10 may be configured to use an activation function as described above or, for example, the activation function $\Phi(Y_j(\omega,l))=Y_j(\omega,l)/|Y_j(\omega,l)|$. Examples of well-known ICA implementations include Infomax, FastICA (available online at www-dot-cis-dot-hut-dot-fi/projects/ica/fastica), and JADE (Joint Approximate Diagonalization of Eigenmatrices).

Scaling and frequency permutation are two ambiguities commonly encountered in BSS. Although the initial beams produced by filter orientation module OM10 are not permuted, such an ambiguity may arise during adaptation in the case of ICA. In order to stay on a nonpermuted solution, it may be desirable instead to configure filter updating module UM10 to use independent vector analysis (IVA), a variation of complex ICA that uses a source prior which models expected dependencies among frequency bins. In this method, the activation function Φ is a multivariate activation function, such as $\Phi(Y_j(\omega,l)=Y_j(\omega,l)/(\Sigma_\omega|Y_j(\omega,l)|^p)^{1/p}$, where p has an integer value greater than or equal to one (e.g., 1, 2, or 3). In this function, the term in the denominator relates to the separated source spectra over all frequency bins. In this case, the permutation ambiguity is resolved.

The beam patterns defined by the resulting adapted coefficient values may appear convoluted rather than straight. Such patterns may be expected to provide better separation than the beam patterns defined by the initial coefficient values CV10 and CV20, which are typically insufficient for separation of distant sources. For example, an increase in interference cancellation from 10-12 dB to 18-20 dB has been observed. The solution represented by the adapted coefficient values may also be expected to be more robust to mismatches in microphone response (e.g., gain and/or phase response) than an open-loop beamforming solution.

Figure 4:
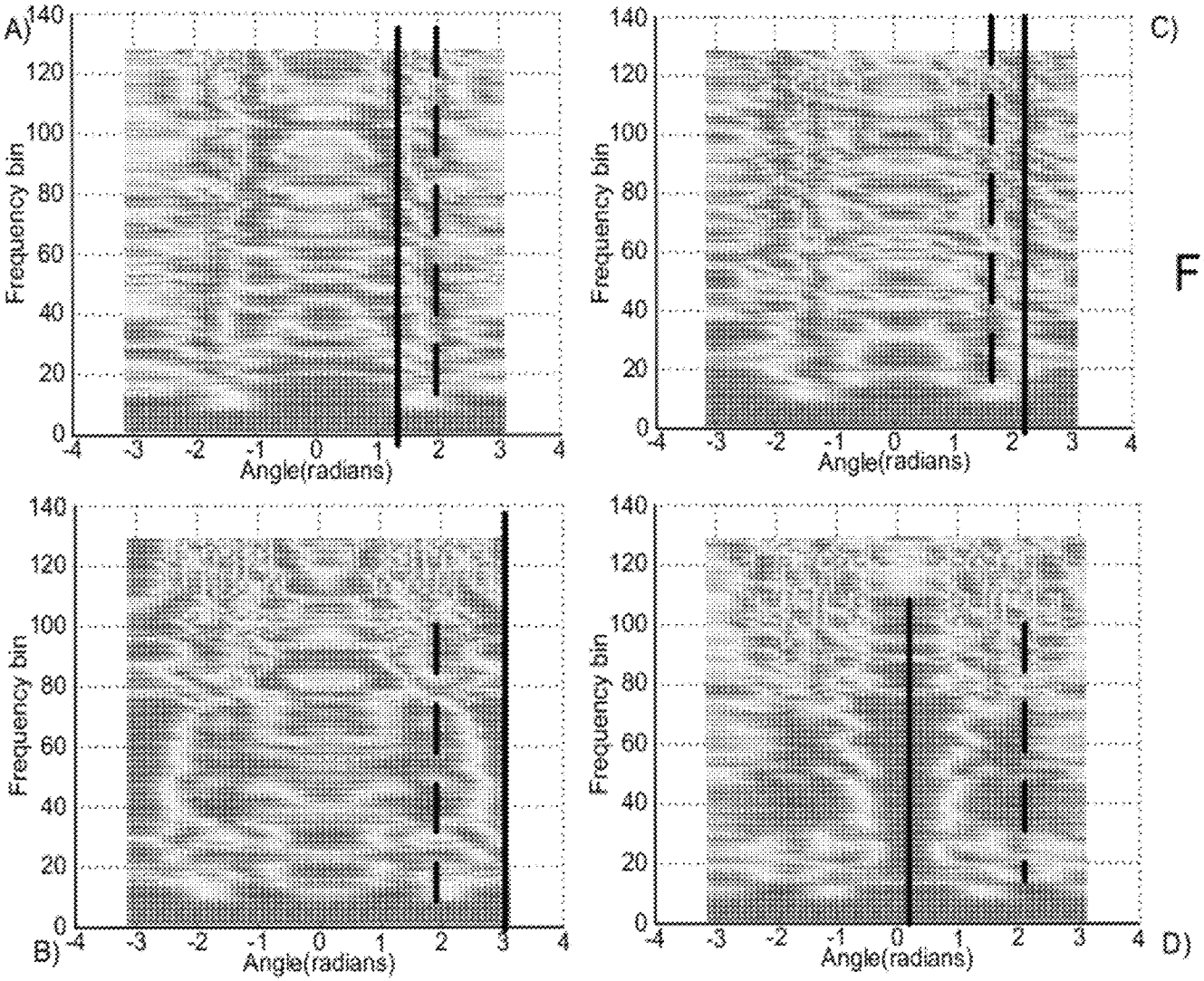
FIG. 4 shows an example of a set of four BSS filters for a case in which two directional sources are located two-and-one-half meters from the array and about forty to sixty degrees away from one another with respect to the array.
Figure 5:
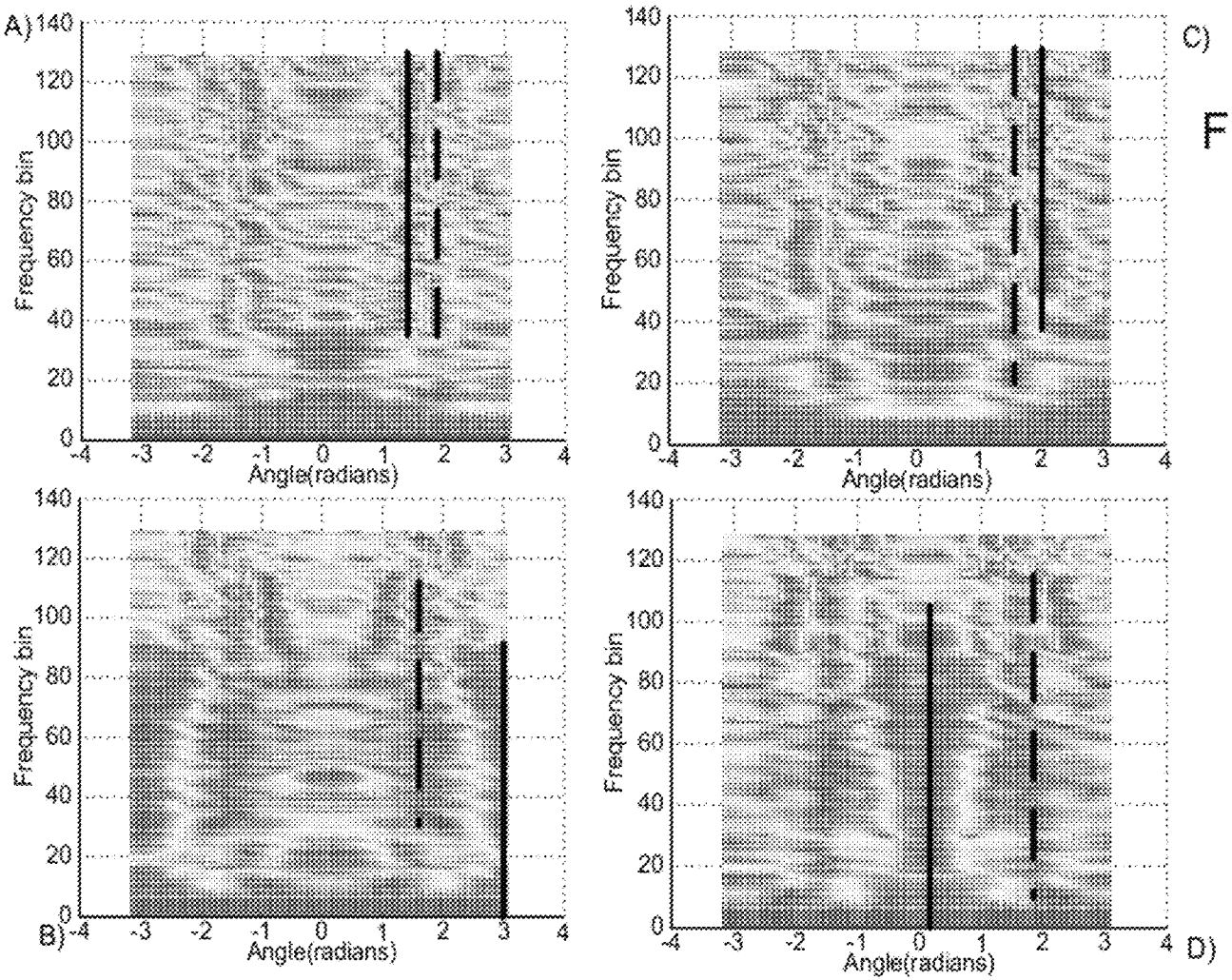
FIG. 5 shows an example of a set of four BSS filters for a case in which two directional sources are located two-and-one-half meters from the array and about fifteen degrees away from one another with respect to the array.
Figure 6:
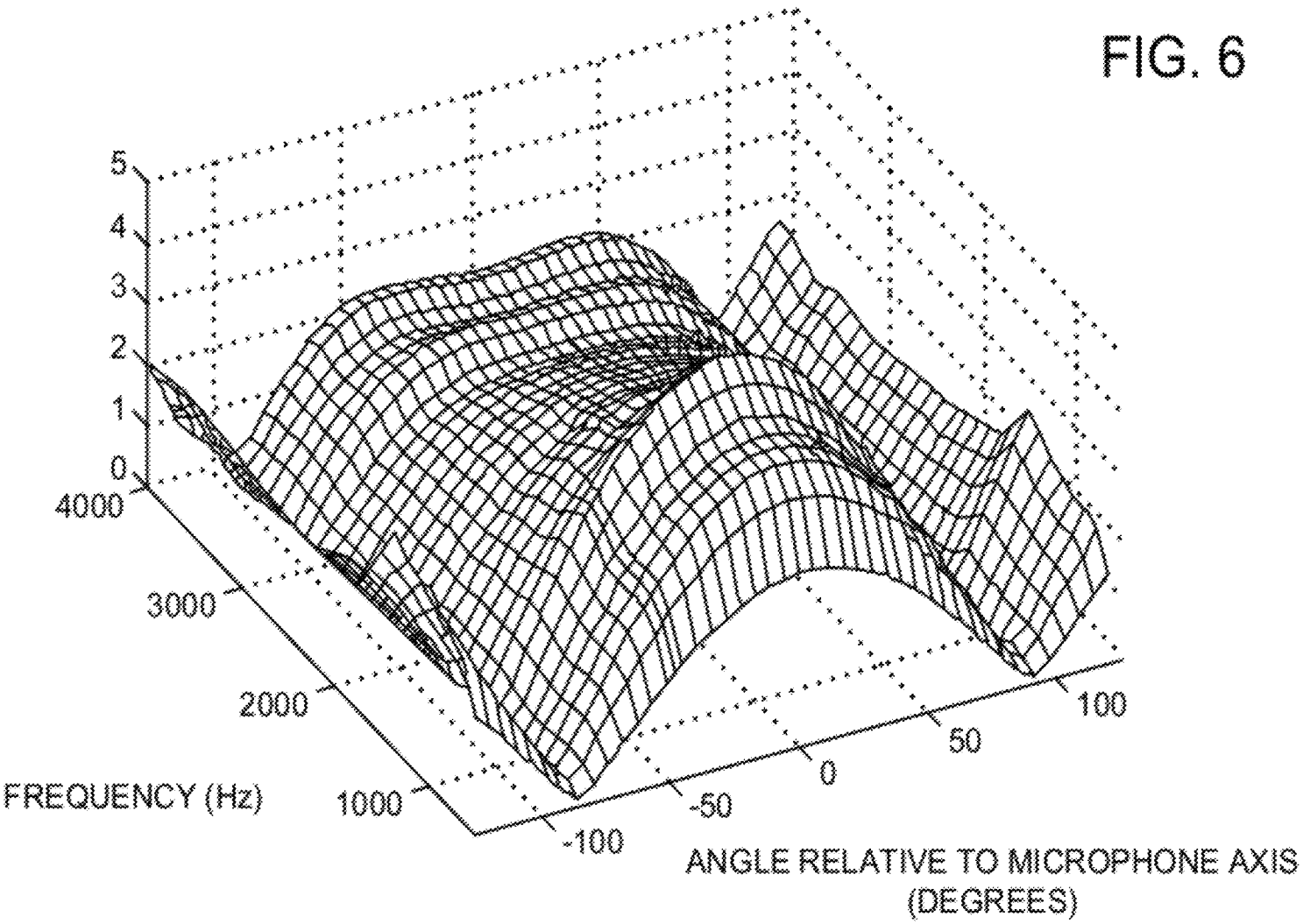
FIG. 6 shows an example of a BSS-adapted beam pattern from another perspective.

FIG. 4 shows beam patterns (e.g., as defined by the values obtained by filter updating module UM10 by adapting the sets of coefficient values CV10, CV20, CV30, and CV40, respectively) for each of the four filters in one example of filter bank BK12. In this case, two directional sources are located two-and-one-half meters from the array and about forty to sixty degrees away from one another with respect to the array. FIG. 5 shows beam patterns of these filters for another case in which the two directional sources are located two-and-one-half meters from the array and about fifteen degrees away from one another with respect to the array. In these figures, high and low gain response amplitudes (e.g., the beams and null beams) are indicated in black, mid-range gain response amplitudes are indicated in white, and the approximate directions of the beams and null beams are indicated by the bold solid and dashed lines, respectively. FIG. 6 shows an example of a beam pattern from another perspective for one of the adapted filters in a two-channel implementation of filter bank BK10.

Although the examples above describe filter adaptation in a frequency domain, alternative implementations of filter updating module UM10 that are configured to update sets of coefficient values in the time domain are also expressly contemplated and hereby disclosed. Time-domain BSS methods are immune from permutation ambiguity, although they typically involve the use of longer filters than frequency-domain BSS methods and may be unwieldy in practice.

While filters adapted using a BSS method generally achieve good separation, such an algorithm also tends to introduce additional reverberation into the separated signals, especially for distant sources. It may be desirable to control the spatial response of the adapted BSS solution by adding a geometric constraint to enforce a unity gain in a particular direction of arrival. As noted above, however, tailoring a filter response with respect to a single direction of arrival may be inadequate in a reverberant environment. Moreover, attempting to enforce beam directions (as opposed to null beam directions) in a BSS adaptation may create problems.

Filter updating module UM10 is configured to adjust at least one among the adapted set of values for the plurality of first coefficients and the adapted set of values for the plurality of second coefficients, based on a determined response of the adapted set of values with respect to direction. This determined response is based on a response that has a specified property and may have a different value at different frequencies. In one example, the determined response is a maximum response (e.g., the specified property is a maximum value). For each set of coefficients j to be adjusted and at each frequency ω within a range to be adjusted, for example, this maximum response $R_j(\omega)$ may be expressed as a maximum value among a plurality of responses of the adapted set at the frequency, according to an expression such as $$R_j(\omega) = \max_{\theta=[-\pi,\pi]} |W_{j1}(\omega)D_{\theta 1}(\omega) + W_{j2}(\omega)D_{\theta 2}(\omega) + \ldots + W_{jM}(\omega)D_{\theta M}(\omega)|, \quad (3)$$

where W is the matrix of adapted values (e.g., an FIR polynomial matrix), $W_{jm}$ denotes the element of matrix W at row j and column m, and each element m of the column vector $D_\theta(\omega)$ indicates a phase delay at frequency w for a signal received from a far-field source at direction θ that may be expressed as $$D_{\theta m}(\omega)=\exp(-i\times\cos(\theta)\times\mathrm{pos}(m)\times\omega/c).$$

In another example, the determined response is a minimum response (e.g., a minimum value among a plurality of responses of the adapted set at each frequency).

In one example, expression (3) is evaluated for sixty-four uniformly spaced values of θ in the range [−π, +π]. In other examples, expression (3) may be evaluated for a different number of values of θ (e.g., 16 or 32 uniformly spaced values, values at five-degree or ten-degree increments, etc.), at non-uniform intervals (e.g., for greater resolution over a range of broadside directions than over a range of endfire directions, or vice versa), and/or over a different region of interest (e.g., [−π, 0], [−π/2, +π/2], [−π, +π/2]). For a linear array of microphones with uniform inter-microphone spacing d, the factor pos(m) may be expressed as (m−1)d, such that each element m of vector $D_\theta(\omega)$ may be expressed as $$D_{\theta m}(\omega)=\exp(-i\times\cos(\theta)\times(m-1)d\times\omega/c).$$

The value of direction θ for which expression (3) has a maximum value may be expected to differ for different values of frequency ω. It is noted that a source direction (e.g., DA10 and/or DA20) may be included within the values of θ at which expression (3) is evaluated or, alternatively, may be separate from those values (e.g., for a case in which a source direction indicates an angle that is between adjacent ones of the values of θ for which expression (3) is evaluated).

Figure 7A:
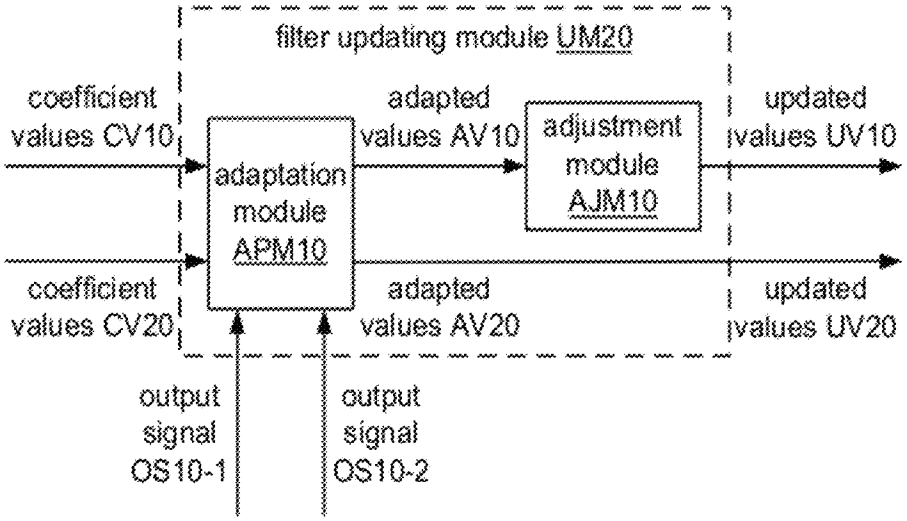
FIG. 7A shows a block diagram of an implementation UM20 of filter updating module UM10.

FIG. 7A shows a block diagram of an implementation UM20 of filter updating module UM10. Filter updating module UM10 includes an adaptation module APM10 that is configured to adapt coefficient values CV10 and CV20, based on information from output signals OS10-1 and OS10-2, to produce corresponding adapted sets of values AV10 and AV20. For example, adaptation module APM10 may be implemented to perform any of the BSS methods described herein (e.g., ICA, IVA).

Filter updating module UM20 also includes an adjustment module AJM10 that is configured to adjust adapted values AV10, based on a maximum response of the adapted set of values AV10 with respect to direction (e.g., according to expression (3) above), to produce an updated set of values UV10. In this case, filter updating module UM20 is configured to produce the adapted values AV20 without such adjustment as updated values UV20. (It is noted that the range of configurations disclosed herein also includes apparatus that differ from apparatus A100 in that coefficient values CV20 are neither adapted nor adjusted. Such an arrangement may be used, for example, in a situation where a signal arrives from a corresponding source over a direct path with little or no reverberation.)

Adjustment module AJM10 may be implemented to adjust an adapted set of values by normalizing the set to have a desired gain response (e.g., a unity gain response at the maximum) in each frequency with respect to direction. In such case, adjustment module AJM10 may be implemented to divide each value of the adapted set of coefficient values j (e.g., adapted values AV10) by the maximum response $R_j(\omega)$ of the set to obtain a corresponding updated set of coefficient values (e.g., updated values UV10).

For a case in which the desired gain response is other than a unity gain response, adjustment module AJM10 may be implemented such that the adjusting operation includes applying a gain factor to the adapted values and/or to the normalized values, where the value of the gain factor value varies with frequency to describe the desired gain response (e.g., to favor harmonics of a pitch frequency of the source and/or to attenuate one or more frequencies that may be dominated by an interferer). For a case in which the determined response is a minimum response, adjustment module AJM10 may be implemented to adjust the adapted set by subtracting the minimum response (e.g., at each frequency) or by remapping the set to have a desired gain response (e.g., a gain response of zero at the minimum) in each frequency with respect to direction.

Figure 7B:
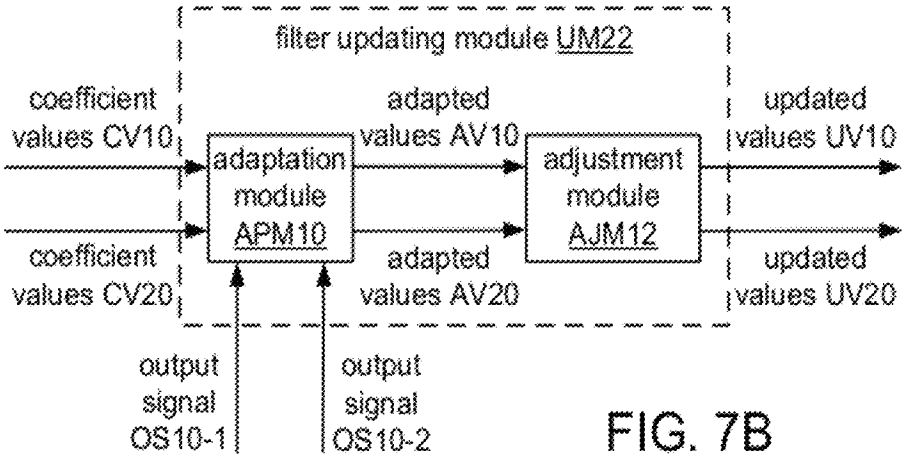
FIG. 7B shows a block diagram of an implementation UM22 of filter updating module UM20.

It may be desirable to implement adjustment module AJM10 to perform such normalization for more than one, and possibly all, of the sets of coefficient values (e.g., for at least the filters that have been associated with localized sources). FIG. 7B shows a block diagram of an implementation UM22 of filter updating module UM20 that includes an implementation AJM12 of adjustment module AJM10 that is also configured to adjust adapted values AV20, based on a maximum response of the adapted set of values AV20 with respect to direction, to produce the updated set of values UV20.

It is understood that such respective adjustment may be extended in the same manner to additional adapted filters (e.g., to other rows of adapted matrix W). For example, filter updating module UM12 as shown in FIG. 2 may be configured as an implementation of filter updating module UM22 to include an implementation of adaptation module APM10, configured to adapt the four sets of coefficient values CV10, CV20, CV30, and CV40 to produce four corresponding adapted sets of values, and an implementation of adjustment module AJM12, configured to produce each of one or both of the updated sets of values UV30 and UV40 based on a maximum response of the corresponding adapted set of values.

A traditional audio processing solution may include calculation of a noise reference and a post-processing step to apply the calculated noise reference. An adaptive solution as described herein may be implemented to rely less on post-proces sing and more on filter adaptation to improve interference cancellation and dereverberation by eliminating interfering point-sources. Reverberation may be considered as a transfer function (e.g., the room response transfer function) that has a gain response which varies with frequency, attenuating some frequency components and amplifying others. For example, the room geometry may affect the relative strengths of the signal at different frequencies, causing some frequencies to be dominant. By constraining a filter to have a desired gain response in a direction that varies from one frequency to another (i.e., in the direction of the main beam at each frequency), a normalization operation as described herein may help to dereverberate the signal by compensating for differences in the degree to which the energy of the signal is spread out in space at different frequencies.

To achieve the best separation and dereverberation results, it may be desirable to configure a filter of filter bank BK10 to have a spatial response that passes energy arriving from a source within some range of angles of arrival and blocks energy arriving from interfering sources at other angles. As described herein, it may be desirable to configure filter updating module UM10 to use a BSS adaptation to allow the filter to find a better solution in the vicinity of the initial solution. Without a constraint to preserve a main beam that is directed at the desired source, however, the filter adaptation may allow an interfering source from a similar direction to erode the main beam (for example, by creating a wide null beam to remove energy from the interfering source).

Filter updating module UM10 may be configured to use adaptive null beamforming via constrained BSS to prevent large deviations from the source localization solution while allowing for correction of small localization errors. However, it may also be desirable to enforce a spatial constraint on the filter update rule that prevents the filter from changing direction to a different source. For example, it may be desirable for the process of adapting a filter to include a null constraint in the direction of arrival of an interfering source. Such a constraint may be desirable to prevent the beam pattern from changing its orientation to that interfering direction in the low frequencies.

It may be desirable to implement filter updating module UM10 (e.g., to implement adaptation module APM10) to use a constrained BSS method by including one or more geometric constraints in the adaptation process. Such a constraint, also called a spatial or directional constraint, inhibits the adaptation process from changing the direction of a specified beam or null beam in the beam pattern. For example, it may be desirable to implement filter updating module UM10 (e.g., to implement adaptation module APM10) to impose a spatial constraint that is based on direction DA10 and/or direction DA20.

In one example of constrained BSS adaptation, filter adaptation module AM10 is configured to enforce geometric constraints on source direction beams and/or null beams by adding a regularization term $J(\omega)$ that is based on the directivity matrix $D(\omega)$. Such a term may be expressed as a least-squares criterion, such as $J(\omega)=\|W(\omega)D(\omega)-C(\omega)\|^2$, where $\|\bullet\|^2$ indicates the Frobenius norm and $C(\omega)$ is an M×M diagonal matrix that sets the choice of the desired beam pattern.

It may be desirable for the spatial constraints to only enforce null beams, as trying to enforce the source beams as well may create problems for the filter adaptation process. In one such case, the constraint matrix $C(\omega)$ is equal to $\mathrm{diag}(W(\omega)D(\omega))$ such that nulls are enforced at interfering directions for each source filter. Such constraints preserve the main beam of a filter by enforcing null beams in the source directions of the other filters (e.g., by attenuating a response of the filter in other source directions relative to a response in the main beam direction), which prevents the filter adaptation process from putting energy of the desired source into any other filter. The spatial constraints also inhibit each filter from switching to another source.

It may be also desirable for the regularization term $J(\omega)$ to include a tuning factor $S(\omega)$ that can be tuned for each frequency $\omega$ to balance enforcement of the constraint against adaptation according to the learning rule. In such case, the regularization term may be expressed as $J(\omega)=S(\omega)\|W(\omega)D(\omega)-C(\omega)\|^2$ and may be implemented using a constraint such as the following:

$$constr(\omega) = \left(\frac{dJ}{dW}\right)(\omega) = 2S(\omega)(W(\omega)D(\omega) - C(\omega))D(\omega)^H.$$

This constraint may be applied to the filter adaptation rule (e.g., as shown in expression (2)) by adding a corresponding term to that rule, as in the following expression:

$$W_{constr,l+r}(\omega) = W_l(\omega) + \mu[I - \langle\Phi(Y(\omega, l))Y(\omega, l)^H\rangle]W_l(\omega) + 2S(\omega)(W_l(\omega)D(\omega) - C(\omega))D(\omega)^H. \quad (4)$$

By preserving the initial orientation, such a spatial constraint may allow for a more aggressive tuning of a null beam with respect to the desired source beam. For example, such tuning may include sharpening the main beam to enable suppression of an interfering source whose direction is very close to that of the desired source. Although aggressive tuning may produce sidelobes, overall separation performance may be increased due to the ability of the adaptive solution to take advantage of a lack of interfering energy in the sidelobes.

Such responsiveness is not available with fixed beamforming, which typically operates under the assumption that distributed noise components are arriving from all directions.

As noted above, FIG. 5 shows beam patterns of each of the adapted filters of an example of filter bank BK12 for a case in which two directional sources are located two-and-one-half meters from the microphone array and about fifteen degrees away from one another with respect to the array. This particular solution, which is not normalized and does not have unity gain in any direction, is an example of an unconstrained BSS solution that shows wide null beams. In the beam patterns shown in each of the top figures, one of the two sources is eliminated. In the beam patterns shown in each of the bottom figures, the beams are especially wide as both of the two sources are being blocked.

Figure 8:
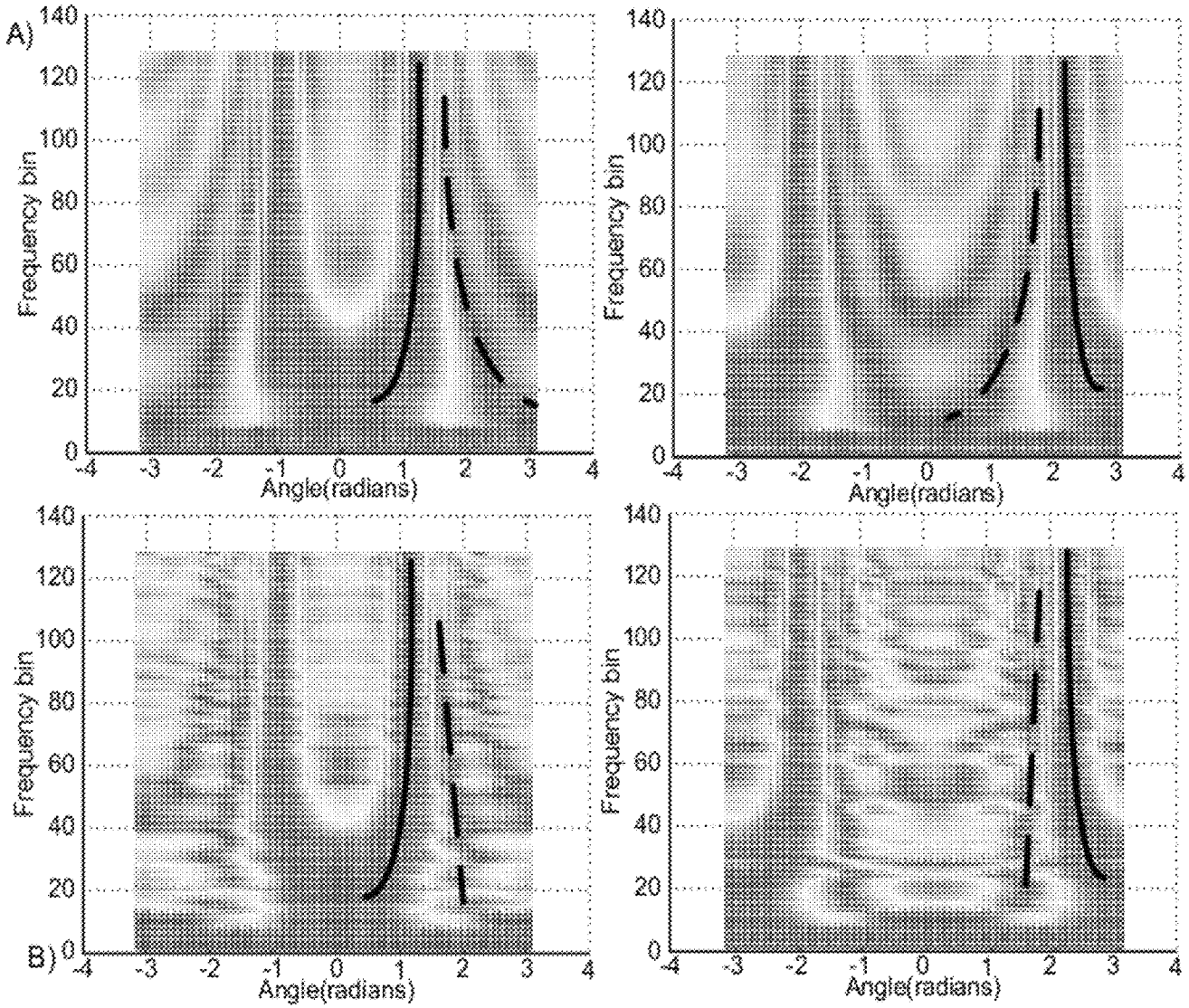
FIG. 8 shows an example of two source filters before (top plots) and after adaptation by constrained BSS (bottom plots).
Figure 9:
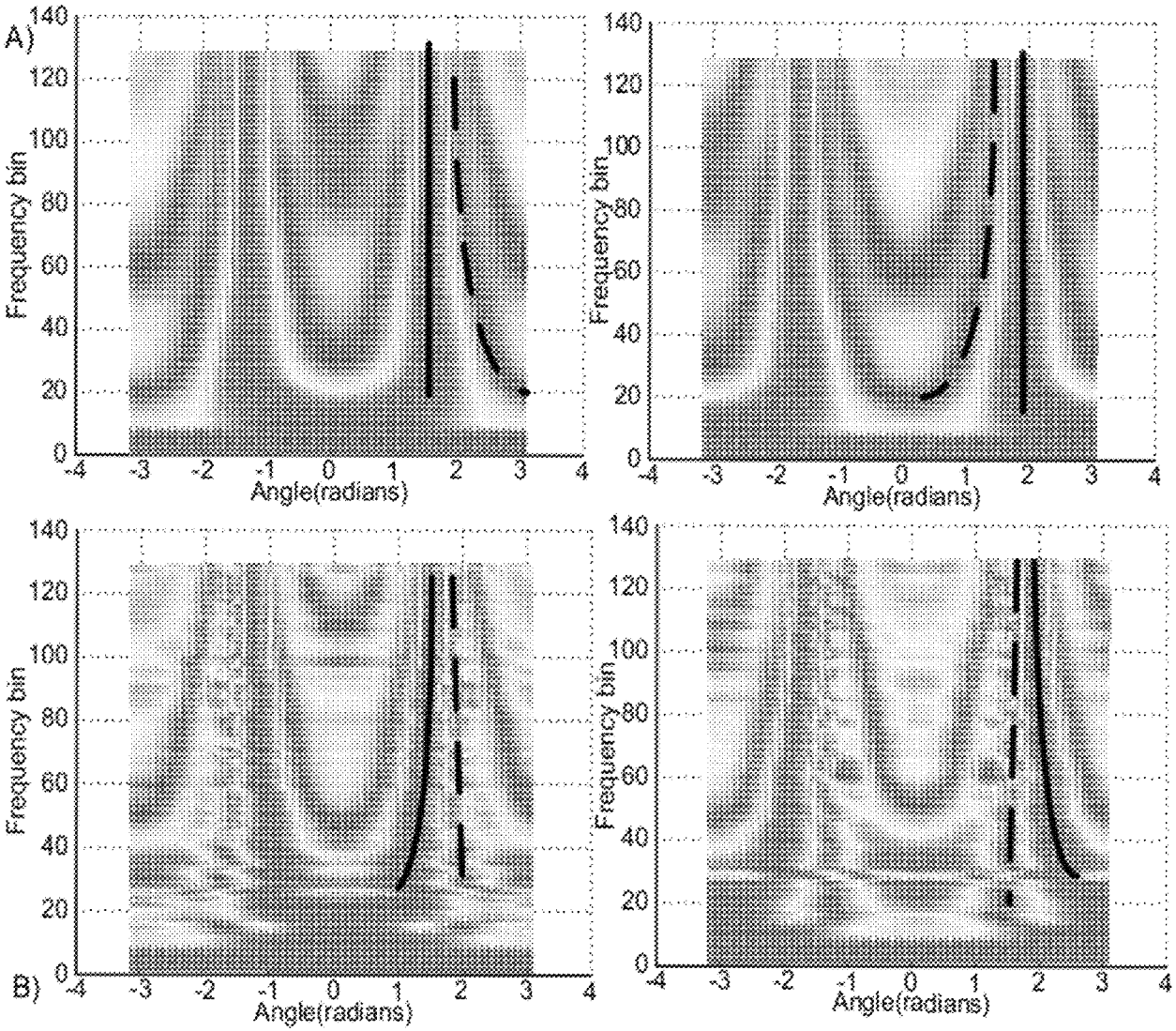
FIG. 9 shows another example of two source filters before (top plots) and after adaptation by constrained BSS (bottom plots).

Each of FIGS. 8 and 9 shows an example of beam patterns of two sets of coefficient values (left and right columns, respectively), in which the top plots show the beam patterns of the filters as produced by filter orientation module OM10, and the bottom plots show the beam patterns after adaptation by filter updating module UM10 using a geometrically constrained BSS method as described herein (e.g., according to expression (4) above). FIG. 8 illustrates a case of two sources (human speakers) located two-and-one-half meters from the array and spaced forty to sixty degrees apart, and FIG. 9 illustrates a case of two sources (human speakers) located two-and-one-half meters from the array and spaced fifteen degrees apart. In these figures, high and low gain response amplitudes (e.g., the beams and null beams) are indicated in black, mid-range gain response amplitudes are indicated in white, and the approximate directions of the beams and null beams are indicated by the bold solid and dashed lines, respectively.

It may be desirable to implement filter updating module UM10 (e.g., to implement adaptation module APM10) to adapt only part of the BSS unmixing matrix. For example, it may be desirable to fix one or more of the filters of filter bank BK10. Such a constraint may be implemented by preventing the filter adaptation process (e.g., as shown in expression (2) above) from changing the corresponding rows of coefficient matrix W.

In one example, such a constraint is applied from the start of the adaptation process in order to preserve the initial set of coefficient values (e.g., as produced by filter orientation module OM10) that corresponds to each filter to be fixed. Such an implementation may be appropriate, for example, for a filter whose beam pattern is directed toward a stationary interferer. In another example, such a constraint is applied at a later time to prevent further adaptation of the adapted set of coefficient values (e.g., upon detecting that the filter has converged). Such an implementation may be appropriate, for example, for a filter whose beam pattern is directed toward a stationary interferer in a stable reverberant environment. It is noted that once a normalized set of filter coefficient values has been fixed, it is not necessary for adjustment module AJM10 to perform adjustment of those values while the set remains fixed, even though adjustment module AJM10 may continue to adjust other sets of coefficient values (e.g., in response to their adaptation by adaptation module APM10).

Alternatively or additionally, it may be desirable to implement filter updating module UM10 (e.g., to implement adaptation module APM10) to adapt one or more of the filters over only part of its frequency range. Such fixing of a filter may be achieved by not adapting the filter coefficient values that correspond to frequencies (e.g., to values of $\omega$ in expression (2) above) which are outside of that range.

It may be desirable to adapt each of one or more (possibly all) of the filters only in a frequency range that contains useful information, and to fix the filter in another frequency range. The range of frequencies to be adapted may be based on factors such as the expected distance of the speaker from the microphone array, the distance between microphones (e.g., to avoid adapting the filter in frequencies at which spatial filtering will fail anyway, for example because of spatial aliasing), the geometry of the room, and/or the arrangement of the device within the room. For example, the input signals may not contain enough information over a particular range of frequencies (e.g., a high-frequency range) to support correct BSS learning over that range. In such case, it may be desirable to continue to use the initial (or otherwise most recent) filter coefficient values for this range without adaptation.

When a source is three to four meters or more away from the array, it is typical that very little high-frequency energy emitted by the source will reach the microphones. As little information may be available in the high-frequency range to properly support filter adaptation in such a case, it may be desirable to fix the filters in high frequencies and adapt them only in low frequencies.

Figure 10:
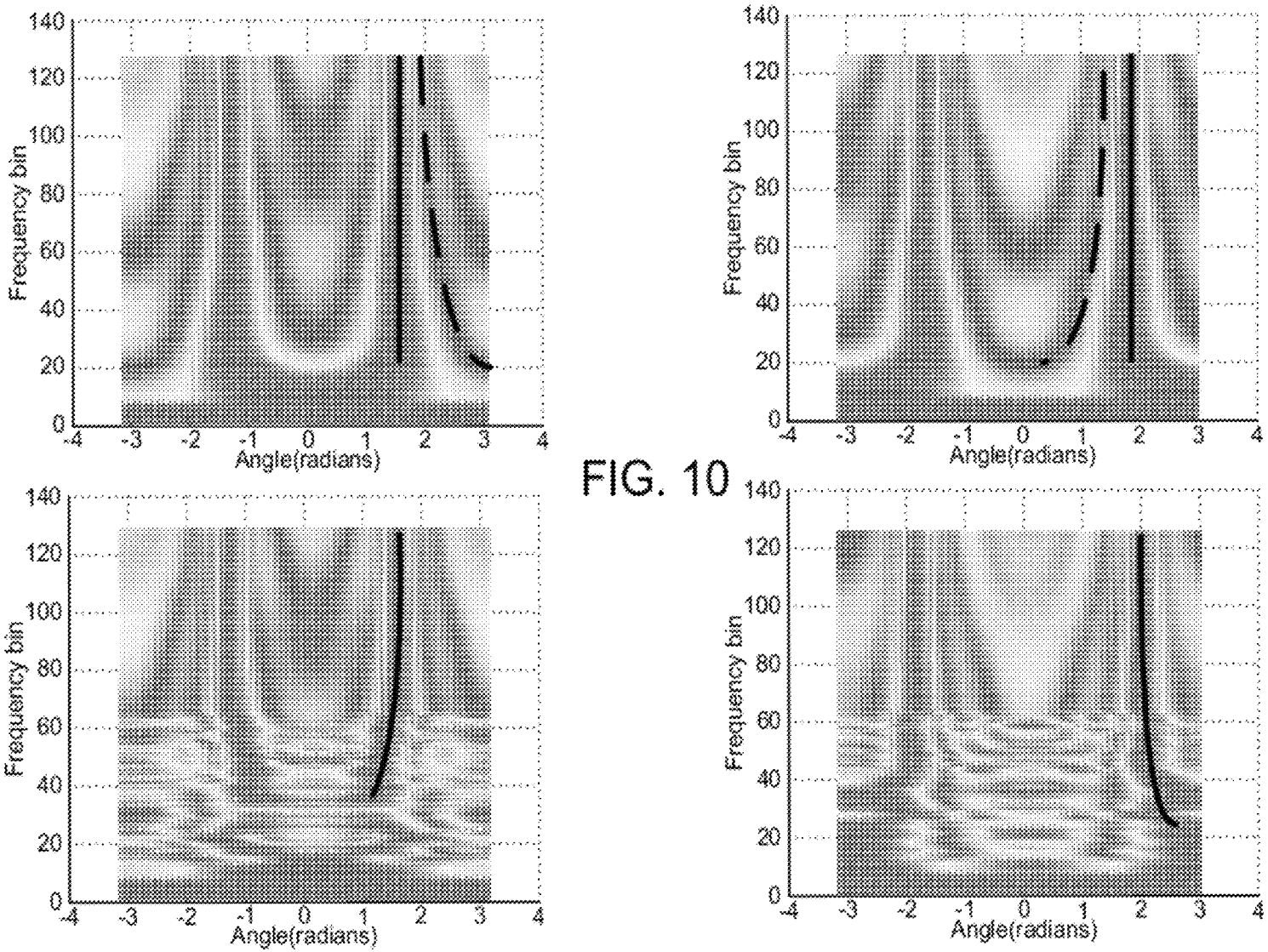
FIG. 10 shows examples of beam patterns before (top plots) and after (bottom plots) partial adaptation.

FIG. 10 shows examples of beam patterns of two filters before (top plots) and after (bottom plots) such partial BSS adaptation that is limited to filter coefficient values in a specified low-frequency range. In this particular case, the adaptation is restricted to the lower 64 out of 140 frequency bins (e.g., a band of about zero to 1800 Hz in the range of zero to four kHz, or a band of about zero to 3650 Hz in the range of zero to eight kHz).

Additionally or alternatively, the decision of which frequencies to adapt may change during runtime, according to factors such as the amount of energy currently available in a frequency band and/or the estimated distance of the current speaker from the microphone array, and may differ for different filters. For example, it may be desirable to adapt a filter at frequencies of up to two kHz (or three or five kHz) at one time, and to adapt the filter at frequencies of up to four kHz (or five, eight, or ten kHz) at another time. It is noted that it is not necessary for adjustment module AJM10 to adjust filter coefficient values that are fixed for a particular frequency and have already been adjusted (e.g., normalized), even though adjustment module AJM10 may continue to adjust coefficient values at other frequencies (e.g., in response to their adaptation by adaptation module APM10).

Filter bank BK10 applies the updated coefficient values (e.g., UV10 and UV20) to corresponding channels of the multichannel signal. The updated coefficient values are the values of the corresponding rows of unmixing matrix W (e.g., as adapted by adaptation module APM10), after adjustment as described herein (e.g., by adjustment module AJM10) except where such values have been fixed as described herein. Each updated set of coefficient values will typically describe multiple filters. For example, each updated set of coefficient values may describe a filter for each element of the corresponding row of unmixing matrix W.

Figure 11A:
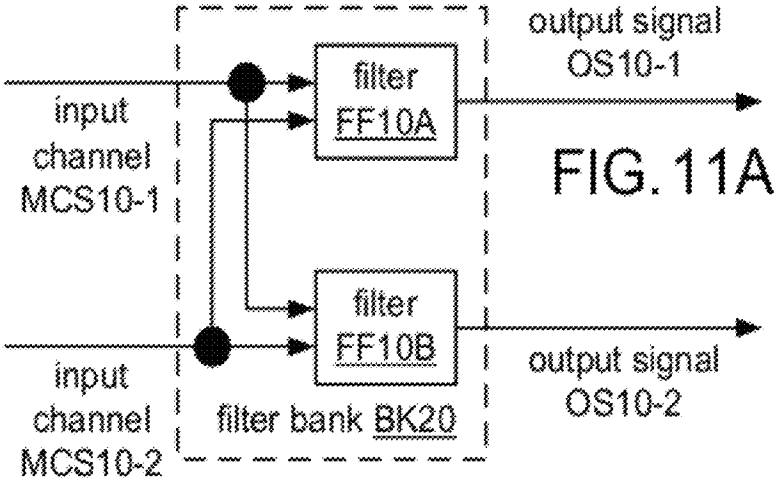
FIG. 11A shows a block diagram of a feedforward implementation BK20 of filter bank BK10.

FIG. 11A shows a block diagram of a feedforward implementation BK20 of filter bank BK10. Filter bank BK20 includes a first feedforward filter FF10A that is configured to filter input channels MCS10-1 and MCS10-2 to produce first output signal OS10-1, and a second feedforward filter FF10B that is configured to filter input channels MCS10-1 and MCS10-2 to produce second output signal OS10-2.

Figure 11B:
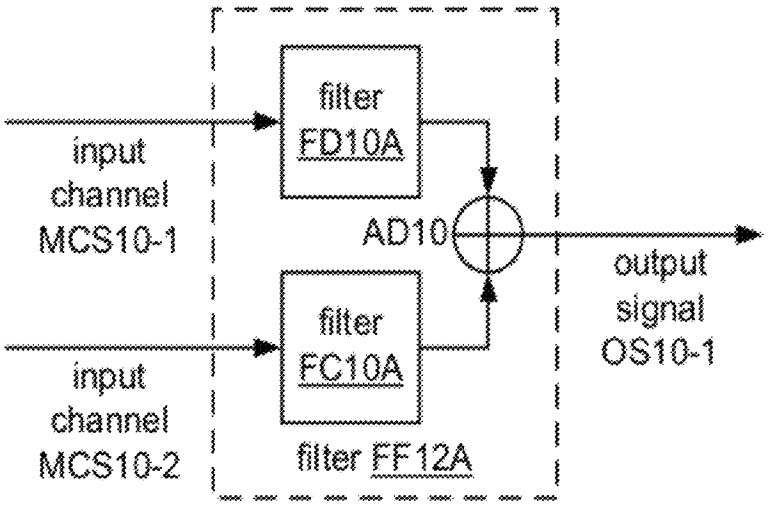
FIG. 11B shows a block diagram of an implementation FF12A of feedforward filter FF10A.
Figure 11C:
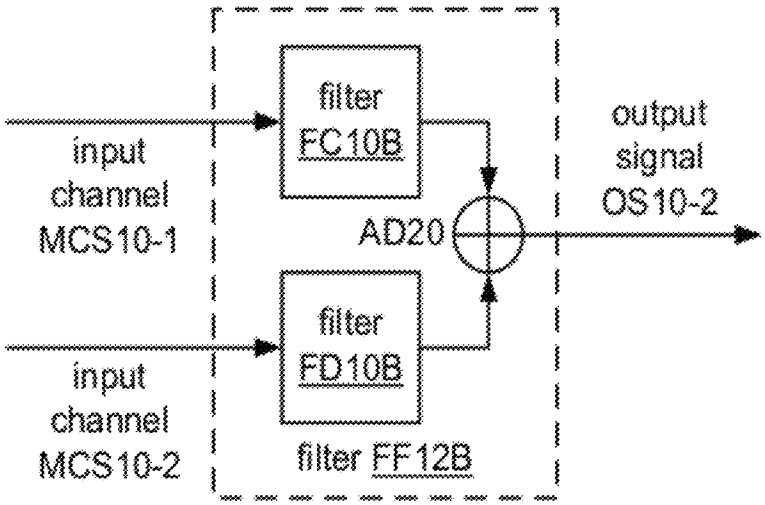
FIG. 11C shows a block diagram of an implementation FF12B of feedforward filter FF10B.

FIG. 11B shows a block diagram of an implementation FF12A of feedforward filter FF10A, which includes a direct filter FD10A arranged to filter first input channel MCS10-1, a cross filter FC10A arranged to filter second input channel MCS10-2, and an adder A10 arranged to add the two filtered signals to produce first output signal O510-1. FIG. 11C shows a block diagram of a corresponding implementation FF12B of feedforward filter FF10B, which includes a direct filter FD10B arranged to filter second input channel MCS10-2, a cross filter FC10B arranged to filter first input channel MCS10-1, and an adder A20 arranged to add the two filtered signals to produce second output signal O510-2.

Filter bank BK20 may be implemented such that filters FF10A and FF10B apply the updated sets of coefficient values that correspond to respective rows of adapted unmixing matrix W. In one such example, filters FD10A and FC10A of filter FF12A are implemented as FIR filters whose coefficient values are elements $w_{11}$ and $w_{12}$, respectively, of adapted unmixing matrix W (possibly after adjustment by adjustment module AJM10), and filters FC10B and FD10B of filter FF12B are implemented as FIR filters whose coefficient values are elements $w_{21}$ and $w_{22}$, respectively, of adapted unmixing matrix W (possibly after adjustment by adjustment module AJM10).

Figure 12:
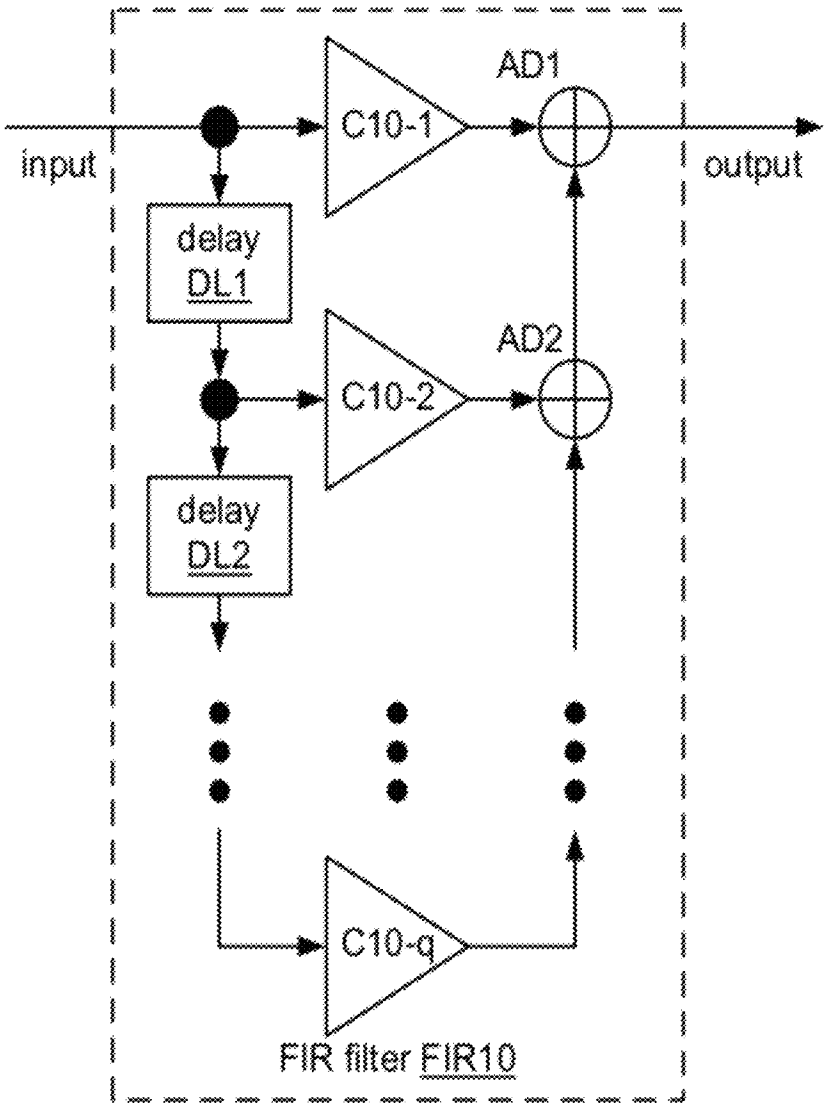
FIG. 12 shows a block diagram of an FIR filter FIR10.

In general, each of feedforward filters FF10A and FF10B (e.g., each among the cross filters FC10A and FC10B and each among the direct filters FD10A and FD10B) may be implemented as a finite-impulse-response (FIR) filter. FIG. 12 shows a block diagram of an FIR filter FIR10 that is configured to apply a plurality q of coefficients C10-1, C10-2, . . . , C10-*q* to an input signal to produce an output signal, where filter updating module UM10 is configured to produce initial and updated values for the coefficients as described herein. Filter FIR10 also includes (q−1) delay elements (e.g., DL1, DL2) and (q−1) adders (e.g., AD1, AD2).

Figure 13:
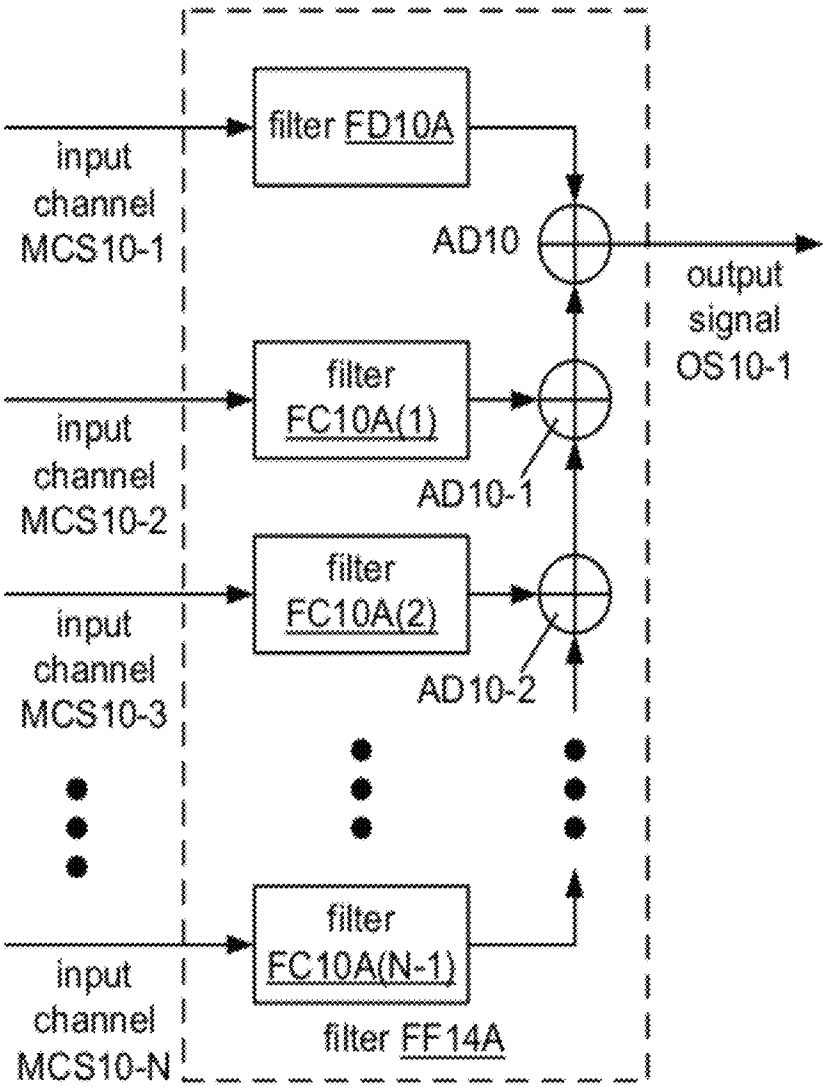
FIG. 13 shows a block diagram of an implementation FF14A of feedforward filter FF12A.

As described herein, filter bank BK10 may also be implemented to have three, four, or more channels. FIG. 13 shows a block diagram of an implementation FF14A of feedforward filter FF12A that is configured to filter N input channels MCS10-1, MCS10-2, MCS10-3, . . . , MCS10-N, where N is an integer greater than two (e.g., three or four). Filter FF14A includes an instance of direct filter FD10A arranged to filter first input channel MCS10-1; (N−1) cross filters FC10A(1), FC10A(2), . . . , FC10A(N−1) that are each arranged to filter a corresponding one of the input channels MCS10-2 to MCS10-N; and (N−1) adders AD10, AD10-1, AD10-2, . . . , (or, for example, an (N−1)-input adder) arranged to add the N filtered signals to produce output signal OS10-1.

In one such example, filters FD10A, FC10A(1), FC10A (2), . . . , FC10A(N−1) of filter FF14A are implemented as FIR filters whose coefficient values are elements $w_{11}$, $w_{12}$, $w_{13}$, . . . , $w_{1N}$, respectively, of adapted unmixing matrix W (e.g., the first row of adapted matrix W, possibly after adjustment by adjustment module AJM10). A corresponding implementation of filter bank BK10 may include several filters similar to filter FF14A, each configured to apply the coefficient values of a corresponding row of adapted matrix W (possibly after adjustment by adjustment module AJM10) to the respective input channels MCS10-1 to MCS10-N in such manner to produce a corresponding output signal.

Filter bank BK10 may be implemented to filter the signal in the time domain or in a frequency domain, such as a transform domain. Examples of transform domains in which such filtering may be performed include a modified discrete cosine (MDCT) domain and a Fourier transform, such as a discrete (DFT), discrete-time short-time (DT-STFT), or fast (FFT) Fourier transform.

In addition to the particular examples described herein, filter bank BK10 may be implemented according to any known method of applying an adapted unmixing matrix W to a multichannel input signal (e.g., using FIR filters). Filter bank BK10 may be implemented to apply the coefficient values to the multichannel signal in the same domain in which the values are initialized and updated (e.g., in the time domain or in a frequency domain) or in a different domain. As described herein, the values from at least one row of the adapted matrix are adjusted before such application, based on a maximum response with respect to direction.

Figure 14:
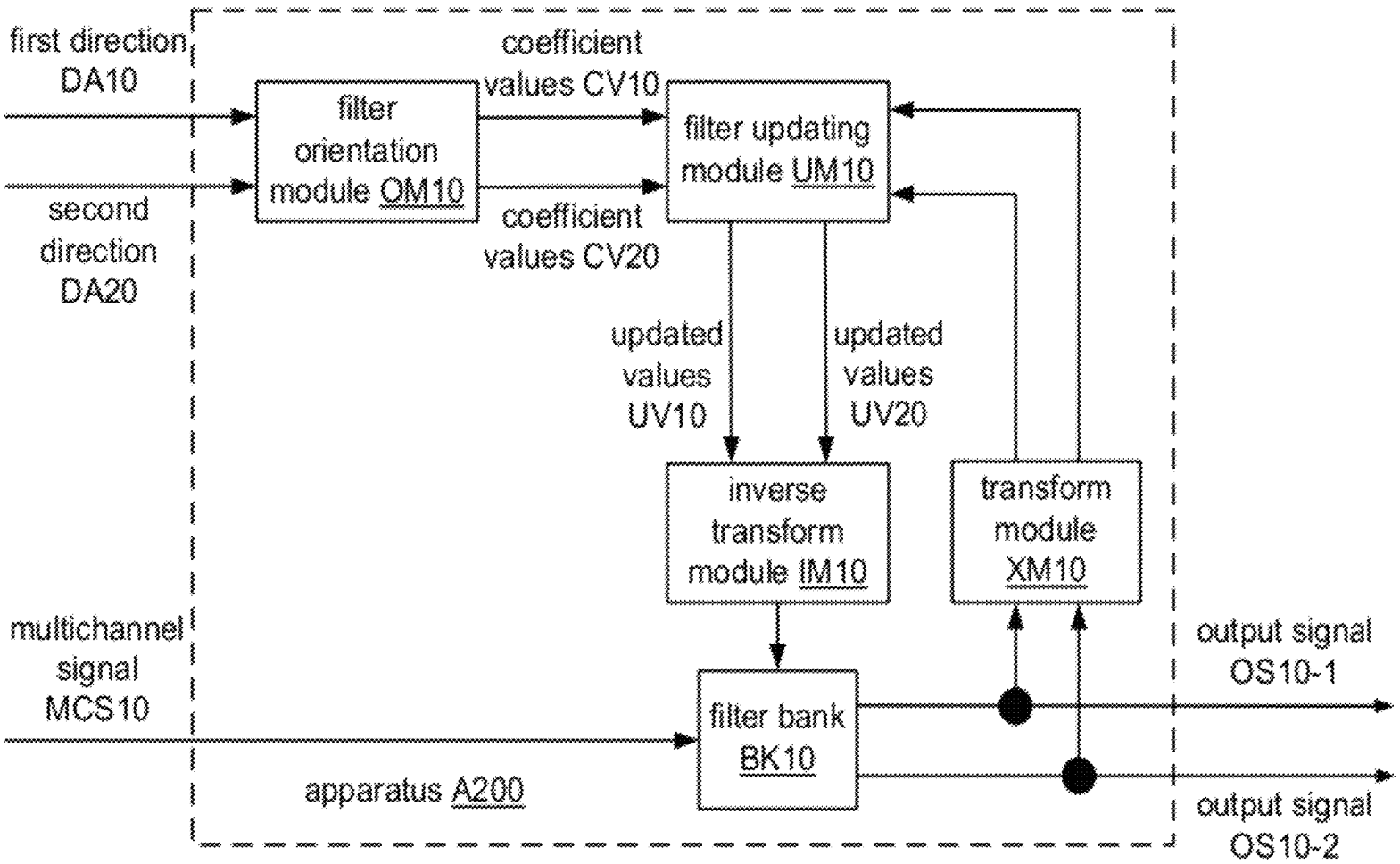
FIG. 14 shows a block diagram of an implementation A200 of apparatus A100.

FIG. 14 shows a block diagram of an implementation A200 of apparatus A100 that is configured to perform updating of initial coefficient values CV10, CV20 in a frequency domain (e.g., a DFT or MDCT domain). In this example, filter bank BK10 is configured to apply the updated coefficient values UV10, UV20 to multichannel signal MCS10 in the time domain. Apparatus A200 includes an inverse transform module IM10 that is arranged to transform updated coefficient values UV10, UV20 from the frequency domain to the time domain and a transform module XM10 that is configured to transform output signals OS10-1, OS10-2 from the time domain to the frequency domain. It is expressly noted that apparatus A200 may also be implemented to support more than two input and/or output channels. For example, apparatus A200 may be implemented as as an implementation of apparatus A110 as shown in FIG. 2, such that inverse transform module IM10 is configured to transform updated values UV10, UV20, UV30, and UV40 and transform module XM10 is configured to transform signals OS10-1, OS10-2, OS10-3, and OS10-4.

As described herein, filter orientation module OM10 produces initial conditions for filter bank BK10, based on estimated source directions, and filter updating module UM10 updates the filter coefficients to converge to an improved solution. The quality of the initial conditions may depend on the accuracy of the estimated source directions (e.g., DA10 and DA20).

Figure 15A:
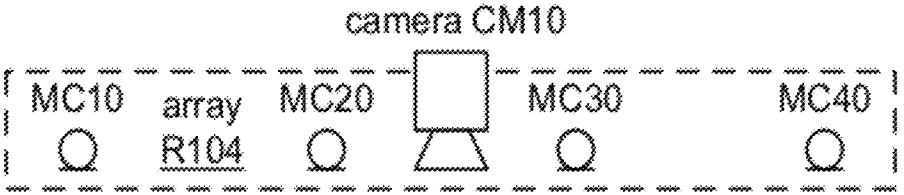
FIG. 15A shows a top view of one example of an arrangement of a four-microphone implementation R104 of array R100 with a camera CM10.

In general, each estimated source direction (e.g., DA10 and/or DA20) may be measured, calculated, predicted, projected, and/or selected and may indicate a direction of arrival of sound from a desired source, an interfering source, or a reflection. Filter orientation module OM10 may be arranged to receive the estimated source directions from another module or device (e.g., from a source localization module). Such a module or device may be configured to produce the estimated source directions based on image information from a camera (e.g., by performing face and/or motion detection) and/or ranging information from ultrasound reflections. Such a module or device may also be configured to estimate the number of sources and/or to track one or more sources in motion. FIG. 15A shows a top view of one example of an arrangement of a four-microphone implementation R104 of array R100 with a camera CM10 that may be used to capture such image information.

Alternatively, apparatus A100 may be implemented to include a direction estimation module DM10 that is configured to calculate the estimated source directions (e.g., DA10 and DA20) based on information within multichannel signal MCS10 and/or information within the output signals produced by filter bank BK10. In such cases, direction estimation module DM10 may also be implemented to calculate the estimated source directions based on image and/or ranging information as described above. For example, direction estimation module DM10 may be implemented to estimate source DOA using a generalized cross-correlation (GCC) algorithm, or a beamformer algorithm, applied to multichannel signal MCS10.

Figure 16:
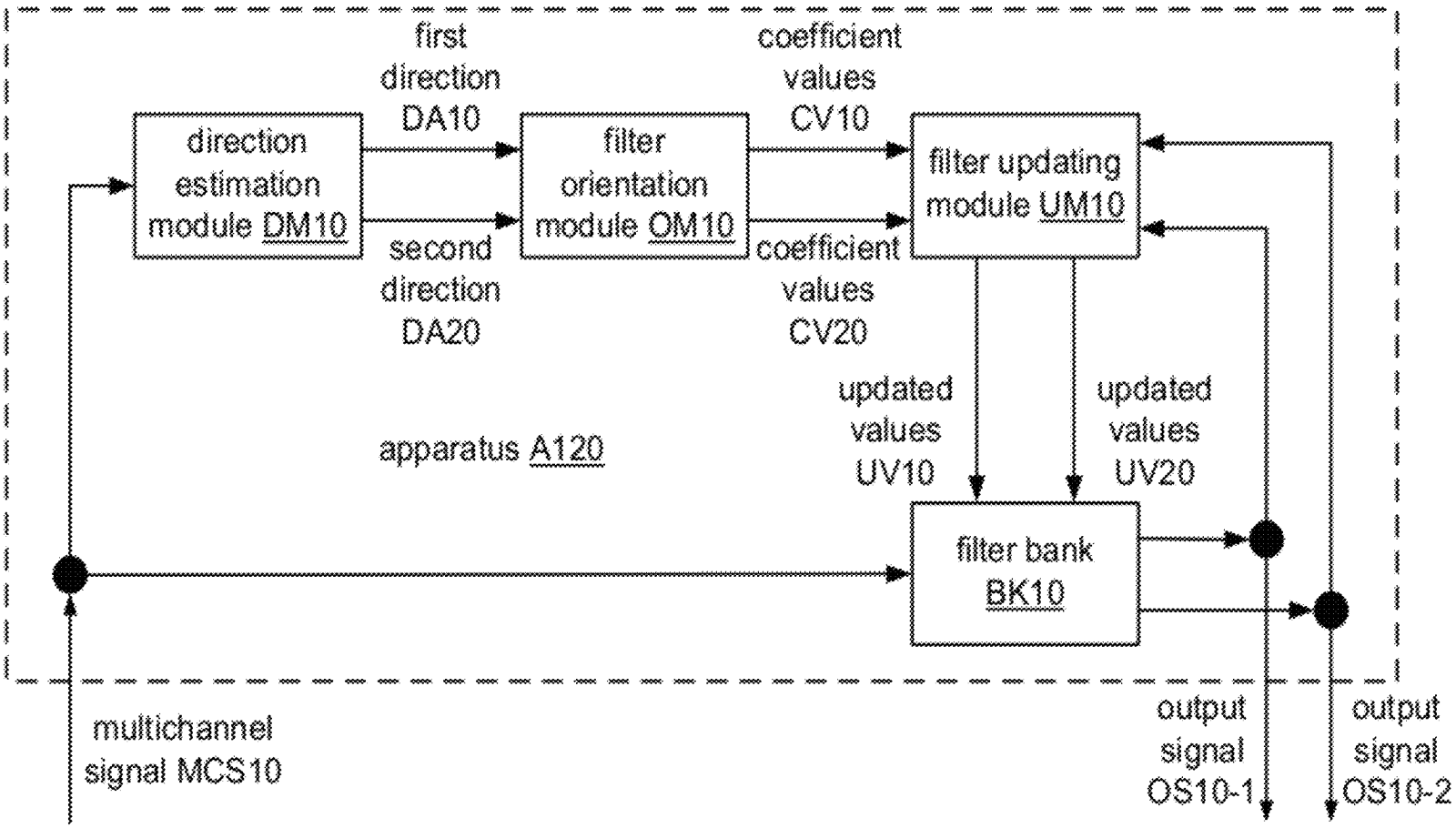
FIG. 16 shows a block diagram of an implementation A120 of apparatus A100.
Figure 17:
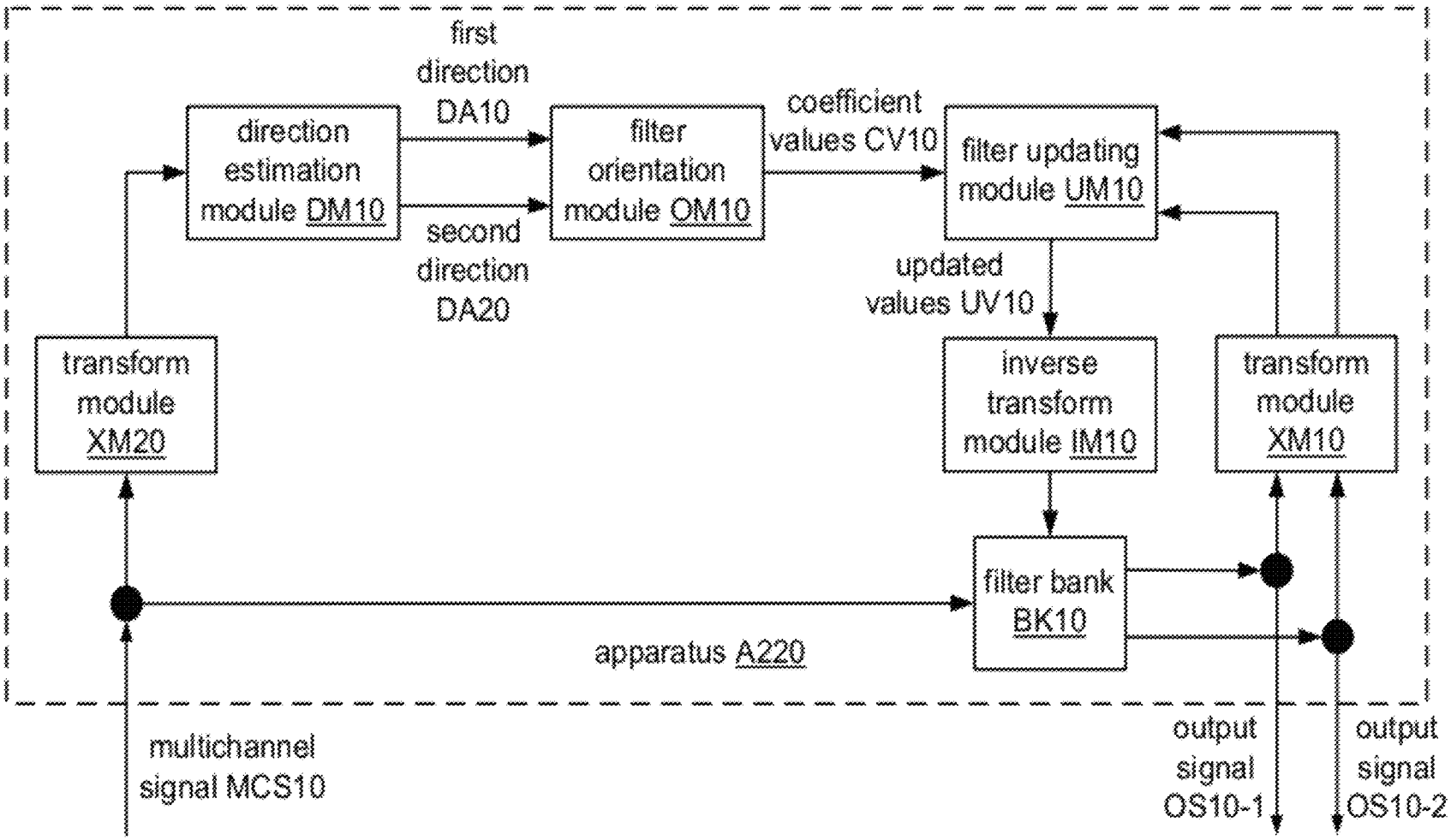
FIG. 17 shows a block diagram of an implementation A220 of apparatus A120 and A200.

FIG. 16 shows a block diagram of an implementation A120 of apparatus A100 that includes an instance of direction estimation module DM10 which is configured to calculate the estimated source directions DA10 and DA20 based on information within multichannel signal MCS10. In this case, direction estimation module DM10 and filter bank BK10 are implemented to operate in the same domain (e.g., to receive and process multichannel signal MCS10 as a frequency-domain signal). FIG. 17 shows a block diagram of an implementation A220 of apparatus A120 and A200 in which direction estimation module DM10 is arranged to receive the information from multichannel signal MCS10 in the frequency domain from a transform module XM20.

In one example, direction estimation module DM10 is implemented to calculate the estimated source directions, based on information within multichannel signal MCS10, using the steered response power using the phase transform (SRP-PHAT) algorithm. The SRP-PHAT algorithm, which follows from maximum likelihood source localization, determines the time delays at which a correlation of the output signals is maximum. The cross-correlation is normalized by the power in each bin, which gives a better robustness. In a reverberant environment, SRP-PHAT may be expected to provide better results than competing source localization methods.

The SRP-PHAT algorithm may be expressed in terms of received signal vector X (i.e., multichannel signal MCS10) in a frequency domain $$X(\omega)=[X_1(\omega), \ldots, X_p(\omega)]^T=S(\omega)G(\omega)+S(\omega)H(\omega)+N(\omega),$$

where S indicates the source signal vector and gain matrix G, room transfer function vector H, and noise vector N may be expressed as follows:

$$X(\omega)=[X_1(\omega), \ldots, X_P(\omega)]^T,$$

$$G(\omega)=[\alpha_1(\omega)e^{-j\omega\tau_1}, \ldots, \alpha_P(\omega)e^{-j\omega\tau_P}]^T,$$

$$H(\omega)=[H_1(\omega), \ldots, H_P(\omega)]^T,$$

$$N(\omega)=[N_1(\omega), \ldots, N_P(\omega)]^T.$$

In these expressions, P denotes the number of sensors (i.e., the number of input channels), $\alpha$ denotes a gain factor, and $\tau$ denotes a time of propagation from the source.

In this example, the combined noise vector $N^c(\omega)=S(\omega)H(\omega)+N(\omega)$ may be assumed to have the following zero-mean, frequency-independent, joint Gaussian distribution:

$$p(N^c(\omega))=\rho\exp\{-\tfrac{1}{2}[N^C(\omega)]^H Q^{-1}(\omega)N^c(\omega)\},$$

where $Q(\omega)$ is the covariance matrix and $\rho$ is a constant. The source direction may be estimated by maximizing the expression $$J_2=\int_\omega \frac{[G^H(\omega)Q^{-1}(\omega)X(\omega)]^H G^H(\omega)Q^{-1}(\omega)X(\omega)}{G^H(\omega)Q^{-1}(\omega)G(\omega)}\,d\omega.$$

Under the assumption that $N(\omega)=0$, this expression may be rewritten as $$J_2=\frac{1}{\gamma P}\int\left|\sum_{i=1}^{P}\frac{X_i(\omega)e^{j\omega\tau_i}}{|X_i(\omega)|}\right|^2 d\omega, \tag{4}$$

where $0<\gamma<1$ is a design constant, and the time delay $\tau_i$ that maximizes the right-hand-side of expression (4) indicates the source direction of arrival.

Figure 18:
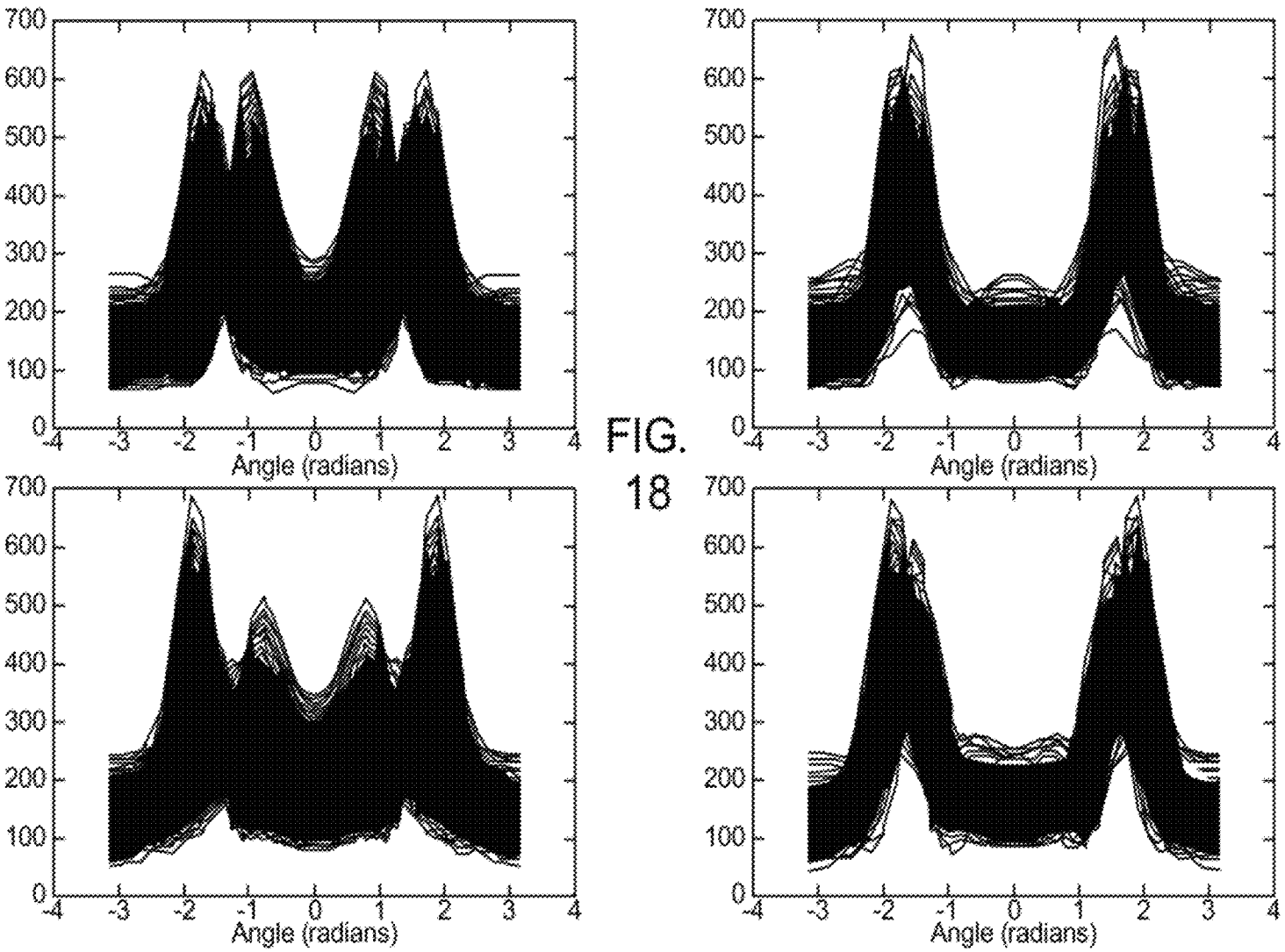
FIG. 18 shows examples of histograms resulting from using SRP-PHAT for DOA estimation.

FIG. 18 shows examples of plots resulting from using such an implementation of SRP-PHAT for DOA estimation for different two-source scenarios over a range of frequencies $\omega$. In these plots, the y axis indicates the value of $$\left|\sum_{i=1}^{P}\frac{X_i(\omega)e^{j\omega\tau_i}}{|X_i(\omega)|}\right|^2$$

and the x axis indicates estimated source direction of arrival $\theta_i$ ($=\cos^{-1}(\tau_i c/d)$) relative to the array axis. In each plot, each line corresponds to a different frequency in the range, and each plot is symmetric around the endfire direction of the microphone array (i.e., $\theta=0$). The top-left plot shows a histogram for two sources at a distance of four meters from the array. The top-right plot shows a histogram for two close sources at a distance of four meters from the array. The bottom-left plot shows a histogram for two sources at a distance of two-and-one-half meters from the array. The bottom-right plot shows a histogram for two close sources at a distance of two-and-one-half meters from the array. It may be seen that each of these plots indicates the estimated source direction as a range of angles which may be characterized by a center of gravity, rather than as a single peak across all frequencies.

In another example, direction estimation module DM10 is implemented to calculate the estimated source directions, based on information within multichannel signal MCS10, using a blind source separation (BSS) algorithm. A BSS method tends to generate reliable null beams to remove energy from interfering sources, and the directions of these null beams may be used to indicate the directions of arrival of the corresponding sources. Such an implementation of direction estimation module DM10 may be implemented to calculate the direction of arrival (DOA) of source i at frequency f, relative to the axis of an array of microphones j and j□, according to an expression such as $$\hat{\theta}_{i,jj'}(f)=\cos^{-1}(\arg([W^{-1}]_{ji'}/[W^{-1}]_{j'i})/2\pi f c^{-1}\|p_j-p_{j'}\|), \tag{5}$$

where W denotes the unmixing matrix and $p_j$ and $p_{j\square}$ denote the spatial coordinates of microphones j and j', respectively. In this case, it may be desirable to implement the BSS filters (e.g., unmixing matrix W) of direction estimation module DM10 separately from the filters that are updated by filter updating module UM10 as described herein.

Figure 19:
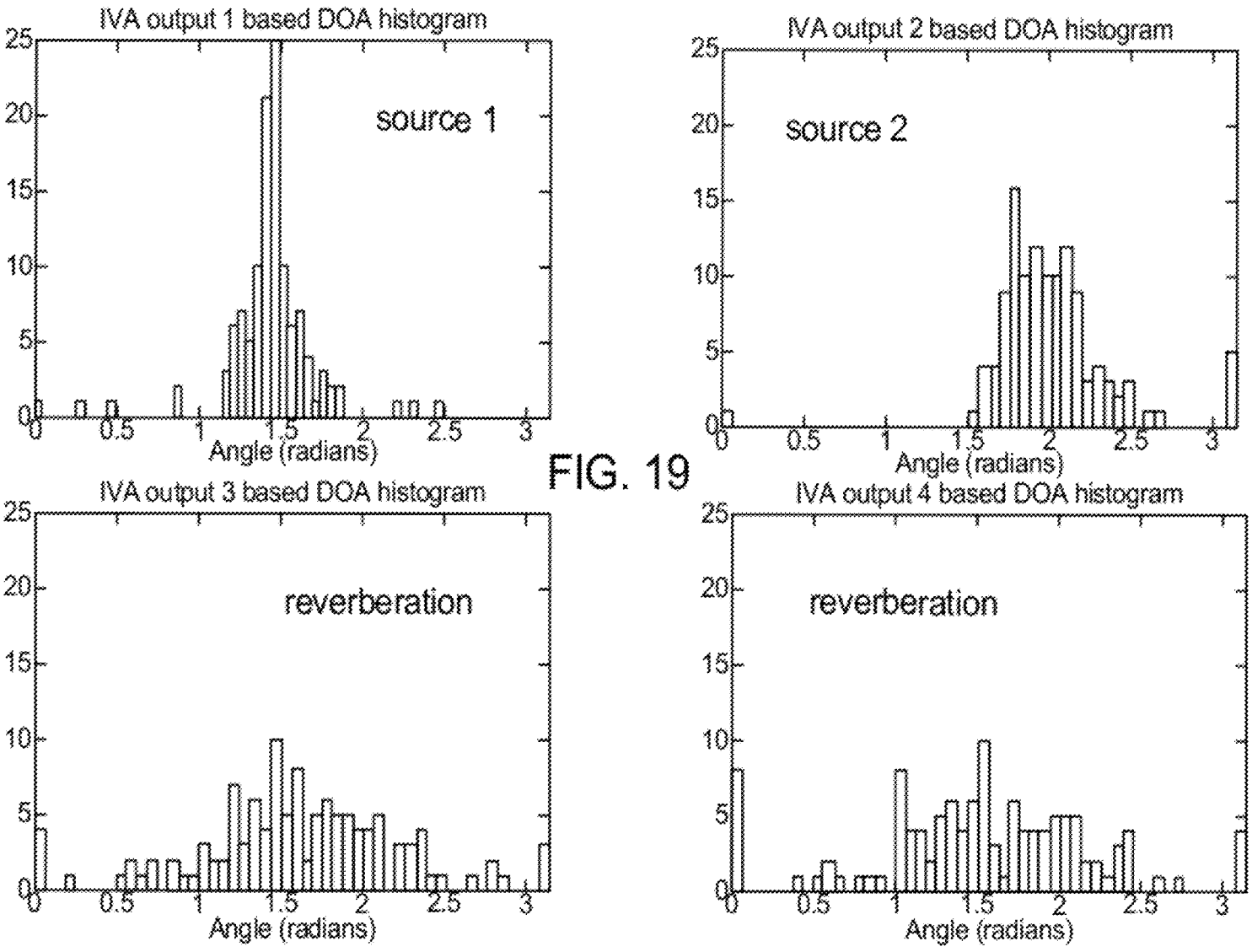
FIG. 19 shows an example of a set of four histograms for different output channels of an unmixing matrix that is adapted using an IVA adaptation rule (source separation of 40-60 degrees).

FIG. 19 shows an example of a set of four histograms, each indicating the number of frequency bins that expression (5) maps to each incident angle (relative to the array axis) for a corresponding instance of a four-row unmixing matrix W, where W is based on information within multichannel signal MCS10 and is calculated by an implementation of direction estimation module DM10 according to an IVA adaptation rule as described herein. In this example, the input multichannel signal contains energy from two active sources that are separated by an angle of about 40 to 60 degrees. The top left plot shows the histogram for IVA output 1 (indicating the direction of source 1), and the top right plot shows the histogram for IVA output 2 (indicating the direction of source 2). It may be seen that each of these plots indicates the estimated source direction as a range of angles which may be characterized by a center of gravity, rather than as a single peak across all frequencies. The bottom plots show the histograms for IVA outputs 3 and 4, which block energy from both sources and contain energy from reverberation.

Figure 20:
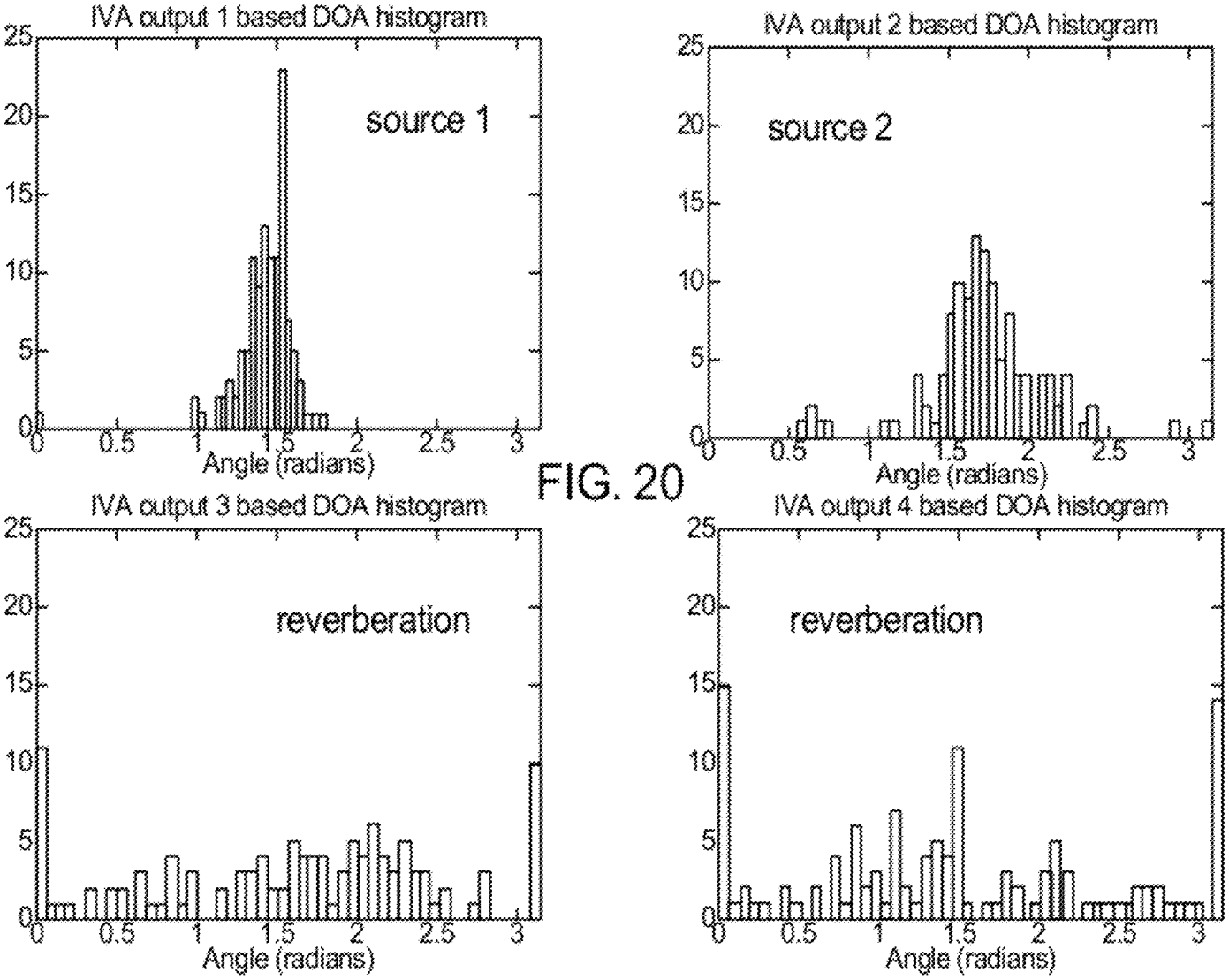
FIG. 20 shows an example of a set of four histograms for different output channels of an unmixing matrix that is adapted using an IVA adaptation rule (source separation of 15 degrees).

FIG. 20 shows another set of histograms for corresponding channels of a similar IVA unmixing matrix for an example in which the two active sources are separated by an angle of about fifteen degrees. As in FIG. 19, the top left plot shows the histogram for IVA output 1 (indicating the direction of source 1), the top right plot shows the histogram for IVA output 2 (indicating the direction of source 2), and the bottom plots show the histograms for IVA outputs 3 and 4 (indicating reverberant energy).

Figure 15B:
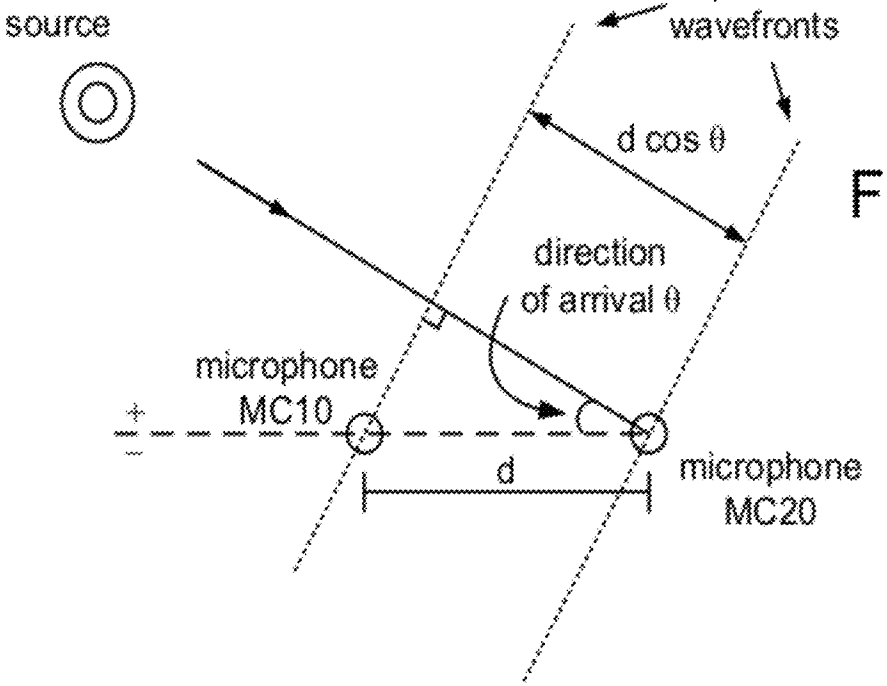
FIG. 15B shows a far-field model for estimation of direction of arrival.

In another example, direction estimation module DM10 is implemented to calculate the estimated source directions based on phase differences between channels of multichannel signal MCS10 for each of a plurality of different frequency components. In the ideal case of a single point source in the far field (e.g., such that the assumption of plane wavefronts as shown in FIG. 15B is valid) and no reverberation, the ratio of phase difference to frequency is constant with respect to frequency. With reference to the model illustrated in FIG. 15B, such an implementation of direction estimation module DM10 may be configured to calculate the source direction $\theta_i$ as the inverse cosine (also called the arccosine) of the quantity $$\frac{c\Delta\varphi_i}{d2\pi f_i},$$

where c denotes the speed of sound (approximately 340 m/sec), d denotes the distance between the microphones, $\Delta\phi_i$ denotes the difference in radians between the corresponding phase estimates for the two microphone channels, and f, is the frequency component to which the phase estimates correspond (e.g., the frequency of the corresponding FFT samples, or a center or edge frequency of the corresponding subbands).

Apparatus A100 may be implemented such that filter adaptation module AM10 is configured to handle small changes in the acoustic environment, such as movement of the speaker's head. For large changes, such as the speaker moving to speak from a different part of the room, it may be desirable to implement apparatus A100 such that direction estimation module DM10 updates the direction of arrival for the changing source and filter orientation module OM10 obtains (e.g., generates or retrieves) a beam in that direction to produce a new corresponding initial set of coefficient values (i.e., to reset the corresponding coefficient values according to the new source direction). In such case, it may be desirable for filter orientation module OM10 to produce more than one new initial set of coefficient values at a time. For example, it may be desirable for filter orientation module OM10 to produce new initial sets of coefficient values for at least the filters that are currently associated with estimated source directions. The new initial coefficient values are then updated by filter updating module UM10 as described herein.

To support real-time source tracking, it may be desirable to implement direction estimation module DM10 (or another source localization module or device that provides the estimated source directions) to quickly identify the DOA of a signal component from a source. It may be desirable for such a module or device to estimate the number of sources present in the acoustic scene being recorded and/or to perform source tracking and/or ranging. Source tracking may include associating an estimated source direction with a distinguishing characteristic, such as frequency distribution or pitch frequency, such that the module or device may continue to track a particular source over time even after its direction crosses the direction of another source.

Even if only two sources are to be tracked, it may be desirable to implement apparatus A100 to have at least four input channels. For example, an array of four microphones may be used to obtain beams that are more narrow than an array of two microphones can provide.

For a case in which the number of filters is greater than the number of sources (e.g., as indicated by direction estimation module DM10), it may be desirable to use the extra filters for noise estimation. For example, once filter orientation module OM10 has associated a filter with each estimated source direction (e.g., directions DA10 and DA20), it may be desirable to orient each remaining filter into a fixed direction at which no sources are present. For an application in which the axis of the microphone array is broadside to the region of interest, this fixed direction may be a direction of the array axis (also called an endfire direction), as typically no targeted source signal will originate from either of the array endfire directions in this case.

In one such example, filter orientation module OM10 is implemented to support generation of one or more noise references by pointing a beam of each of one or more non-source filters (i.e., the filter or filters of filter bank BK10 that remain after each estimated source direction has been associated with a corresponding filter) toward an array endfire direction or otherwise away from signal sources. The outputs of these filters may be used as reverberation references in a noise reduction operation to provide further dereverberation (e.g., an additional six dB). The resulting perceptual effect may be such that the speaker sounds as if he or she is speaking directly into the microphone, rather than at some distance away within a room.

Figure 21:
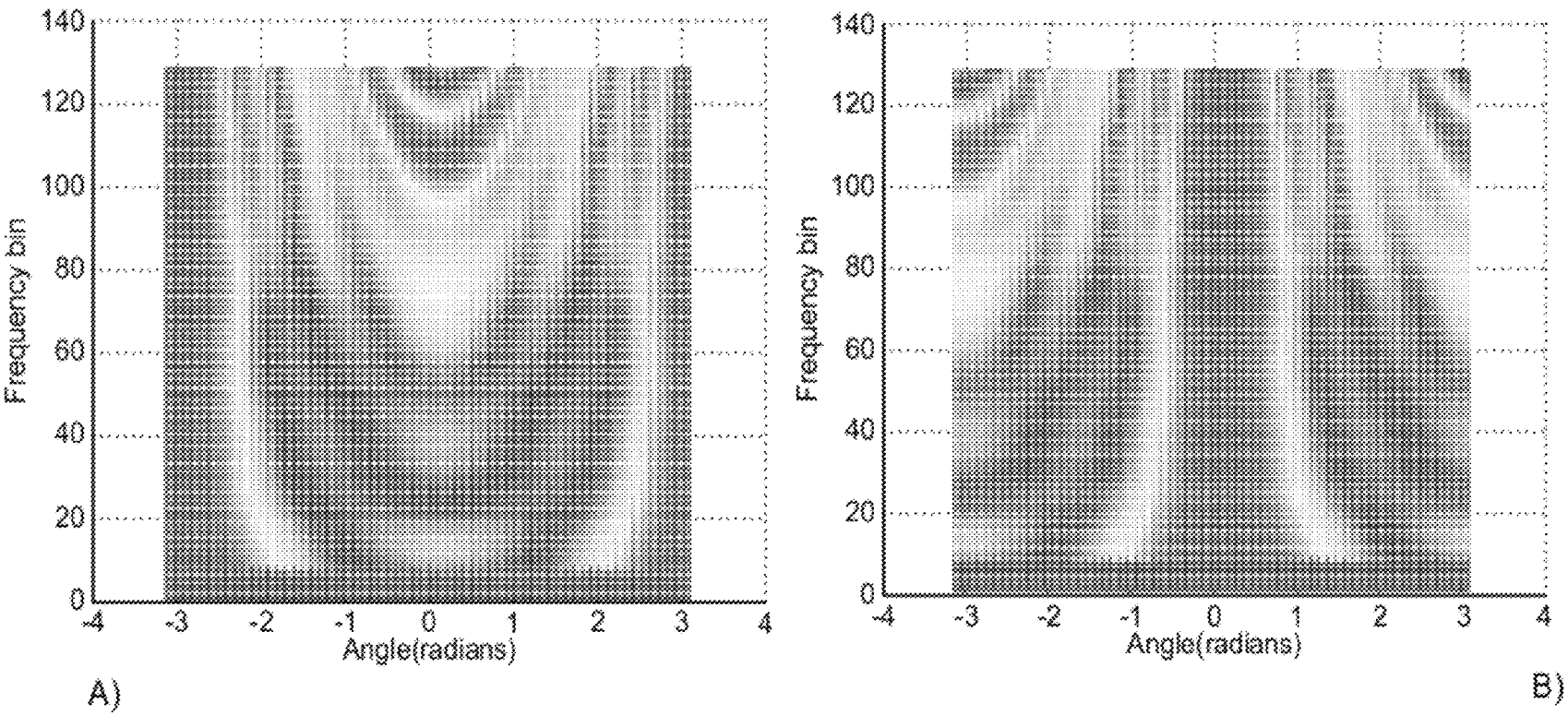
FIG. 21 shows an example of beam patterns of filters of a four-channel system that are fixed in different array endfire directions.

FIG. 21 shows an example of beam patterns of third and fourth filters of a four-channel implementation of filter bank BK10 (e.g., filter bank BK12) in which the third filter (plot A) is fixed in one endfire direction of the array (the +/−pi direction) and the fourth filter (plot B) is fixed in the other endfire direction of the array (the zero direction). Such fixed orientations may be used for a case in which each of the first and second filters of the filter bank is oriented toward a corresponding one of estimated source directions DA10 and DA20.

Figure 22:
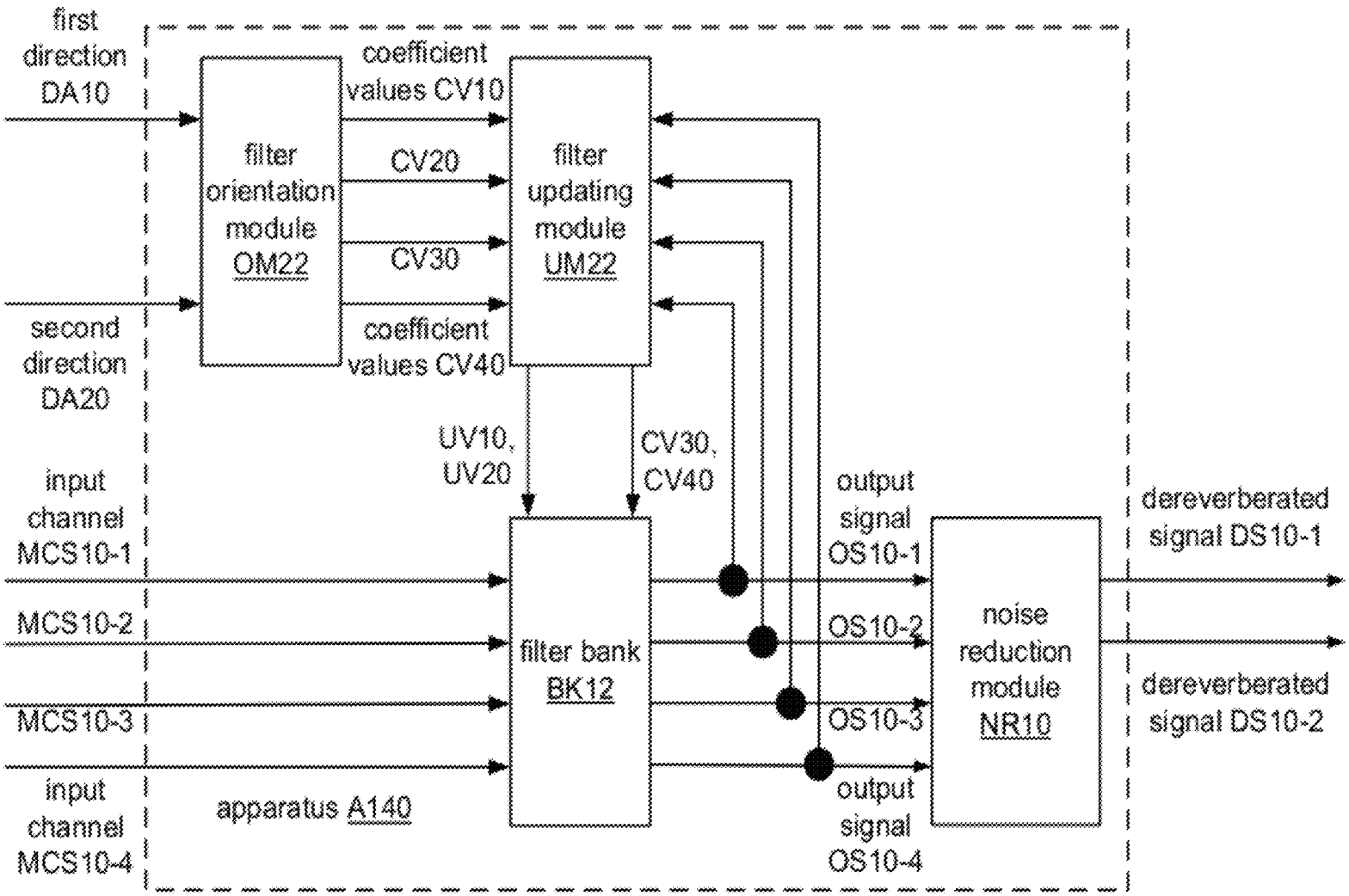
FIG. 22 shows a block diagram of an implementation A140 of apparatus A110.

FIG. 22 shows a block diagram of an implementation A140 of apparatus A110 that includes an implementation OM22 of filter orientation module OM12, which is configured to produce coefficient values CV30 to have a response that is oriented in one endfire direction of the microphone array and to produce coefficient values CV40 to have a response that is oriented in the other endfire direction of the microphone array (e.g., as shown in FIG. 21). Apparatus A140 also includes an implementation UM22 of filter updating module UM12 that is configured to pass the sets of coefficient values CV30 and CV40 to filter bank BK12 without updating them (e.g., without adapting them). It may be desirable to configure an adaptation rule of filter updating module UM22 to include a constraint (e.g., as described herein) that enforces null beams in the endfire directions in the source filters.

Apparatus A140 also includes a noise reduction module NR10 that is configured to perform a noise reduction operation on at least one of output signals of the source filters (e.g., OS10-1 and OS10-2), based on information from at least one of the output signals of the fixed filters (e.g., O510-3 and O510-4), to produce a corresponding dereverberated signal. In this particular example, noise reduction module NR10 is implemented to perform such an operation on each source output signal to produce corresponding dereverberated signals DS10-1 and DS10-2.

Noise reduction module NR10 may be implemented to perform the noise reduction as a frequency-domain operation (e.g., spectral subtraction or Wiener filtering). For example, noise reduction module NR10 may be implemented to produce a dereverberated signal from a source output signal by subtracting an average of the fixed output signals (also called reverberation references), by subtracting the reverberation reference associated with the endfire direction that is closest to the corresponding source direction, or by subtracting the reverberation reference associated with the endfire direction that is farthest from the corresponding source direction. Apparatus A140 may also be implemented to include an inverse transform module that is arranged to convert the dereverberated signals from the frequency domain to the time domain.

Apparatus A140 may also be implemented to use a voice activity detection (VAD) indication to control post-processing aggressiveness. For example, noise reduction module NR10 may be implemented to use an output signal of each of one or more other source filters (rather than or in addition to an output signal of a fixed filter) as a reverberation reference during intervals of voice inactivity. Apparatus A140 may be implemented to receive the VAD indication from another module or device. Alternatively, apparatus A140 may be implemented to include a VAD module that is configured to generate the VAD indication for each output channel based on information from one or more of the output signals of filter bank BK12. In one such example, the VAD module is implemented to generate the VAD indication by subtracting the total power of each other source output signal (i.e., the output of each individual filter of filter bank BK12 that is associated with an estimated source direction) and of each non-source output signal (i.e., the output of each filter of filter bank BK12 that has been fixed in a non-source direction) from the particular source output signal. It may be desirable to configure filter updating module UM22 to perform adaptation of the coefficient values CV10 and CV20 independently of any VAD indication.

It is possible to implement apparatus A100 to change the number of filters in filter bank BK10 at run-time, based on the number of sources (e.g., as detected by direction estimation DM10). In such case, it may be desirable for apparatus A100 to configure filter bank BK10 to include an additional filter that is fixed in an endfire direction, or two additional filters that are fixed in each of the endfire directions, as discussed herein.

In summary, constraints applied by filter updating module UM10 may include normalizing one or more source filters to have a unity gain response in each frequency with respect to direction; constraining the filter adaptation to enforce null beams in respective source directions; and/or fixing filter coefficient values in some frequency ranges while adapting filter coefficient values in other frequency ranges. Additionally or alternatively, apparatus A100 may be implemented to fix excess filters into endfire look directions when the number of input channels (e.g., the number of sensors) exceeds the estimated number of sources.

In one example, filter updating module UM10 is implemented as a digital signal processor (DSP) configured to execute a set of filter updating instructions, and the resulting adapted and normalized filter solution is loaded into an implementation of filter bank BK10 in a field-programmable gate array (FPGA) for application to the multichannel signal. In another example, the DSP performs both filter updating and application of the filter to the multichannel signal.

Figure 23:
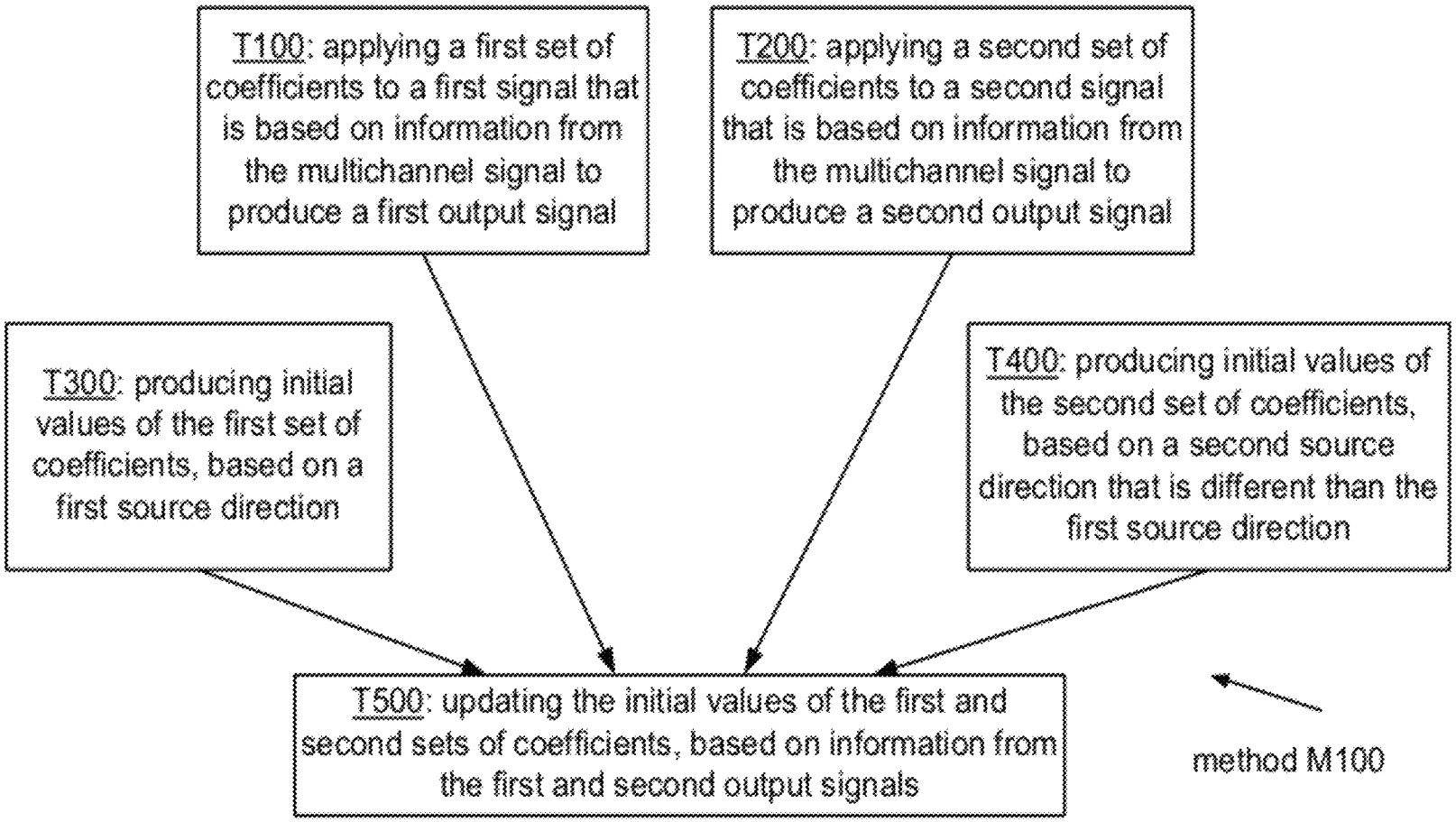
FIG. 23 shows a flowchart for a method M100 of processing a multichannel signal according to a general configuration.
Figure 24:
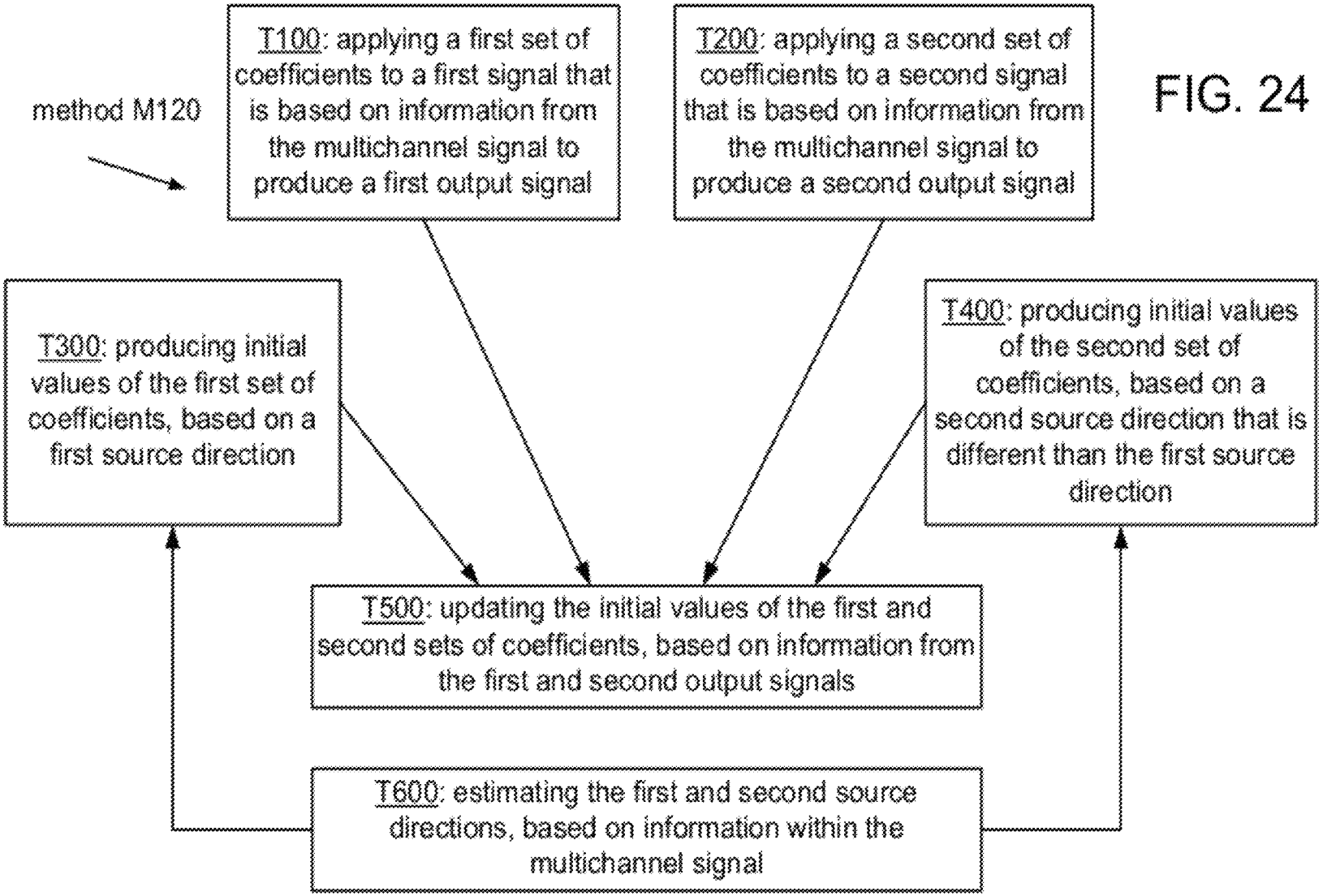
FIG. 24 shows a flowchart for an implementation M120 of method M100.

FIG. 23 shows a flowchart for a method M100 of processing a multichannel signal according to a general configuration that includes tasks T100, T200, T300, T400, and T500. Task T100 applies a plurality of first coefficients to a first signal that is based on information from the multichannel signal to produce a first output signal, and task T200 applies a plurality of second coefficients to a second signal that is based on information from the multichannel signal to produce a second output signal (e.g., as described herein with reference to implementations of filter bank BK10). Task T300 produces an initial set of values for the plurality of first coefficients, based on a first source direction, and task T400 produces an initial set of values for the plurality of second coefficients, based on a second source direction that is different than the first source direction (e.g., as described herein with reference to implementations of filter orientation module OM10). Task T500 updates the initial values for the pluralities of first and second coefficients, based on information from the first and second output signals, wherein said updating the initial set of values for the plurality of first coefficients is based on a response having a specified property (e.g., a maximum response) of the initial set of values for the plurality of first coefficients with respect to direction (e.g., as described herein with reference to implementations of filter updating module UM10). FIG. 24 shows a flowchart for an implementation M120 of method M100 that includes a task T600 which estimates the first and second source directions, based on information within the multichannel signal (e.g., as described herein with reference to implementations of direction estimation module DM10).

Figure 25A:
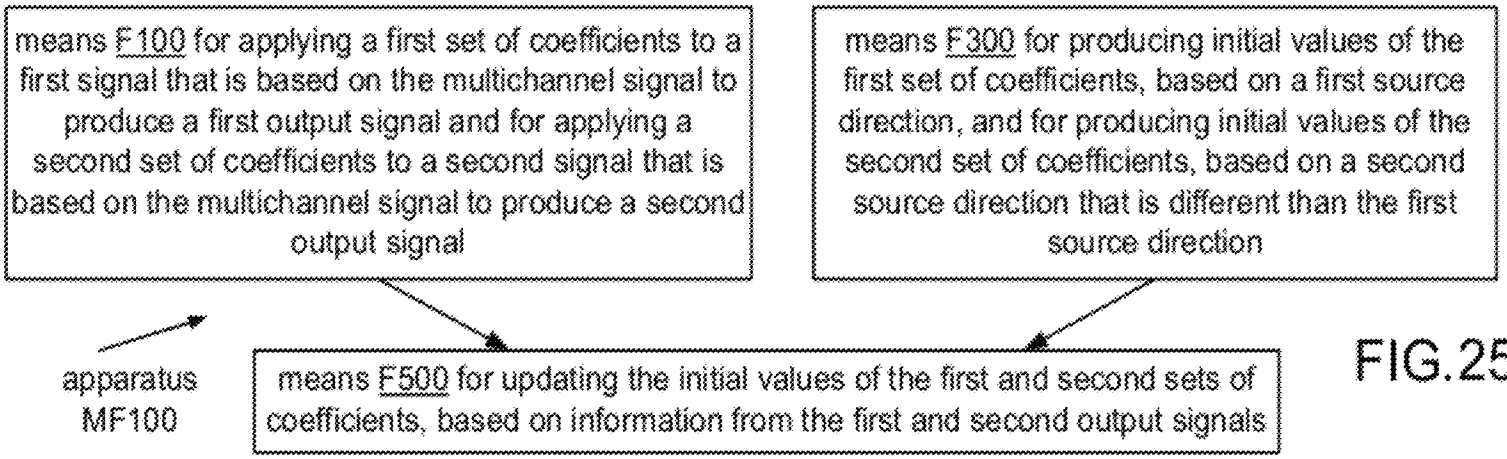
FIG. 25A shows a block diagram for an apparatus MF100 for processing a multichannel signal according to another general configuration.
Figure 25B:
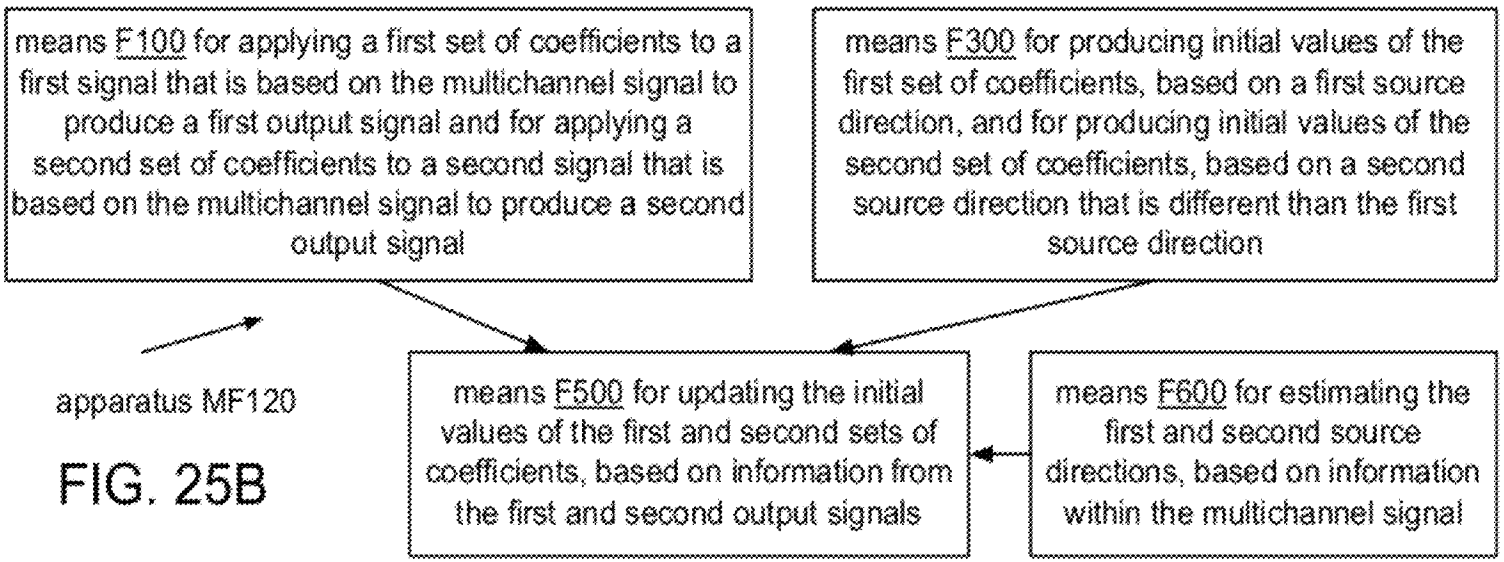
FIG. 25B shows a block diagram for an implementation MF120 of apparatus MF100.

FIG. 25A shows a block diagram for an apparatus MF100 for processing a multichannel signal according to another general configuration. Apparatus MF100 includes means F100 for applying a plurality of first coefficients to a first signal that is based on information from the multichannel signal to produce a first output signal and for applying a plurality of second coefficients to a second signal that is based on information from the multichannel signal to produce a second output signal (e.g., as described herein with reference to implementations of filter bank BK10). Apparatus MF100 also includes means F300 for producing an initial set of values for the plurality of first coefficients, based on a first source direction, and for producing an initial set of values for the plurality of second coefficients, based on a second source direction that is different than the first source direction (e.g., as described herein with reference to implementations of filter orientation module OM10). Apparatus MF100 also includes means F500 for updating the initial values for the pluralities of first and second coefficients, based on information from the first and second output signals, wherein said updating the initial set of values for the plurality of first coefficients is based on a response having a specified property (e.g., a maximum response) of the initial set of values for the plurality of first coefficients with respect to direction (e.g., as described herein with reference to implementations of filter updating module UM10). FIG. 25B shows a block diagram for an implementation MF120 of apparatus MF100 that includes means F600 for estimating the first and second source directions, based on information within the multichannel signal (e.g., as described herein with reference to implementations of direction estimation module DM10).

Microphone array R100 may be used to provide a spatial focus in a particular source direction. The array aperture (for a linear array, the distance between the two terminal microphones of the array), the number of microphones, and the relative arrangement of the microphones may all influence the spatial separation capabilities. FIG. 26A shows an example of a beam pattern obtained using a four-microphone implementation of array R100 with a uniform spacing of eight centimeters. FIG. 26B shows an example of a beam pattern obtained using a four-microphone implementation of array R100 with a uniform spacing of four centimeters. In these figures, the frequency range is zero to four kilohertz, and the z axis indicates gain response. As above, the direction (angle) of arrival is indicated relative to the array axis.

A nonuniform microphone spacing may include both small spacings and large spacings, which may help to equalize separation performance across a wide frequency range. For example, such nonuniform spacing may be used to enable beams that have similar widths in different frequencies.

To provide sharp spatial beams for signal separation in the range of about 500 to 4000 Hz, it may be desirable to implement array R100 to have non-uniform spacing between adjacent microphones and an aperture of at least twenty centimeters that is oriented broadside towards the acoustic scene being recorded. In one example, a four-microphone implementation of array R100 has an aperture of twenty centimeters and a nonuniform spacing of four, six, and ten centimeters between the respective adjacent microphone pairs. FIG. 26C shows an example of such a spacing and a corresponding beam pattern obtained using such an array, where the frequency range is zero to four kilohertz, the z axis indicates gain response, and the direction (angle) of arrival is indicated relative to the array axis. It may be seen that the nonuniform array provides better separation at low frequencies than the four-centimeter array, and that this beam pattern lacks the high-frequency artifacts seen in the beam pattern for the eight-centimeter array.

Using an implementation of apparatus A100 as described herein with such a non-uniformly-spaced 20-cm-aperture linear array, interference cancellation and de-reverberation of up to 18-20 dB may be obtained in the 500-4000 Hz band with few artifacts, even with speakers standing shoulder-to-shoulder at a distance of two to three meters, resulting in a robust acoustic zoom-in effect. Beyond three meters, a decreasing direct-path-to-reverberation ratio and increasing low-frequency power leads to more post-processing distortion, but an acoustic zoom-in effect is still possible (e.g., up to 15 dB). Consequently, it may be desirable to combine such methods with reconstructive speech spectrum techniques, especially below 500 Hz and above 2 kHz, to provide a "face-to-face conversation" sound effect. To cancel interference below 500 Hz, a larger microphone spacing is typically used.

Figure 27B:
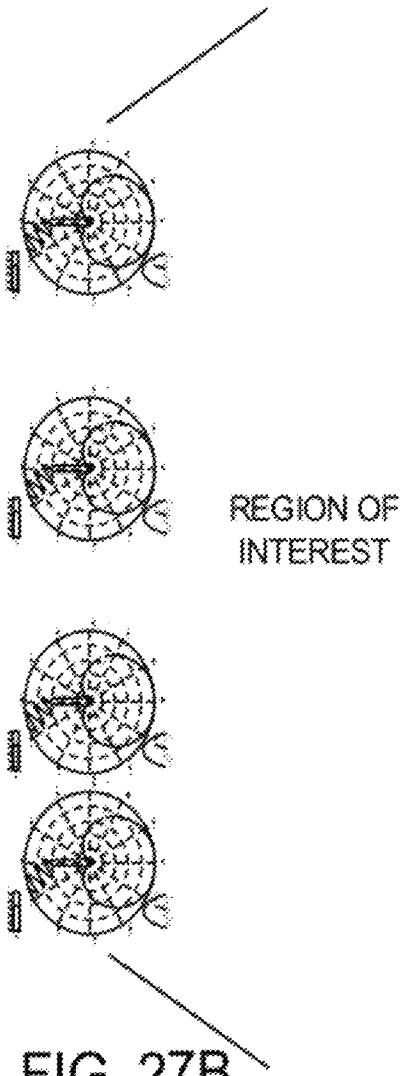
FIG. 27B shows a diagram of a non-uniform linear array of unidirectional microphones.
Figure 27A:
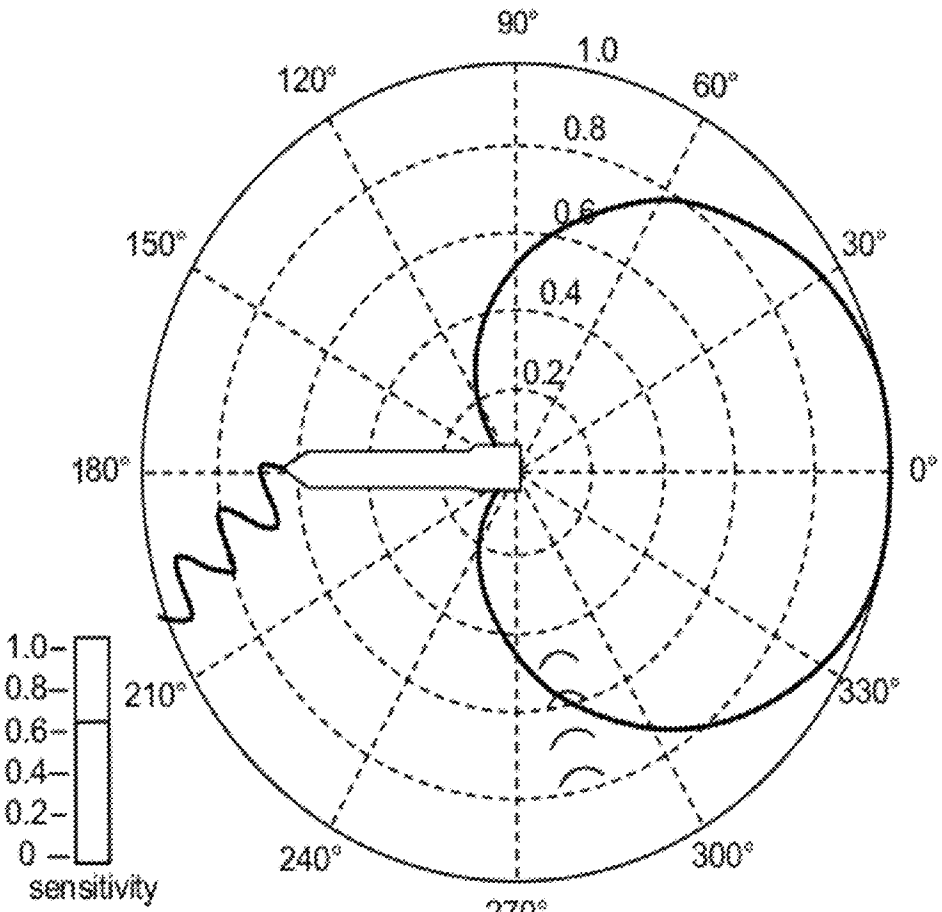
FIG. 27A shows a diagram of a typical unidirectional microphone response.

Although FIGS. 26A-26C show beam patterns obtained using arrays of omnidirectional microphones, the principles described herein may also be extended to arrays of directional microphones. FIG. 27A shows a diagram of a typical unidirectional microphone response. This particular example shows the microphone response having a sensitivity of about 0.65 to a signal component arriving in a direction of about 283 degrees. FIG. 27B shows a diagram of a non-uniformly-spaced linear array of such microphones in which a region of interest that is broadside to the array axis is identified. Such an implementation of array R100 may be used to support a robust acoustic zoom-in effect for distance of two to four meters. Beyond three meters, it may be possible to obtain a zoom-in effect of 18 dB with such an array.

It may be desirable to adjust a directivity vector (or "steering vector") to account for microphone directivity. In one such example, filter orientation module OM10 is implemented such that each column j of matrix D of expression (1) above is expressed as $D_{mj}(\omega)=v_{mj}(\omega,\theta_j)\times\exp(-i\times\cos(\theta_j)\times pos(m)\times\omega/c)$, where $v_{mj}(\omega,\theta_j)$ is a directivity factor that indicates a relative response of microphone m at frequency ω and incident angle $\theta_j$. In such case, it may also be desirable to adjust coherence function Γ (e.g., by a similar factor) to account for microphone directivity. In another example, filter updating module UM10 is implemented such that the maximum response $R_j(\omega)$ as shown in expression (3) is expressed instead as $$R_j(\omega) = \max_{\theta=[-\pi,\pi]} |W_{j1}(\omega)v_1(\omega,\theta)D_{\theta 1}(\omega) + W_{j2}(\omega)v_2(\omega,\theta)D_{\theta 2}(\omega) + \ldots + W_{jM}(\omega)v_M(\omega,\theta)D_{\theta M}(\omega)|,$$

where $v_m(\omega,\theta)$ is a directivity factor that indicates a relative response of microphone m at frequency ω and incident angle θ.

During the operation of multi-microphone audio sensing device D10, microphone array R100 produces a multichannel signal in which each channel is based on the response of a corresponding one of the microphones to the acoustic environment. One microphone may receive a particular sound more directly than another microphone, such that the corresponding channels differ from one another to provide collectively a more complete representation of the acoustic environment than can be captured using a single microphone.

Figure 28A:
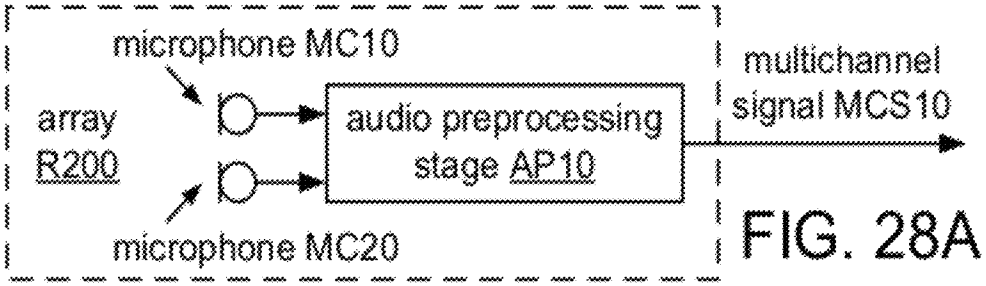
FIG. 28A shows a block diagram of an implementation R200 of array R100.

It may be desirable for array R100 to perform one or more processing operations on the signals produced by the microphones to produce the multichannel signal MCS10 that is processed by apparatus A100. FIG. 28A shows a block diagram of an implementation R200 of array R100 that includes an audio preprocessing stage AP10 configured to perform one or more such operations, which may include (without limitation) impedance matching, analog-to-digital conversion, gain control, and/or filtering in the analog and/or digital domains.

Figure 28B:
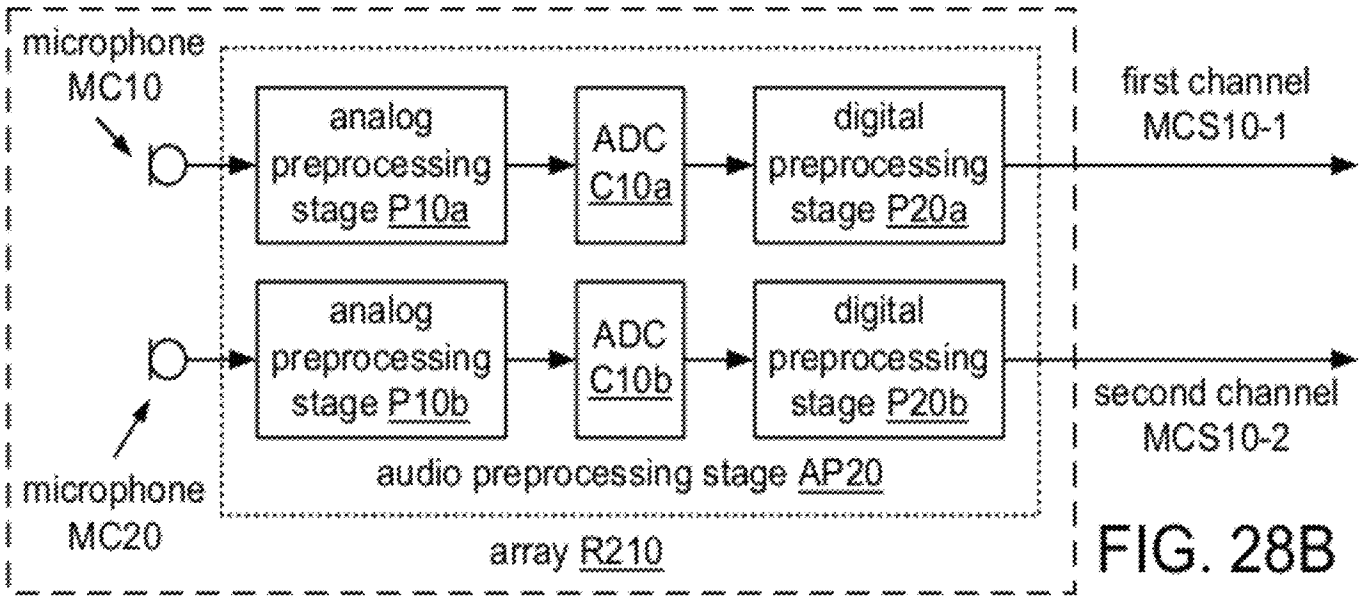
FIG. 28B shows a block diagram of an implementation R210 of array R200.

FIG. 28B shows a block diagram of an implementation R210 of array R200. Array R210 includes an implementation AP20 of audio preprocessing stage AP10 that includes analog preprocessing stages P10*a* and P10*b*. In one example, stages P10*a* and P10*b* are each configured to perform a highpass filtering operation (e.g., with a cutoff frequency of 50, 100, or 200 Hz) on the corresponding microphone signal.

It may be desirable for array R100 to produce the multichannel signal as a digital signal, that is to say, as a sequence of samples. Array R210, for example, includes analog-to-digital converters (ADCs) C10*a* and C10*b* that are each arranged to sample the corresponding analog channel. Typical sampling rates for acoustic applications include 8 kHz, 12 kHz, 16 kHz, and other frequencies in the range of from about 8 to about 16 kHz, although sampling rates as high as about 44.1, 48, and 192 kHz may also be used. In this particular example, array R210 also includes digital preprocessing stages P20*a* and P20*b* that are each configured to perform one or more preprocessing operations (e.g., echo cancellation, noise reduction, and/or spectral shaping) on the corresponding digitized channel to produce the corresponding channels MCS10-1, MCS10-2 of multichannel signal MCS10. Additionally or in the alternative, digital preprocessing stages P20*a* and P20*b* may be implemented to perform a frequency transform (e.g., an FFT or MDCT operation) on the corresponding digitized channel to produce the corresponding channels MCS10-1, MCS10-2 of multichannel signal MCS10 in the corresponding frequency domain. Although FIGS. 28A and 28B show two-channel implementations, it will be understood that the same principles may be extended to an arbitrary number of microphones and corresponding channels of multichannel signal MCS10 (e.g., a three-, four-, or five-channel implementation of array R100 as described herein).

Each microphone of array R100 may have a response that is omnidirectional, bidirectional, or unidirectional (e.g., cardioid). The various types of microphones that may be used in array R100 include (without limitation) piezoelectric microphones, dynamic microphones, and electret microphones. For a far-field application, the center-to-center spacing between adjacent microphones of array R100 is typically in the range of from about four to ten centimeters, although a larger spacing between at least some of the adjacent microphone pairs (e.g., up to 20, 30, or 40 centimeters or more) is also possible in a device such as a flat-panel television display. The microphones of array R100 may be arranged along a line (with uniform or non-uniform microphone spacing) or, alternatively, such that their centers lie at the vertices of a two-dimensional (e.g., triangular) or three-dimensional shape.

It is expressly noted that the microphones may be implemented more generally as transducers sensitive to radiations or emissions other than sound. In one such example, the microphone pair is implemented as a pair of ultrasonic transducers (e.g., transducers sensitive to acoustic frequencies greater than fifteen, twenty, twenty-five, thirty, forty, or fifty kilohertz or more).

It may be desirable to produce an audio sensing device D10 as shown in FIG. 1B that includes an instance of array R100 configured to produce a multichannel signal MCS and an instance of apparatus A100 configured to process multichannel signal MCS. In general, device D10 includes an instance of any of the implementations of microphone array R100 disclosed herein and an instance of any of the implementations of apparatus A100 (or MF100) disclosed herein, and any of the audio sensing devices disclosed herein may be implemented as an instance of device D10. Examples of an audio sensing device that may be implemented to include such an array and may be used for audio recording and/or voice communications applications include television displays, set-top boxes, and audio- and/or video-conferencing devices.

Figure 29A:
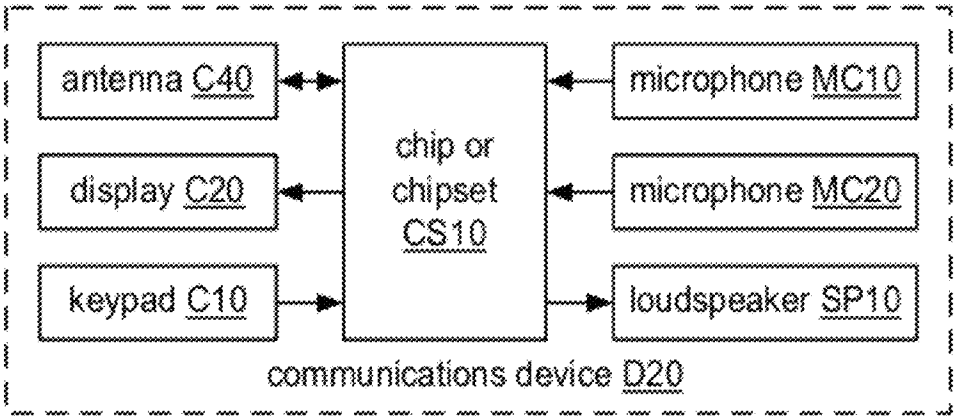
FIG. 29A shows a block diagram of a communications device D20 that is an implementation of device D10.

FIG. 29A shows a block diagram of a communications device D20 that is an implementation of device D10. Device D20 includes a chip or chipset CS10 (e.g., a mobile station modem (MSM) chipset) that includes an implementation of apparatus A100 (or MF100) as described herein. Chip/chipset CS10 may include one or more processors, which may be configured to execute all or part of the operations of apparatus A100 or MF100 (e.g., as instructions). Chip/chipset CS10 may also include processing elements of array R100 (e.g., elements of audio preprocessing stage AP10 as described herein).

Chip/chipset CS10 includes a receiver which is configured to receive a radio-frequency (RF) communications signal (e.g., via antenna C40) and to decode and reproduce (e.g., via loudspeaker SP10) an audio signal encoded within the RF signal. Chip/chipset CS10 also includes a transmitter which is configured to encode an audio signal that is based on an output signal produced by apparatus A100 and to transmit an RF communications signal (e.g., via antenna C40) that describes the encoded audio signal. For example, one or more processors of chip/chipset CS10 may be configured to perform a noise reduction operation as described above on one or more channels of the multichannel signal such that the encoded audio signal is based on the noise-reduced signal. In this example, device D20 also includes a keypad C10 and display C20 to support user control and interaction.

Figure 33:
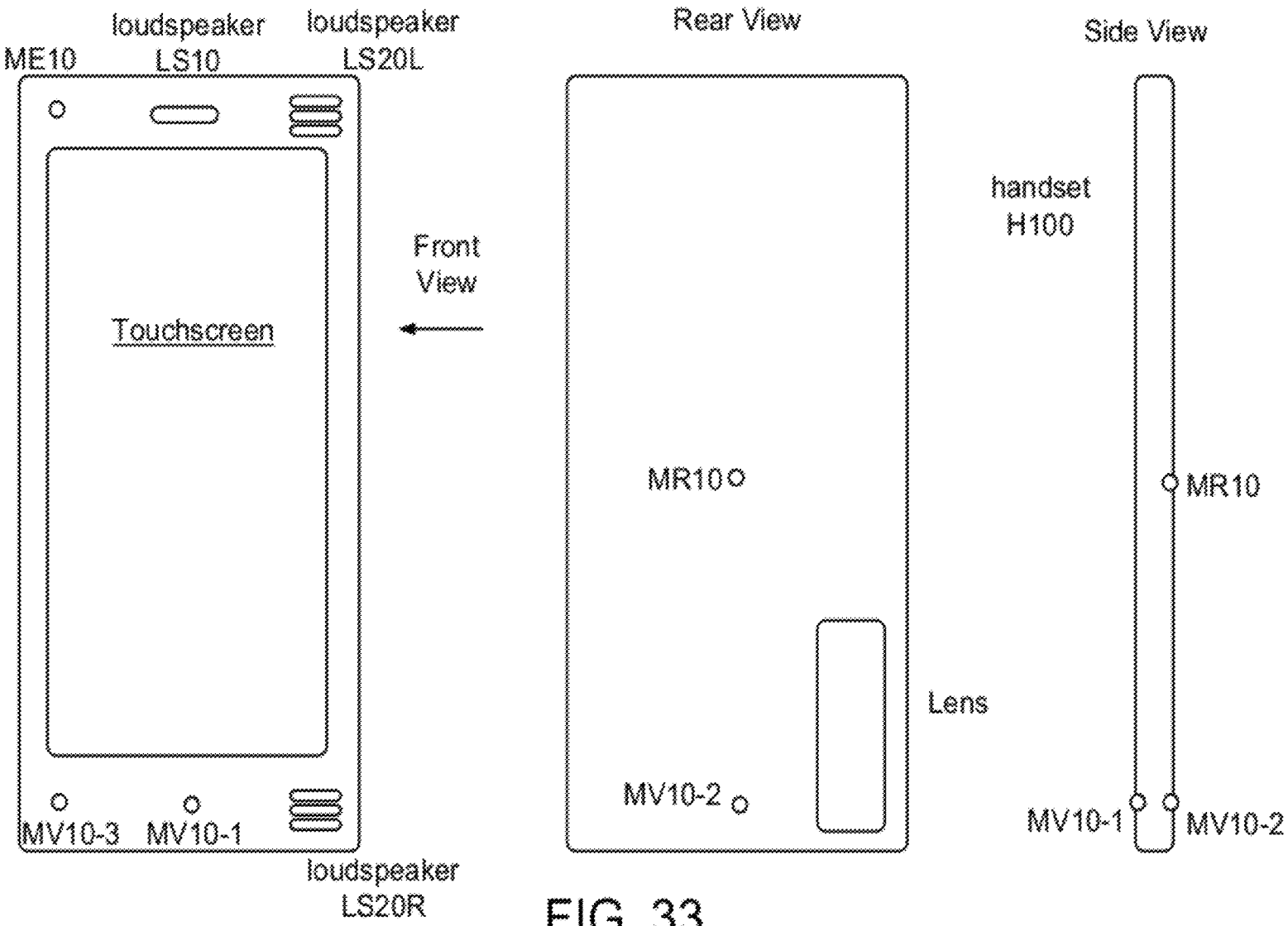
FIG. 33 shows front, rear, and side views of a handset H100.

FIG. 33 shows front, rear, and side views of a handset H100 (e.g., a smartphone) that may be implemented as an instance of device D20. Handset H100 includes two voice microphones MV10-1 and MV10-3 arranged on the front face; an error microphone ME10 located in a top corner of the front face; and a voice microphone MV10-2, a noise reference microphone MR10, and a camera lens arranged on the rear face. A loudspeaker LS10 is arranged in the top center of the front face near error microphone ME10, and two other loudspeakers LS20L, LS20R are also provided (e.g., for speakerphone applications). A maximum distance between the microphones of such a handset is typically about ten or twelve centimeters.

Figure 29B:
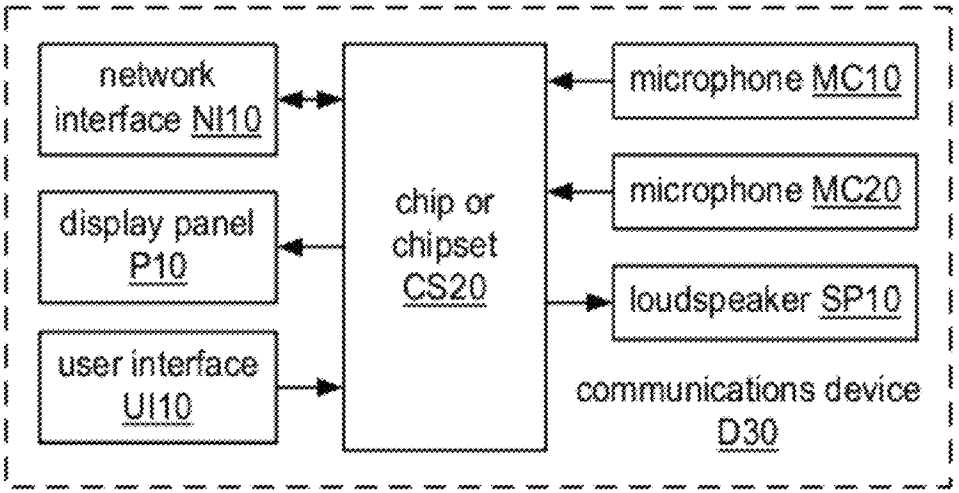
FIG. 29B shows a block diagram of a communications device D30 that is an implementation of device D10.

FIG. 29B shows a block diagram of another communications device D30 that is an implementation of device D10. Device D30 includes a chip or chipset CS20 that includes an implementation of apparatus A100 (or MF100) as described herein. Chip/chipset CS20 may include one or more processors, which may be configured to execute all or part of the operations of apparatus A100 or MF100 (e.g., as instructions). Chip/chipset CS20 may also include processing elements of array R100 (e.g., elements of audio preprocessing stage AP10 as described herein).

Device D30 includes a network interface NI10, which is configured to support data communications with a network (e.g., with a local-area network and/or a wide-area network). The protocols used by interface NI10 for such communications may include Ethernet (e.g., as described by any of the IEEE 802.2 standards), wireless local area networking (e.g., as described by any of the IEEE 802.11 or 802.16 standards), Bluetooth (e.g., a Headset or other Profile as described in the Bluetooth Core Specification version 4.0 [which includes Classic Bluetooth, Bluetooth high speed, and Bluetooth low energy protocols], Bluetooth SIG, Inc., Kirkland, Wash.), Peanut (QUALCOMM Incorporated, San Diego, Calif.), and/or ZigBee (e.g., as described in the ZigBee 2007 Specification and/or the ZigBee RF4CE Specification, ZigBee Alliance, San Ramon, Calif.). In one example, network interface NI10 is configured to support voice communications applications via microphone MC10 and MC20 and loudspeaker SP10 (e.g., using a Voice over Internet Protocol or "VoIP" protocol). Device D30 also includes a user interface UI10 configured to support user control of device D30 (e.g., via an infrared signal received from a handheld remote control and/or via recognition of voice commands). Device D30 also includes a display panel P10 configured to display video content to one or more users.

Figure 30B:
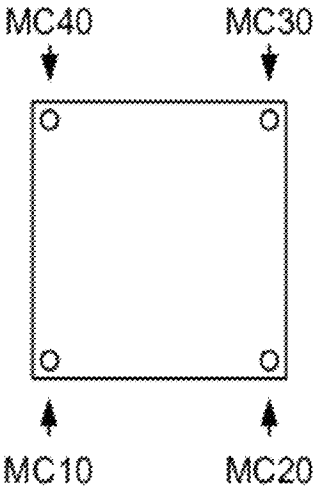
FIGS. 30A-D show top views of several examples of conferencing implementations of device D10.
Figure 30D:
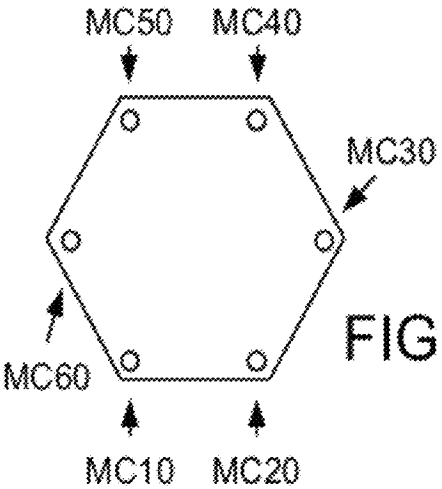
Figure 30A:
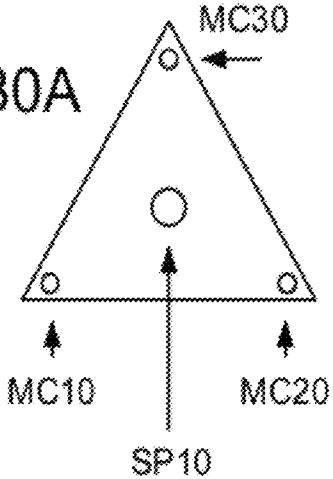
Figure 30C:
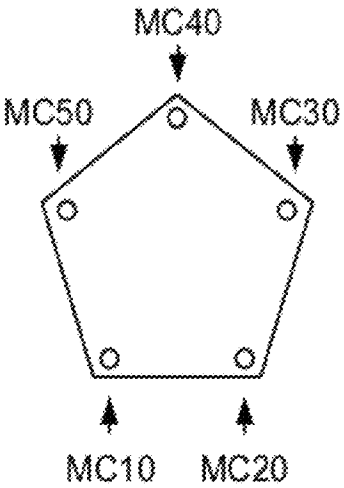

Reverberation energy within the multichannel recorded signal tends to increase as the distance between the desired source and array R100 increases. Another application in which it may be desirable to apply apparatus A100 is audio- and/or video-conferencing. FIGS. 30A-D show top views of several examples of conferencing implementations of device D10. FIG. 30A includes a three-microphone implementation of array R100 (microphones MC10, MC20, and MC30). FIG. 30B includes a four-microphone implementation of array R100 (microphones MC10, MC20, MC30, and MC40). FIG. 30C includes a five-microphone implementation of array R100 (microphones MC10, MC20, MC30, MC40, and MC50). FIG. 30D includes a six-microphone implementation of array R100 (microphones MC10, MC20, MC30, MC40, MC50, and MC60). It may be desirable to position each of the microphones of array R100 at a corresponding vertex of a regular polygon. A loudspeaker SP10 for reproduction of the far-end audio signal may be included within the device (e.g., as shown in FIG. 30A), and/or such a loudspeaker may be located separately from the device (e.g., to reduce acoustic feedback).

It may be desirable for a conferencing implementation of device D10 to perform a separate instance of an implementation of apparatus A100 for each of more than one spatial sector (e.g., overlapping or nonoverlapping sectors of 90, 120, 150, or 180 degrees). In such case, it may also be desirable for the device to combine (e.g., to mix) the various dereverberated speech signals before transmission to the far-end.

In another example of a conferencing application of device D10 (e.g., of device D30), a horizontal linear implementation of array R100 is included within the front panel of a television or set-top box. Such a device may be configured to support telephone communications by locating and dereverberating a near-end source signal from a person speaking within the area in front of and from a position about one to three or four meters away from the array (e.g., a viewer watching the television).

Figure 31A:
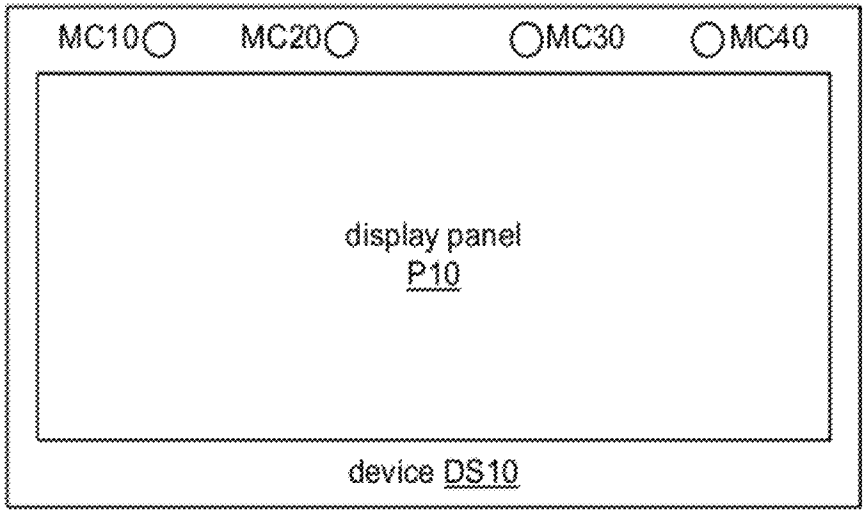
FIG. 31A shows a block diagram of an implementation DS10 of device D10.
Figure 31B:
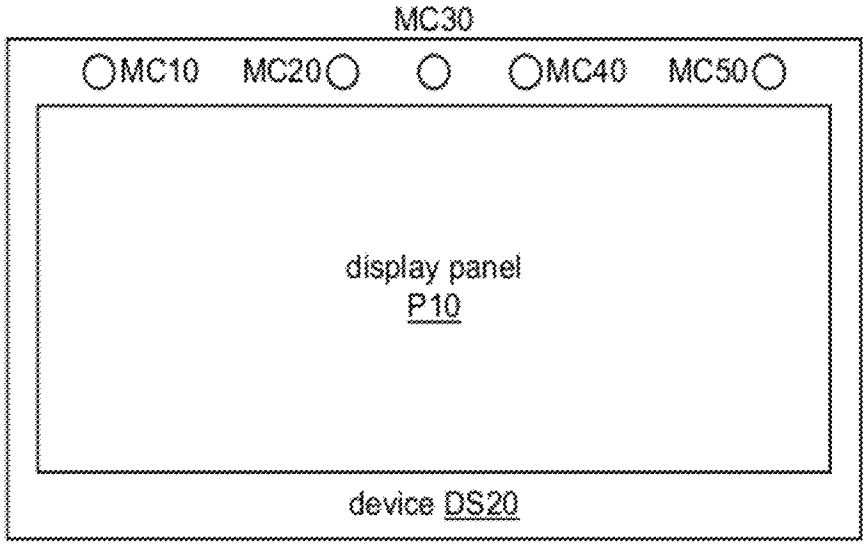
FIG. 31B shows a block diagram of an implementation DS20 of device D10.

FIG. 31A shows a diagram of an implementation DS10 (e.g., a television or computer monitor) of device D10 that includes a display panel P10 and an implementation of array R100 that includes four microphones MC10, MC20, MC30, and MC40 arranged linearly with uniform spacing. FIG. 31B shows a diagram of an implementation DS20 (e.g., a television or computer monitor) of device D10 that includes display panel P10 and an implementation of array R100 that includes four microphones MC10, MC20, MC30, and MC40 arranged linearly with non-uniform spacing. Either of devices DS10 and DS20 may also be realized as an implementation of device D30 as described herein. It is expressly disclosed that applicability of systems, methods, and apparatus disclosed herein is not limited to the particular examples noted herein.

The methods and apparatus disclosed herein may be applied generally in any audio sensing application, especially sensing of signal components from far-field sources. The range of configurations disclosed herein includes communications devices that reside in a wireless telephony communication system configured to employ a code-division multiple-access (CDMA) over-the-air interface. Nevertheless, it would be understood by those skilled in the art that a method and apparatus having features as described herein may reside in any of the various communication systems employing a wide range of technologies known to those of skill in the art, such as systems employing Voice over IP (VoIP) over wired and/or wireless (e.g., CDMA, TDMA, FDMA, and/or TD-SCDMA) transmission channels.

It is expressly contemplated and hereby disclosed that communications devices disclosed herein may be adapted for use in networks that are packet-switched (for example, wired and/or wireless networks arranged to carry audio transmissions according to protocols such as VoIP) and/or circuit-switched. It is also expressly contemplated and hereby disclosed that communications devices disclosed herein may be adapted for use in narrowband coding systems (e.g., systems that encode an audio frequency range of about four or five kilohertz) and/or for use in wideband coding systems (e.g., systems that encode audio frequencies greater than five kilohertz), including whole-band wideband coding systems and split-band wideband coding systems.

The foregoing presentation of the described configurations is provided to enable any person skilled in the art to make or use the methods and other structures disclosed herein. The flowcharts, block diagrams, and other structures shown and described herein are examples only, and other variants of these structures are also within the scope of the disclosure. Various modifications to these configurations are possible, and the generic principles presented herein may be applied to other configurations as well. Thus, the present disclosure is not intended to be limited to the configurations shown above but rather is to be accorded the widest scope consistent with the principles and novel features disclosed in any fashion herein, including in the attached claims as filed, which form a part of the original disclosure.

Those of skill in the art will understand that information and signals may be represented using any of a variety of different technologies and techniques. For example, data, instructions, commands, information, signals, bits, and symbols that may be referenced throughout the above description may be represented by voltages, currents, electromagnetic waves, magnetic fields or particles, optical fields or particles, or any combination thereof.

Important design requirements for implementation of a configuration as disclosed herein may include minimizing processing delay and/or computational complexity (typically measured in millions of instructions per second or MIPS), especially for computation-intensive applications, such as playback of compressed audio or audiovisual information (e.g., a file or stream encoded according to a compression format, such as one of the examples identified herein) or applications for wideband communications (e.g., voice communications at sampling rates higher than eight kilohertz, such as 12, 16, 44.1, 48, or 192 kHz).

Goals of a multi-microphone processing system may include achieving ten to twelve dB in overall noise reduction, preserving voice level and color during movement of a desired speaker, obtaining a perception that the noise has been moved into the background instead of an aggressive noise removal, dereverberation of speech, and/or enabling the option of post-processing for more aggressive noise reduction.

An apparatus as disclosed herein (e.g., apparatus A100 and MF100) may be implemented in any combination of hardware with software, and/or with firmware, that is deemed suitable for the intended application. For example, the elements of such an apparatus may be fabricated as electronic and/or optical devices residing, for example, on the same chip or among two or more chips in a chipset. One example of such a device is a fixed or programmable array of logic elements, such as transistors or logic gates, and any of the elements of the apparatus may be implemented as one or more such arrays. Any two or more, or even all, of the elements of the apparatus may be implemented within the same array or arrays. Such an array or arrays may be implemented within one or more chips (for example, within a chipset including two or more chips).

One or more elements of the various implementations of the apparatus disclosed herein may be implemented in whole or in part as one or more sets of instructions arranged to execute on one or more fixed or programmable arrays of logic elements, such as microprocessors, embedded processors, IP cores, digital signal processors, FPGAs (field-programmable gate arrays), ASSPs (application-specific standard products), and ASICs (application-specific integrated circuits). Any of the various elements of an implementation of an apparatus as disclosed herein may also be embodied as one or more computers (e.g., machines including one or more arrays programmed to execute one or more sets or sequences of instructions, also called "processors"), and any two or more, or even all, of these elements may be implemented within the same such computer or computers.

A processor or other means for processing as disclosed herein may be fabricated as one or more electronic and/or optical devices residing, for example, on the same chip or among two or more chips in a chipset. One example of such a device is a fixed or programmable array of logic elements, such as transistors or logic gates, and any of these elements may be implemented as one or more such arrays. Such an array or arrays may be implemented within one or more chips (for example, within a chipset including two or more chips). Examples of such arrays include fixed or programmable arrays of logic elements, such as microprocessors, embedded processors, IP cores, DSPs, FPGAs, ASSPs, and ASICs. A processor or other means for processing as disclosed herein may also be embodied as one or more computers (e.g., machines including one or more arrays programmed to execute one or more sets or sequences of instructions) or other processors. It is possible for a processor as described herein to be used to perform tasks or execute other sets of instructions that are not directly related to a multichannel directional audio processing procedure as described herein, such as a task relating to another operation of a device or system in which the processor is embedded (e.g., an audio sensing device). It is also possible for part of a method as disclosed herein to be performed by a processor of the audio sensing device and for another part of the method to be performed under the control of one or more other processors.

Those of skill will appreciate that the various illustrative modules, logical blocks, circuits, and tests and other operations described in connection with the configurations disclosed herein may be implemented as electronic hardware, computer software, or combinations of both. Such modules, logical blocks, circuits, and operations may be implemented or performed with a general-purpose processor, a digital signal processor (DSP), an ASIC or ASSP, an FPGA or other programmable logic device, discrete gate or transistor logic, discrete hardware components, or any combination thereof designed to produce the configuration as disclosed herein. For example, such a configuration may be implemented at least in part as a hard-wired circuit, as a circuit configuration fabricated into an application-specific integrated circuit, or as a firmware program loaded into non-volatile storage or a software program loaded from or into a data storage medium as machine-readable code, such code being instructions executable by an array of logic elements such as a general purpose processor or other digital signal processing unit. A general-purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration. A software module may reside in a non-transitory storage medium such as RAM (random-access memory), ROM (read-only memory), nonvolatile RAM (NVRAM) such as flash RAM, erasable programmable ROM (EPROM), electrically erasable programmable ROM (EEPROM), registers, hard disk, a removable disk, or a CD-ROM; or in any other form of storage medium known in the art. An illustrative storage medium is coupled to the processor such the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

It is noted that the various methods disclosed herein (e.g., method M100 and other methods disclosed by way of description of the operation of the various apparatus described herein) may be performed by an array of logic elements such as a processor, and that various elements of an apparatus as described herein may be implemented as modules designed to execute on such an array. As used herein, the term "module" or "sub-module" can refer to any method, apparatus, device, unit or computer-readable data storage medium that includes computer instructions (e.g., logical expressions) in software, hardware or firmware form. It is to be understood that multiple modules or systems can be combined into one module or system and one module or system can be separated into multiple modules or systems to perform the same functions. When implemented in software or other computer-executable instructions, the elements of a process are essentially the code segments to perform the related tasks, such as with routines, programs, objects, components, data structures, and the like. The term "software" should be understood to include source code, assembly language code, machine code, binary code, firmware, macrocode, microcode, any one or more sets or sequences of instructions executable by an array of logic elements, and any combination of such examples. The program or code segments can be stored in a processor-readable storage medium or transmitted by a computer data signal embodied in a carrier wave over a transmission medium or communication link.

The implementations of methods, schemes, and techniques disclosed herein may also be tangibly embodied (for example, in one or more computer-readable media as listed herein) as one or more sets of instructions readable and/or executable by a machine including an array of logic elements (e.g., a processor, microprocessor, microcontroller, or other finite state machine). The term "computer-readable medium" may include any medium that can store or transfer information, including volatile, nonvolatile, removable and non-removable media. Examples of a computer-readable medium include an electronic circuit, a semiconductor memory device, a ROM, a flash memory, an erasable ROM (EROM), a floppy diskette or other magnetic storage, a CD-ROM/DVD or other optical storage, a hard disk, a fiber optic medium, a radio frequency (RF) link, or any other medium which can be used to store the desired information and which can be accessed. The computer data signal may include any signal that can propagate over a transmission medium such as electronic network channels, optical fibers, air, electromagnetic, RF links, etc. The code segments may be downloaded via computer networks such as the Internet or an intranet. In any case, the scope of the present disclosure should not be construed as limited by such embodiments.

Each of the tasks of the methods described herein may be embodied directly in hardware, in a software module executed by a processor, or in a combination of the two. In a typical application of an implementation of a method as disclosed herein, an array of logic elements (e.g., logic gates) is configured to perform one, more than one, or even all of the various tasks of the method. One or more (possibly all) of the tasks may also be implemented as code (e.g., one or more sets of instructions), embodied in a computer program product (e.g., one or more data storage media such as disks, flash or other nonvolatile memory cards, semiconductor memory chips, etc.), that is readable and/or executable by a machine (e.g., a computer) including an array of logic elements (e.g., a processor, microprocessor, microcontroller, or other finite state machine). The tasks of an implementation of a method as disclosed herein may also be performed by more than one such array or machine. In these or other implementations, the tasks may be performed within a device for wireless communications such as a cellular telephone or other device having such communications capability. Such a device may be configured to communicate with circuit-switched and/or packet-switched networks (e.g., using one or more protocols such as VoIP). For example, such a device may include RF circuitry configured to receive and/or transmit encoded frames.

It is expressly disclosed that the various methods disclosed herein may be performed by a communications device, and that the various apparatus described herein may be included within such a device. A typical real-time (e.g., online) application is a telephone conversation conducted using such a device.

In one or more exemplary embodiments, the operations described herein may be implemented in hardware, software, firmware, or any combination thereof. If implemented in software, such operations may be stored on or transmitted over a computer-readable medium as one or more instructions or code. The term "computer-readable media" includes both computer-readable storage media and communication (e.g., transmission) media. By way of example, and not limitation, computer-readable storage media can comprise an array of storage elements, such as semiconductor memory (which may include without limitation dynamic or static RAM, ROM, EEPROM, and/or flash RAM), or ferroelectric, magnetoresistive, ovonic, polymeric, or phase-change memory; CD-ROM or other optical disk storage; and/or magnetic disk storage or other magnetic storage devices. Such storage media may store information in the form of instructions or data structures that can be accessed by a computer. Communication media can comprise any medium that can be used to carry desired program code in the form of instructions or data structures and that can be accessed by a computer, including any medium that facilitates transfer of a computer program from one place to another. Also, any connection is properly termed a computer-readable medium. For example, if the software is transmitted from a website, server, or other remote source using a coaxial cable, fiber optic cable, twisted pair, digital subscriber line (DSL), or wireless technology such as infrared, radio, and/or microwave, then the coaxial cable, fiber optic cable, twisted pair, DSL, or wireless technology such as infrared, radio, and/or microwave are included in the definition of medium. Disk and disc, as used herein, includes compact disc (CD), laser disc, optical disc, digital versatile disc (DVD), floppy disk and Blu-ray Disc™ (Blu-Ray Disc Association, Universal City, Calif.), where disks usually reproduce data magnetically, while discs reproduce data optically with lasers. Combinations of the above should also be included within the scope of computer-readable media.

An acoustic signal processing apparatus as described herein (e.g., apparatus A100 or MF100) may be incorporated into an electronic device that accepts speech input in order to control certain operations, or may otherwise benefit from separation of desired noises from background noises, such as communications devices. Many applications may benefit from enhancing or separating clear desired sound from background sounds originating from multiple directions. Such applications may include human-machine interfaces in electronic or computing devices which incorporate capabilities such as voice recognition and detection, speech enhancement and separation, voice-activated control, and the like. It may be desirable to implement such an acoustic signal processing apparatus to be suitable in devices that only provide limited processing capabilities.

The elements of the various implementations of the modules, elements, and devices described herein may be fabricated as electronic and/or optical devices residing, for example, on the same chip or among two or more chips in a chipset. One example of such a device is a fixed or programmable array of logic elements, such as transistors or gates. One or more elements of the various implementations of the apparatus described herein may be implemented in whole or in part as one or more sets of instructions arranged to execute on one or more fixed or programmable arrays of logic elements such as microprocessors, embedded processors, IP cores, digital signal processors, FPGAs, ASSPs, and ASICs.

It is possible for one or more elements of an implementation of an apparatus as described herein to be used to perform tasks or execute other sets of instructions that are not directly related to an operation of the apparatus, such as a task relating to another operation of a device or system in which the apparatus is embedded. It is also possible for one or more elements of an implementation of such an apparatus to have structure in common (e.g., a processor used to execute portions of code corresponding to different elements at different times, a set of instructions executed to perform tasks corresponding to different elements at different times, or an arrangement of electronic and/or optical devices performing operations for different elements at different times).

What is claimed is:

1. An apparatus for processing a multichannel signal, said apparatus comprising:

a filter bank having (A) a first filter configured to apply a plurality of first coefficients to a first audio signal that is based on the multichannel signal to produce a first output signal and (B) a second filter configured to apply a plurality of second coefficients to a second audio signal that is based on the multichannel signal to produce a second output signal;

a filter orientation module configured to produce an initial set of values for the plurality of first coefficients, based on a first source direction, and to produce an initial set of values for the plurality of second coefficients, based on a second source direction that is different than the first source direction;

a processor; and a filter updating module executed by the processor and configured (A) to determine, based on a plurality of filter responses at corresponding directions, a filter response that has a specified property, and (B) to update the initial set of values for the plurality of first coefficients, based on the first output signal and the second output signal and said filter response that has the specified property, wherein said specified property is a maximum value among said plurality of filter responses, and wherein updating the initial set of values for the plurality of first coefficients comprises adapting the initial set of values for the plurality of first coefficients based on the first output signal and the second output signal to produce an adapted set of values for the plurality of first coefficients, and normalizing the adapted set of values for the plurality of first coefficients based on the filter response that has the maximum value in order to produce a desired gain response with respect to direction.

2. The apparatus according to claim 1, wherein each filter response of said plurality of filter responses is a filter response, at said corresponding direction, of a set of values that is based on the initial set of values for the plurality of first coefficients.

3. The apparatus according to claim 1, wherein said filter updating module is configured to calculate a determined filter response that has a value at each frequency of a plurality of frequencies, and wherein said calculating the determined filter response includes performing said determining at each frequency of the plurality of frequencies, and wherein, at each frequency of the plurality of frequencies, said value of said determined filter response is said filter response that has the specified property among a plurality of filter responses at the frequency.

4. The apparatus according to claim 3, wherein, at each frequency of the plurality of frequencies, said value of said determined filter response is a maximum value among said plurality of filter responses at the frequency.

5. The apparatus according to claim 3, wherein said value of said determined filter response at a first frequency of the plurality of frequencies is a filter response in a first direction, and wherein said value of said determined filter response at a second frequency of the plurality of frequencies is a filter response in a second direction that is different than the first direction.

6. The apparatus according to claim 1, wherein said adapted set of values for the plurality of first coefficients includes (A) a first plurality of adapted values that correspond to a first frequency of said plurality of frequencies and (B) a second plurality of adapted values that correspond to a second frequency of said plurality of frequencies and said second frequency being different from said first frequency of said plurality of frequencies, and wherein said normalizing comprises (A) normalizing each value of said first plurality of adapted values, based on said value of said determined filter response that corresponds to said first frequency of said plurality of frequencies, and (B) normalizing each value of said second plurality of adapted values, based on said value of said determined filter response that corresponds to said second frequency of said plurality of frequencies.

7. The apparatus according to claim 1, wherein each value of the updated set of values for the plurality of first coefficients corresponds to a different value of the initial set of values for the plurality of first coefficients and to a frequency component of the multichannel signal, and wherein each value of the updated set of values for the plurality of first coefficients that corresponds to a frequency component in a first frequency range has the same value as said corresponding value of the initial set of values for the plurality of first coefficients.

8. The apparatus according to claim 1, wherein each of said plurality of the first and second coefficients corresponds to one among a plurality of frequency components of the multichannel signal.

9. The apparatus according to claim 1, wherein the initial set of values for the plurality of first coefficients describes a beam oriented in the first source direction.

10. The apparatus according to claim 1, wherein said filter updating module is configured to update the initial set of values for the plurality of first coefficients according to a result of applying a nonlinear bounded function to frequency components of the first and second output signals.

11. The apparatus according to claim 1, wherein said filter updating module is configured to update the initial set of values for the plurality of first coefficients according to a blind source separation learning rule.

12. The apparatus according to claim 1, wherein said updating the initial set of values for the plurality of first coefficients is based on a spatial constraint, and wherein said spatial constraint is based on the second source direction.

13. The apparatus according to claim 1, wherein said updating the initial set of values for the plurality of first coefficients includes attenuating a filter response of the plurality of first coefficients in the second source direction relative to a filter response of the plurality of first coefficients in the first source direction.

14. The apparatus according to claim 1, wherein said apparatus comprises a direction estimation module configured to calculate the first source direction based on information within the multichannel signal.

15. The apparatus according to claim 1, wherein said apparatus comprises a microphone array including a plurality of microphones, and wherein each channel of the multichannel signal is based on a signal produced by a different corresponding microphone of the plurality of microphones, and wherein the microphone array has an aperture of at least twenty centimeters.

16. The apparatus according to claim 1, wherein said apparatus comprises a microphone array including a plurality of microphones, and wherein each channel of the multichannel signal is based on a signal produced by a different corresponding microphone of the plurality of microphones, and wherein a distance between a first pair of adjacent microphones of the microphone array differs from a distance between a second pair of adjacent microphones of the microphone array.

17. The apparatus according to claim 1, wherein said filter bank includes a third filter configured to apply a plurality of third coefficients to the multichannel signal to produce a third output signal, and wherein said apparatus includes a noise reduction module configured to perform a noise reduction operation on the first output signal, based on information from the third output signal, to produce a dereverberated signal.

18. The apparatus according to claim 17, wherein each channel of said multichannel signal is based on a signal produced by a corresponding microphone of a plurality of microphones of an array, and wherein said filter orientation module is configured to produce a set of values for the plurality of third coefficients, based on a direction of an axis of the array.

19. The apparatus according to claim 1, wherein said filter updating module is configured to update the initial set of values for the plurality of first coefficients in a frequency domain, and wherein said filter bank is configured to apply the plurality of first coefficients to the first audio signal in the time domain.

20. A method of processing a multichannel signal by an apparatus, said method comprising:

applying a plurality of first coefficients to a first audio signal that is based on the multichannel signal to produce a first output signal, wherein the multichannel signal is received by a microphone array including a plurality of microphones;

applying a plurality of second coefficients to a second audio signal that is based on the multichannel signal to produce a second output signal;

producing an initial set of values for the plurality of first coefficients, based on a first source direction;

producing an initial set of values for the plurality of second coefficients, based on a second source direction that is different than the first source direction;

determining, based on a plurality of filter responses at corresponding directions, a filter response that has a specified property; and updating, using a processor, the initial set of values for the plurality of first coefficients, based on the first output signal and the second output signal and said filter response that has the specified property, wherein said specified property is a maximum value among said plurality of filter responses, wherein updating the initial set of values for the plurality of first coefficients comprises adapting the initial set of values for the plurality of first coefficients based on the first output signal and the second output signal to produce an adapted set of values for the plurality of first coefficients, and normalizing the adapted set of values for the plurality of first coefficients based on the filter response that has the maximum value in order to produce a desired gain response with respect to direction.

21. The method according to claim 20, wherein each filter response of said plurality of filter responses is a filter response, at said corresponding direction, of a set of values that is based on the initial set of values for the plurality of first coefficients.

22. The method according to claim 20, wherein said method includes calculating a determined filter response that has a value at each frequency of a plurality of frequencies, and wherein said calculating the determined filter response includes performing said determining at each frequency of the plurality of frequencies, and wherein, at each frequency of the plurality of frequencies, said value of said determined filter response is said filter response that has the specified property among a plurality of filter responses at the frequency.

23. The method according to claim 22, wherein, at each frequency of the plurality of frequencies, said value of said determined filter response is a maximum value among said plurality of filter responses at the frequency.

24. The method according to claim 22, wherein said value of said determined filter response at a first frequency of the plurality of frequencies is a filter response in a first direction, and wherein said value of said determined filter response at a second frequency of the plurality of frequencies is a filter response in a second direction that is different than the first direction.

25. The method according to claim 20, wherein said adapted set of values for the plurality of first coefficients includes (A) a first plurality of adapted values that correspond to a first frequency of said plurality of frequencies and (B) a second plurality of adapted values that correspond to a second frequency of said plurality of frequencies and said second frequency being different from said first frequency of said plurality of frequencies, and wherein said normalizing comprises (A) normalizing each value of said first plurality of adapted values, based on said value of said determined filter response that corresponds to said first frequency of said plurality of frequencies, and (B) normalizing each value of said second plurality of adapted values, based on said value of said determined filter response that corresponds to said second frequency of said plurality of frequencies.

26. The method according to claim 1, wherein each value of the updated set of values for the plurality of first coefficients corresponds to a different value of the initial set of values for the plurality of first coefficients and to a frequency component of the multichannel signal, and wherein each value of the updated set of values for the plurality of first coefficients that corresponds to a frequency component in a first frequency range has the same value as said corresponding value of the initial set of values for the plurality of first coefficients.

27. The method according to claim 20, wherein each of said plurality of the first and second coefficients corresponds to one among a plurality of frequency components of the multichannel signal.

28. The method according to claim 20, wherein the initial set of values for the plurality of first coefficients describes a beam oriented in the first source direction.

29. The method according to claim 20, wherein said updating the initial set of values for the plurality of first coefficients is performed according to a result of applying a nonlinear bounded function to frequency components of the first and second output signals.

30. The method according to claim 20, wherein said updating the initial set of values for the plurality of first coefficients is performed according to a blind source separation learning rule.

31. The method according to claim 20, wherein said updating the initial set of values for the plurality of first coefficients is based on a spatial constraint, and wherein said spatial constraint is based on the second source direction.

32. The method according to claim 20, wherein said updating the initial set of values for the plurality of first coefficients includes attenuating a filter response of the plurality of first coefficients in the second source direction relative to a filter response of the plurality of first coefficients in the first source direction.

33. The method according to claim 20, wherein said method includes calculating the first source direction based on information within the multichannel signal.

34. The method according to claim 20, wherein each channel of the multichannel signal is based on a signal produced by a different corresponding microphone of the plurality of microphones of the microphone array, and wherein the microphone array has an aperture of at least twenty centimeters.

35. The method according to claim 20, wherein each channel of the multichannel signal is based on a signal produced by a different corresponding microphone of the plurality of microphones of the microphone array, and wherein a distance between a first pair of adjacent microphones of the microphone array differs from a distance between a second pair of adjacent microphones of the microphone array.

36. The method according to claim 20, wherein said method includes:

applying a plurality of third coefficients to the multichannel signal to produce a third output signal; and performing a noise reduction operation on the first output signal, based on information from the third output signal, to produce a dereverberated signal.

37. The method according to claim 36, wherein each channel of said multichannel signal is based on a signal produced by a corresponding microphone of the plurality of microphones of the microphone array, and wherein said method includes producing a set of values for the plurality of third coefficients, based on a direction of an axis of the array.

38. The method according to claim 20, wherein said updating includes updating the initial set of values for the plurality of first coefficients in a frequency domain, and wherein said applying the plurality of first coefficients to the first audio signal is performed in the time domain.

39. An apparatus for processing a multichannel signal, comprising:

means for applying a plurality of first coefficients to a first audio signal that is based on the multichannel signal to produce a first output signal and for applying a plurality of second coefficients to a second audio signal that is based on the multichannel signal to produce a second output signal, wherein the multichannel signal is based on an acoustic signal;

means for producing an initial set of values for the plurality of first coefficients, based on a first source direction and for producing an initial set of values for the plurality of second coefficients, based on a second source direction that is different than the first source direction;

means for determining, based on a plurality of filter responses at corresponding directions, a filter response that has a specified property; and means for updating, using a processor, the initial set of values for the plurality of first coefficients, based on the first output signal and the second output signal and said filter response that has the specified property, wherein said specified property is a maximum value among said plurality of filter responses, and wherein the means for updating the initial set of values for the plurality of first coefficients comprises means for adapting the initial set of values for the plurality of first coefficients based on the first output signal and the second output signal to produce an adapted set of values for the plurality of first coefficients, and means for normalizing the adapted set of values for the plurality of first coefficients based on the filter response that has the maximum value in order to produce a desired gain filter response with respect to direction.

40. A non-transitory computer-readable storage medium comprising tangible features that when read by a processor cause the processor to:

apply a plurality of first coefficients to a first audio signal that is based on a multichannel signal to produce a first output signal;

apply a plurality of second coefficients to a second audio signal that is based on the multichannel signal to produce a second output signal, wherein the multichannel signal is based on an acoustic signal;

produce an initial set of values for the plurality of first coefficients, based on a first source direction;

produce an initial set of values for the plurality of second coefficients, based on a second source direction that is different than the first source direction;

determine, based on a plurality of filter responses at corresponding directions, a filter response that has a specified property; and update the initial set of values for the plurality of first coefficients, based on the first output signal and the second output signal and said filter response that has the specified property, wherein said specified property is a maximum value among said plurality of filter responses, and wherein updating the initial set of values for the plurality of first coefficients comprises adapting the initial set of values for the plurality of first coefficients based on the first output signal and the second output signal to produce an adapted set of values for the plurality of first coefficients, and normalizing the adapted set of values for the plurality of first coefficients based on the filter response that has the maximum value in order to produce a desired gain filter response with respect to direction.

* * * * *